US010973727B2

(12) United States Patent
Komatsu et al.

(10) Patent No.: US 10,973,727 B2
(45) Date of Patent: Apr. 13, 2021

(54) APPARATUS FOR FALL PREVENTION DURING WALKING, CONTROL DEVICE, CONTROL METHOD, AND RECORDING MEDIUM

(71) Applicant: Panasonic Intellectual Property Management Co., Ltd., Osaka (JP)

(72) Inventors: Mayumi Komatsu, Kyoto (JP); Stephen William John, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 478 days.

(21) Appl. No.: 16/057,853

(22) Filed: Aug. 8, 2018

(65) Prior Publication Data

US 2018/0344561 A1 Dec. 6, 2018

Related U.S. Application Data

(63) Continuation of application No. PCT/JP2018/000605, filed on Jan. 12, 2018.

(30) Foreign Application Priority Data

Jan. 19, 2017 (JP) ..... JP2017-007810
Nov. 8, 2017 (JP) ..... JP2017-215378

(51) Int. Cl.
*A61H 3/00* (2006.01)
*A61H 1/02* (2006.01)

(52) U.S. Cl.
CPC ..... *A61H 3/00* (2013.01); *A61H 1/024* (2013.01); *A61H 1/0237* (2013.01);
(Continued)

(58) Field of Classification Search
CPC ..... A61H 1/00; A61H 1/02; A61H 1/0237; A61H 1/024; A61H 1/0244; A61H 1/0255;
(Continued)

(56) References Cited

U.S. PATENT DOCUMENTS 4,688,559 A * 8/1987 Vito ..... A61F 5/0102 602/23
5,501,656 A * 3/1996 Homma ..... A61H 1/02 601/33
(Continued)

FOREIGN PATENT DOCUMENTS

JP 2007-307216 11/2007
JP 2010-131382 6/2010
JP 2015-002970 1/2015

OTHER PUBLICATIONS

International Search Report of PCT application No. PCT/JP2018/000605 dated Feb. 20, 2018.
(Continued)

*Primary Examiner* — Colin W Stuart
(74) *Attorney, Agent, or Firm* — Wenderoth, Lind & Ponack, L.L.P.

(57) ABSTRACT

An apparatus includes a first wire and a second wire which are coupled to a right upper ankle belt and a right lower ankle belt, a third wire and a fourth wire which are coupled to a left upper ankle belt and a left lower ankle belt, an obtainer obtaining information about a road surface where a user walks, and a controller controlling tensions of the first wire and the second wire at the same time and controlling tensions of the third wire and the fourth wire at the same time using a first stiffness target value corresponding to the first wire, a second stiffness target value corresponding to the second wire, a third stiffness target value corresponding to the third wire, and a fourth stiffness target value corre-
(Continued)

sponding to the fourth wire that are determined based on the information about the road surface.

21 Claims, 34 Drawing Sheets

(52) U.S. Cl.
CPC ..... *A61H 1/0244* (2013.01); *A61H 1/0262* (2013.01); *A61H 1/0266* (2013.01); *A61H 2003/007* (2013.01); *A61H 2201/018* (2013.01); *A61H 2201/0173* (2013.01); *A61H 2201/1215* (2013.01); *A61H 2201/149* (2013.01); *A61H 2201/163* (2013.01); *A61H 2201/165* (2013.01); *A61H 2201/1642* (2013.01); *A61H 2201/1652* (2013.01); *A61H 2201/5002* (2013.01); *A61H 2201/5007* (2013.01); *A61H 2201/5058* (2013.01); *A61H 2201/5061* (2013.01); *A61H 2201/5071* (2013.01); *A61H 2205/088* (2013.01); *A61H 2205/10* (2013.01); *A61H 2205/12* (2013.01)

(58) Field of Classification Search
CPC ..... A61H 1/0262; A61H 1/0266; A61H 3/00; A61H 2003/001; A61H 2201/0173; A61H 2201/1215; A61H 2201/1207; A61H 2201/164; A61H 2201/1642; A61H 2201/1671; A61H 2201/50; A61H 2201/5005; A61H 2201/5007; A61H 2201/5053; A61H 2201/5058; A61H 2201/5061; A61H 2201/5071; A61H 2201/62; A61H 2201/625; A61F 5/04; A61F 5/05841; A61F 5/0585; A61F 5/01; A61F 5/0102; A61F 5/0123; A61F 2/50
See application file for complete search history.

(56) References Cited

U.S. PATENT DOCUMENTS

| | | | | |
|---|---|---|---|---|
| 5,865,770 | A * | 2/1999 | Schectman | A61F 5/0102 601/23 |
| 6,213,922 | B1 * | 4/2001 | Afanasenko | A61F 5/01 482/124 |
| 2003/0092545 | A1 * | 5/2003 | Koscielny | A63B 21/4025 482/124 |
| 2003/0120183 | A1 * | 6/2003 | Simmons | G06F 3/011 600/595 |
| 2010/0113987 | A1 * | 5/2010 | Agrawal | B25J 9/0006 601/33 |
| 2011/0224586 | A1 | 9/2011 | Ikeuchi | |
| 2015/0359699 | A1 * | 12/2015 | Chang | A61G 5/1094 701/22 |
| 2016/0296411 | A1 * | 10/2016 | Shirato | A61H 3/04 |
| 2018/0064560 | A1 * | 3/2018 | Choi | A61F 2/70 |

OTHER PUBLICATIONS

Extended European Search Report dated Nov. 13, 2019 in European Patent Application No. 18742020.3.

* cited by examiner

FIG. 11A

| | FIG. 8 | A | B | C | D |
|---|---|---|---|---|---|
| L1 | OFF | ON | OFF | OFF | OFF |
| L2 | OFF | ON | ON | OFF | OFF |
| L3 | ON | ON | ON | ON | ON |
| L4 | OFF | ON | ON | OFF | OFF |
| L5 | OFF | ON | OFF | OFF | OFF |
| L6 | ON | ON | OFF | OFF | OFF |
| L7 | OFF | ON | ON | OFF | OFF |
| L8 | ON | ON | ON | ON | ON |
| L9 | OFF | ON | ON | OFF | OFF |
| L10 | ON | ON | OFF | ON | OFF |
| L11 | OFF | ON | OFF | ON | OFF |
| L12 | OFF | ON | ON | OFF | OFF |
| L13 | ON | ON | ON | ON | OFF |
| L14 | OFF | ON | ON | OFF | OFF |
| L15 | OFF | ON | OFF | OFF | OFF |
| L16 | ON | ON | ON | ON | OFF |
| L17 | OFF | ON | ON | OFF | ON |
| L18 | ON | ON | OFF | ON | ON |
| L19 | OFF | ON | ON | OFF | OFF |
| L20 | OFF | ON | ON | OFF | OFF |
| L21 | OFF | ON | OFF | OFF | OFF |
| L22 | ON | ON | ON | ON | OFF |
| L23 | OFF | ON | ON | OFF | OFF |
| L24 | ON | ON | ON | ON | OFF |
| L25 | OFF | ON | ON | OFF | OFF |
| L26 | ON | ON | ON | ON | OFF |
| PERCENTAGE OF COINCIDENCE [%] | | 38.46154 | 46.15385 | 92.30769 | 69.23077 |

FIG. 11B

| | FIG. 9 | A | B | C | D |
|---|---|---|---|---|---|
| L1 | OFF | ON | OFF | OFF | OFF |
| L2 | ON | ON | ON | OFF | OFF |
| L3 | ON | ON | ON | ON | ON |
| L4 | ON | ON | ON | OFF | OFF |
| L5 | OFF | ON | OFF | OFF | OFF |
| L6 | OFF | ON | OFF | OFF | OFF |
| L7 | ON | ON | ON | OFF | OFF |
| L8 | ON | ON | ON | ON | ON |
| L9 | ON | ON | ON | OFF | OFF |
| L10 | ON | ON | OFF | ON | OFF |
| L11 | OFF | ON | OFF | ON | OFF |
| L12 | ON | ON | ON | OFF | OFF |
| L13 | ON | ON | ON | ON | OFF |
| L14 | ON | ON | ON | OFF | OFF |
| L15 | OFF | ON | OFF | OFF | OFF |
| L16 | ON | ON | ON | ON | OFF |
| L17 | ON | ON | ON | OFF | ON |
| L18 | ON | ON | OFF | ON | ON |
| L19 | ON | ON | ON | OFF | OFF |
| L20 | ON | ON | ON | OFF | OFF |
| L21 | ON | ON | OFF | OFF | OFF |
| L22 | ON | ON | ON | ON | OFF |
| L23 | ON | ON | ON | OFF | OFF |
| L24 | ON | ON | ON | ON | OFF |
| L25 | OFF | ON | ON | OFF | OFF |
| L26 | ON | ON | ON | ON | OFF |
| PERCENTAGE OF COINCIDENCE [%] | | 76.92308 | 84.61538 | 53.84615 | 38.46154 |

| GAIT CYCLE | NORMAL CONDITION |
|---|---|
| 0% | Up |
| 10% | Up |
| 48% | Up |
| 60% | Down |
| 98% | Up |

| | LARGE-ROAD-SURFACE-R GROUP | SMALL-ROAD-SURFACE-R GROUP |
|---|---|---|
| INCREASE TIME | 30 | 50 |
| DECREASE TIME | 2 | 2 |

| | SNOW | RAIN | WET | SLIPPERY |
|---|---|---|---|---|
| RATE OF INCREASE | 1.5 | 1.2 | 1.2 | 1.8 |

| GAIT CYCLE | NORMAL CONDITION | SNOW |
|---|---|---|
| 0% | 30 | 45 |
| 10% | 30 | 45 |
| 48% | 30 | 45 |
| 60% | 2 | 2 |
| 98% | 30 | 45 |

APPARATUS FOR FALL PREVENTION DURING WALKING, CONTROL DEVICE, CONTROL METHOD, AND RECORDING MEDIUM

BACKGROUND

1. Technical Field

The present disclosure relates to an apparatus for fall prevention during walking, which is worn by a user to prevent the user from falling in their left-right direction when assisting the user in their walking activities, a control device, a control method, and a recording medium.

2. Description of the Related Art

Devices called assist devices that people wear for the purposes of power assistance, assisting the elderly or mobility impaired persons in their activities, rehabilitation support, or the like have been intensively developed in recent years. Such devices work when persons wear them, and thus highly human-friendly activity methods are demanded. It is commonly known that when a person moves their joints, torques of the joints necessary for actions are generated and at the same time antagonistic muscles cause changes in stiffness. Thus, a method that uses a member capable of appropriately setting stiffnesses to be transmitted to the body of a person is known as a highly human-friendly activity method (see, for example, Japanese Unexamined Patent Application Publication No. 2015-2970 and Japanese Patent No. 5259553).

SUMMARY

In particular, when a device assists a person wearing the device in walking, the device is desirably capable of preventing the person from falling not only in the forward-backward direction, which is the walking direction, but also in the transverse direction, i.e., falling to the left and right, in order to allow the person to continue walking safely.

However, many typical assist devices assume only an assistance method in a direction in which assistance is necessary, namely, in the forward-backward direction in the case of walking.

One non-limiting and exemplary embodiment provides an apparatus for fall prevention during walking, which can prevent a user from falling to the left and falling to the right during walking, a control device, a control method, and a recording medium.

In one general aspect, the techniques disclosed here feature an apparatus for fall prevention during walking, including a left upper ankle belt to be fixed on an upper part of a left ankle of a user, a right upper ankle belt to be fixed on an upper part of a right ankle of the user, a left lower ankle belt to be fixed on a lower part of the left ankle of the user, a right lower ankle belt to be fixed on a lower part of the right ankle of the user, a first wire coupled to the right upper ankle belt and the right lower ankle belt, a second wire coupled to the right upper ankle belt and the right lower ankle belt, at least a portion of the first wire being located along a right side surface of the right ankle, at least a portion of the second wire being located along a left side surface of the right ankle, a third wire coupled to the left upper ankle belt and the left lower ankle belt, a fourth wire coupled to the left upper ankle belt and the left lower ankle belt, at least a portion of the third wire being located along a right side surface of the left ankle, at least a portion of the fourth wire being located along a left side surface of the left ankle, a first tension controller that controls a tension of the first wire, a second tension controller that controls a tension of the second wire, a third tension controller that controls a tension of the third wire, a fourth tension controller that controls a tension of the fourth wire, an obtainer that obtains information about a road surface where the user walks, and a controller, wherein the controller determines, based on the information about the road surface, a first stiffness target value of the first wire, a second stiffness target value of the second wire, a third stiffness target value of the third wire, and a fourth stiffness target value of the fourth wire, the controller causes the first tension controller to control the tension of the first wire using the first stiffness target value, the controller causes the second tension controller to control the tension of the second wire using the second stiffness target value, the controller causes the third tension controller to control the tension of the third wire using the third stiffness target value, the controller causes the fourth tension controller to control the tension of the fourth wire using the fourth stiffness target value, the tension of the first wire and the tension of the second wire are controlled at a same time, and the tension of the third wire and the tension of the fourth wire are controlled at a same time.

According to the present disclosure, it is possible to prevent a user from falling to the left or falling to the right during walking. Additional benefits and advantages of an aspect of the present disclosure will become apparent from the specification and drawings. The benefits and/or advantages may be individually provided by various aspects and features disclosed in the specification and drawings, which need not all be provided in order to obtain one or more of such benefits and/or advantages.

It should be noted that general or specific embodiments may be implemented as a system, a method, an integrated circuit, a computer program, a storage medium, or any selective combination thereof.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

BRIEF DESCRIPTION OF THE DRAWINGS

FIG. 3C is a side view of the example of the tension application mechanism of the apparatus for fall prevention during walking, illustrating the configuration thereof with a pulley, a wire, a motor, and so on;

FIG. 11A is a diagram illustrating the respective states of the foot sensors illustrated in FIG. 8 and percentages of coincidence with the signal models A to D of the foot sensors illustrated in FIG. 10;

FIG. 11B is a diagram illustrating the respective states of the foot sensors illustrated in FIG. 9 and percentages of coincidence with the signal models A to D of the foot sensors illustrated in FIG. 10;

DETAILED DESCRIPTION

Figure 1A:
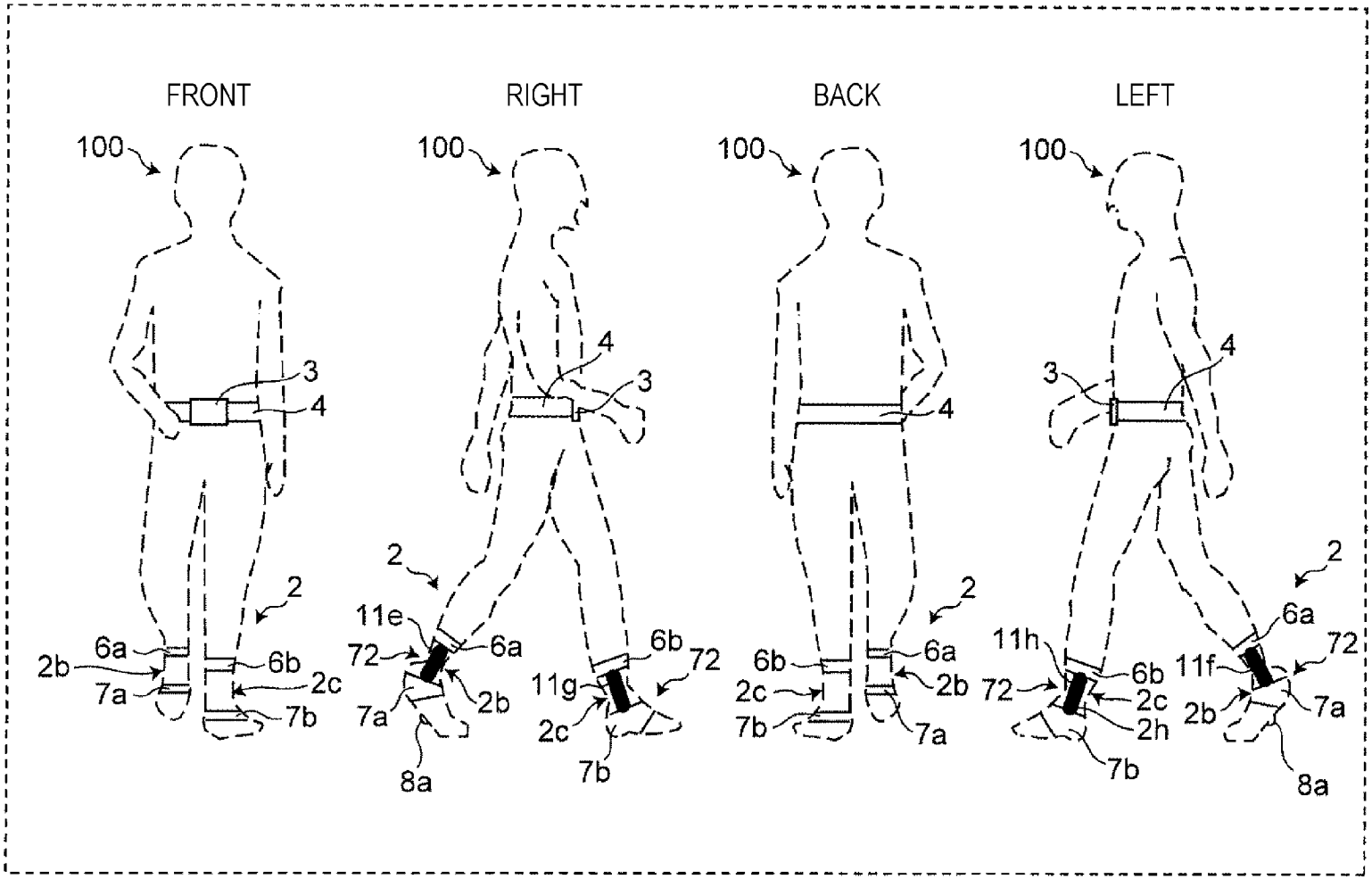
FIG. 1A is a diagram illustrating the arrangement of upper ankle belts, lower ankle belts, and wires as a first example of an assist garment that is an apparatus for fall prevention during walking in a first embodiment of the present disclosure.

The following describes embodiments of the present disclosure in detail with reference to the drawings.

Prior to detailed description of embodiments of the present disclosure with reference to the drawings, a variety of aspects of the present disclosure will be described.

A first aspect of the present disclosure provides an apparatus for fall prevention during walking, including a left upper ankle belt to be fixed on an upper part of a left ankle of a user, a right upper ankle belt to be fixed on an upper part of a right ankle of the user, a left lower ankle belt to be fixed on a lower part of the left ankle of the user, a right lower ankle belt to be fixed on a lower part of the right ankle of the user, a first wire coupled to the right upper ankle belt and the right lower ankle belt, a second wire coupled to the right upper ankle belt and the right lower ankle belt, at least a portion of the first wire being located along a right side surface of the right ankle, at least a portion of the second wire being located along a left side surface of the right ankle, a third wire coupled to the left upper ankle belt and the left lower ankle belt, a fourth wire coupled to the left upper ankle belt and the left lower ankle belt, at least a portion of the third wire being located along a right side surface of the left ankle, at least a portion of the fourth wire being located along a left side surface of the left ankle, a first tension controller that controls a tension of the first wire, a second tension controller that controls a tension of the second wire, a third tension controller that controls a tension of the third wire, a fourth tension controller that controls a tension of the fourth wire, an obtainer that obtains information about a road surface where the user walks, and a controller, wherein the controller determines, based on the information about the road surface, a first stiffness target value of the first wire, a second stiffness target value of the second wire, a third stiffness target value of the third wire, and a fourth stiffness target value of the fourth wire, the controller causes the first tension controller to control the tension of the first wire using the first stiffness target value, the controller causes the second tension controller to control the tension of the second wire using the second stiffness target value, the controller causes the third tension controller to control the tension of the third wire using the third stiffness target value, the controller causes the fourth tension controller to control the tension of the fourth wire using the fourth stiffness target value, the tension of the first wire and the tension of the second wire are controlled at a same time, and the tension of the third wire and the tension of the fourth wire are controlled at a same time.

According to the first aspect, the tension of each wire is controlled by using a stiffness target value based on road surface information. Thus, the user can be prevented from falling to the left and falling to the right during walking.

A second aspect of the present disclosure provides the apparatus for fall prevention during walking according to the first aspect, in which the first tension controller includes a first motor having a first rotating shaft to which the first wire is coupled, the first motor controlling rotation of the first rotating shaft to thereby control the tension of the first wire, the second tension controller includes a second motor having a second rotating shaft to which the second wire is coupled, the second motor controlling rotation of the second rotating shaft to thereby control the tension of the second wire, the third tension controller includes a third motor having a third rotating shaft to which the third wire is coupled, the third motor controlling rotation of the third rotating shaft to thereby control the tension of the third wire, the fourth tension controller includes a fourth motor having a fourth rotating shaft to which the fourth wire is coupled, the fourth motor controlling rotation of the fourth rotating shaft to thereby control the tension of the fourth wire, and the controller instructs the first motor to control the rotation of the first rotating shaft, instructs the second motor to control the rotation of the second rotating shaft, instructs the third motor to control the rotation of the third rotating shaft, and instructs the fourth motor to control the rotation of the fourth rotating shaft.

According to the second aspect, each tension controller is a motor that controls a tension of a corresponding one of the wires. Thus, the motors can cause the corresponding wires to generate tensions proportional to the amounts of change in length in a manner similar to that of springs, thereby preventing the user from falling to the left and falling to the right during walking.

A third aspect of the present disclosure provides the apparatus for fall prevention during walking according to the first aspect, in which the apparatus for fall prevention during walking further includes a waist belt to be fixed on a waist of the user, a left above-knee belt to be fixed above a knee of the left leg, a right above-knee belt to be fixed above a knee of the right leg, a fifth wire coupled to the waist belt and the right above-knee belt, a sixth wire coupled to the waist belt and the right above-knee belt, a seventh wire coupled to the waist belt and the left above-knee belt, an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, a fifth tension controller that controls a tension of the fifth wire, a sixth tension controller that controls a tension of the sixth wire, a seventh tension controller that controls a tension of the seventh wire, and an eighth tension controller that controls a tension of the eighth wire; the controller determines, based on the information about the road surface, a fifth stiffness target value of the fifth wire, a sixth stiffness target value of the sixth wire, a seventh stiffness target value of the seventh wire, and an eighth stiffness target value of the eighth wire; the controller causes the fifth tension controller to control the tension of the fifth wire using the fifth stiffness target value; the controller causes the sixth tension controller to control the tension of the sixth wire using the sixth stiffness target value; the controller causes the seventh tension controller to control the tension of the seventh wire using the seventh stiffness target value; the controller causes the eighth tension controller to control the tension of the eighth wire using the eighth stiffness target value; the tension of the fifth wire and the tension of the sixth wire are controlled at a same time; and the tension of the seventh wire and the tension of the eighth wire are controlled at a same time.

According to the third aspect, the tension of each wire is controlled by using a stiffness target value based on road surface information. Thus, the user can be prevented from falling to the left and falling to the right during walking.

A fourth aspect of the present disclosure provides the apparatus for fall prevention during walking according to the third aspect, in which the fifth tension controller includes a fifth motor having a fifth rotating shaft to which the fifth wire is coupled, the fifth motor controlling rotation of the fifth rotating shaft to thereby control the tension of the fifth wire, the sixth tension controller includes a sixth motor having a sixth rotating shaft to which the sixth wire is coupled, the sixth motor controlling rotation of the sixth rotating shaft to thereby control the tension of the sixth wire, the seventh tension controller includes a seventh motor having a seventh rotating shaft to which the seventh wire is coupled, the seventh motor controlling rotation of the seventh rotating shaft to thereby control the tension of the seventh wire, the eighth tension controller includes an eighth motor having an eighth rotating shaft to which the eighth wire is coupled, the eighth motor controlling rotation of the eighth rotating shaft to thereby control the tension of the eighth wire, and the controller instructs the fifth tension controller to control the rotation of the fifth rotating shaft, instructs the sixth tension controller to control the rotation of the sixth rotating shaft, instructs the seventh tension controller to control the rotation of the seventh rotating shaft, and instructs the eighth tension controller to control the rotation of the eighth rotating shaft.

According to the fourth aspect, each tension controller is a motor that controls a tension of a corresponding one of the wires. Thus, the motors can cause the corresponding wires to generate tensions proportional to the amounts of change in length in a manner similar to that of springs, thereby preventing the user from falling to the left and falling to the right during walking.

A fifth aspect of the present disclosure provides an apparatus for fall prevention during walking, including a waist belt to be fixed on a waist of a user, a left above-knee belt to be fixed above a knee of a left leg of the user, a right above-knee belt to be fixed above a knee of a right leg of the user, a fifth wire coupled to the waist belt and the right above-knee belt, a sixth wire coupled to the waist belt and the right above-knee belt, a seventh wire coupled to the waist belt and the left above-knee belt, an eighth wire coupled to the waist belt and the left above-knee belt, at least a portion of the fifth wire being located along a right side surface of a right thigh of the user, at least a portion of the sixth wire being located along a left side surface of the right thigh, at least a portion of the seventh wire being located along a right side surface of a left thigh of the user, at least a portion of the eighth wire being located along a left side surface of the left thigh, a fifth tension controller that controls a tension of the fifth wire, a sixth tension controller that controls a tension of the sixth wire, a seventh tension controller that controls a tension of the seventh wire, an eighth tension controller that controls a tension of the eighth wire, an obtainer that obtains information about a road surface where the user walks, and a controller, wherein the stiffness controller determines, based on the information about the road surface, a fifth stiffness target value of the fifth wire, a sixth stiffness target value of the sixth wire, a seventh stiffness target value of the seventh wire, and an eighth stiffness target value of the eighth wire, the controller causes the fifth tension controller to control the tension of the fifth wire using the fifth stiffness target value, the controller causes the sixth tension controller to control the tension of the sixth wire using the sixth stiffness target value, the controller causes the seventh tension controller to control the tension of the seventh wire using the seventh stiffness target value, the controller causes the eighth tension controller to control the tension of the eighth wire using the eighth stiffness target value, the tension of the fifth wire and the tension of the sixth wire are controlled at a same time, and the tension of the seventh wire and the tension of the eighth wire are controlled at a same time.

According to the fifth aspect, the tension of each wire is controlled by using a stiffness target value based on road surface information. Thus, the user can be prevented from falling to the left and falling to the right during walking.

A sixth aspect of the present disclosure provides the apparatus for fall prevention during walking according to the fifth aspect, in which the fifth tension controller includes a fifth motor having a fifth rotating shaft to which the fifth wire is coupled, the fifth motor controlling rotation of the fifth rotating shaft to thereby control the tension of the fifth wire, the sixth tension controller includes a sixth motor having a sixth rotating shaft to which the sixth wire is coupled, the sixth motor controlling rotation of the sixth rotating shaft to thereby control the tension of the sixth wire, the seventh tension controller includes a seventh motor having a seventh rotating shaft to which the seventh wire is coupled, the seventh motor controlling rotation of the seventh rotating shaft to thereby control the tension of the seventh wire, the eighth tension controller includes an eighth motor having an eighth rotating shaft to which the eighth wire is coupled, the eighth motor controlling rotation of the eighth rotating shaft to thereby control the tension of the eighth wire, and the controller instructs the fifth tension controller to control the rotation of the fifth rotating shaft, instructs the sixth tension controller to control the rotation of the sixth rotating shaft, instructs the seventh tension controller to control the rotation of the seventh rotating shaft, and instructs the eighth tension controller to control the rotation of the eighth rotating shaft.

According to the sixth aspect, each tension controller is a motor that controls a tension of a corresponding one of the wires. Thus, the motors can cause the corresponding wires to generate tensions proportional to the amounts of change in length in a manner similar to that of springs, thereby preventing the user from falling to the left and falling to the right during walking.

A seventh aspect of the present disclosure provides the apparatus for fall prevention during walking according to any one of the first to fourth aspects, in which the first stiffness target value is equal to the second stiffness target value, and the third stiffness target value is equal to the fourth stiffness target value.

An eighth aspect of the present disclosure provides the apparatus for fall prevention during walking according to any one of the third to sixth aspects, in which the fifth stiffness target value is equal to the sixth stiffness target value, and the seventh stiffness target value is equal to the eighth stiffness target value.

A ninth aspect of the present disclosure provides the apparatus for fall prevention during walking according to the second aspect, in which the controller (i) provides an instruction to control the rotation of the first rotating shaft on the basis of a force generated in the first wire, provides an instruction to control the rotation of the second rotating shaft on the basis of a force generated in the second wire, provides an instruction to control the rotation of the third rotating shaft on the basis of a force generated in the third wire, and provides an instruction to control the rotation of the fourth rotating shaft on the basis of a force generated in the fourth wire, or (ii) provides an instruction to control the rotation of the first rotating shaft on the basis of a length of the first wire, provides an instruction to control the rotation of the second rotating shaft on the basis of a length of the second wire, provides an instruction to control the rotation of the third rotating shaft on the basis of a length of the third wire, and provides an instruction to control the rotation of the fourth rotating shaft on the basis of a length of the fourth wire.

A tenth aspect of the present disclosure provides the apparatus for fall prevention during walking according to the fourth or sixth aspect, in which the controller (i) provides an instruction to control the rotation of the fifth rotating shaft on the basis of a force generated in the fifth wire, provides an instruction to control the rotation of the sixth rotating shaft on the basis of a force generated in the sixth wire, provides an instruction to control the rotation of the seventh rotating shaft on the basis of a force generated in the seventh wire, and provides an instruction to control the rotation of the eighth rotating shaft on the basis of a force generated in the eighth wire, or (ii) provides an instruction to control the rotation of the fifth rotating shaft on the basis of a length of the fifth wire, provides an instruction to control the rotation of the sixth rotating shaft on the basis of a length of the sixth wire, provides an instruction to control the rotation of the seventh rotating shaft on the basis of a length of the seventh wire, and provides an instruction to control the rotation of the eighth rotating shaft on the basis of a length of the eighth wire.

An eleventh aspect of the present disclosure provides the apparatus for fall prevention during walking according to any one of the first to fourth and ninth aspects, in which the obtainer includes first foot sensors located on a sole of a right foot of the user, second foot sensors located on a sole of a left foot of the user, and a road surface R estimator, the first foot sensors obtain first contact state information about a contact between the right foot and the road surface when the user is walking, the second foot sensors obtain second contact state information about a contact between the left foot and the road surface when the user is walking, the road surface R estimator obtains, based on contact state information including the first contact state information and the second contact state information, information about a curvature of the road surface as the information about the road surface, and the controller sets the first stiffness target value to be larger than an initially set value and sets the second stiffness target value to be larger than an initially set value when the information about the road surface includes a curvature of the road surface less than or equal to a threshold.

According to the eleventh aspect, when a road surface has a curvature less than or equal to a threshold and is likely to cause falling, the first stiffness target value and the second stiffness target value are set to be larger than the respective initially set stiffness target values, thereby preventing falling. In addition, the use of foot sensors eliminates the need for the user to spontaneously input road surface information. The user is only required to walk while wearing the apparatus for fall prevention during walking, thereby automatically obtaining road surface information.

A twelfth aspect of the present disclosure provides the apparatus for fall prevention during walking according to any one of the first to fourth and ninth aspects, in which the obtainer includes first foot sensors located on a sole of a right foot of the user, second foot sensors located on a sole of a left foot of the user, and a road surface R estimator, the first foot sensors obtain first contact state information about a contact between the right foot and the road surface when the user is walking, the second foot sensors obtain second contact state information about a contact between the left foot and the road surface when the user is walking, the road surface R estimator obtains information about a curvature of the road surface as the information about the road surface on the basis of contact state information including the first contact state information and the second contact state information, and the controller sets the first stiffness target value to be smaller than an initially set value and sets the second stiffness target value to be smaller than an initially set value when the information about the road surface includes a curvature of the road surface larger than a threshold.

According to the twelfth aspect, when a road surface has a curvature larger than a threshold and is less likely to cause falling, the first stiffness target value and the second stiffness target value are set to be smaller than the respective initially set stiffness target values, thereby increasing the degree of freedom of the thigh or ankle to facilitate activities.

A thirteenth aspect of the present disclosure provides the apparatus for fall prevention during walking according to any one of the first to tenth aspects, in which the obtainer includes first foot sensors located on a sole of a right foot of the user, second foot sensors located on a sole of a left foot of the user, and a road surface R estimator, the first foot sensors obtain first contact state information about a contact between the right foot and the road surface when the user is walking, the second foot sensors obtain second contact state information about a contact between the left foot and the road surface when the user is walking, and the road surface R estimator obtains information about a curvature of the road surface as the information about the road surface on the basis of contact state information obtained at a timing when the sole of the right foot touches the road surface and/or a timing when the sole of the left foot touches the road surface, the contact state information being included in the first contact state information and the second contact state information.

According to the thirteenth aspect, the road surface R estimator can obtain, based on contact state information obtained at a timing when the sole of a foot is in contact with a road surface among the contact state information obtained by the foot sensors, information about a curvature of the road surface as the information about the road surface, which can be used to perform control for fall prevention. For example, contact state information obtained at a timing when the entire sole is in contact with a road surface while the user is walking on a flat road surface is used, thus enabling more accurate acquisition of road surface information.

A fourteenth aspect of the present disclosure provides the apparatus for fall prevention during walking according to any one of the first to tenth aspects, in which the obtainer includes first foot sensors located on a sole of a right foot of the user, second foot sensors located on a sole of a left foot of the user, and a road surface R estimator, the first foot sensors obtain first contact state information about a contact between the right foot and the road surface when the user is walking, the second foot sensors obtain second contact state information about a contact between the left foot and the road surface when the user is walking, the road surface R estimator obtains information about presence or absence of a step on the road surface as the information about the road surface on the basis of the first contact state information and the second contact state information, and the controller independently sets the first stiffness target value and the second stiffness target value, sets the first stiffness target value to be larger than an initially set value, and sets the second stiffness target value to be larger than an initially set value when the information about the road surface indicates that the road surface includes a step.

According to the fourteenth aspect, for example, when about half the sole of a foot of the user is above a ditch or an opening during walking, the road surface R estimator can estimate information indicating that a leg touches a step on the road surface. As a result, the stiffness controller can perform control to change stiffness target values to be transmitted to the left side surfaces and right side surfaces of the thighs or ankles, achieving fall prevention.

A fifteenth aspect of the present disclosure provides the apparatus for fall prevention during walking according to any one of the first to tenth aspects, in which the obtainer includes first foot sensors located on a sole of a right foot of the user, second foot sensors located on a sole of a left foot of the user, and a road surface condition obtainer, the first foot sensors obtain first contact state information about a contact between the right foot and the road surface when the user is walking, the second foot sensors obtain second contact state information about a contact between the left foot and the road surface when the user is walking, the road surface condition obtainer obtains, based on the first contact state information and the second contact state information, information about road surface conditions that are likely to cause falling as the information about the road surface, and the controller independently sets the first stiffness target value and the second stiffness target value, sets the first stiffness target value to be larger than an initially set value, and sets the second stiffness target value to be larger than an initially set value when the information about the road surface indicates road surface conditions that are likely to cause falling.

According to the fifteenth aspect, when the road surface condition obtainer obtains information about road surface conditions that are likely to cause falling, the stiffness controller performs control to change stiffness target values to be transmitted to the left side surfaces and right side surfaces of the thighs or ankles, achieving fall prevention.

A sixteenth aspect of the present disclosure provides a control device for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire being located along a right side surface of the right ankle, at least a portion of the second wire being located along a left side surface of the right ankle, at least a portion of the third wire being located along a right side surface of the left ankle, at least a portion of the fourth wire being located along a left side surface of the left ankle, the control device including a first tension controller that controls a tension of the first wire, a second tension controller that controls a tension of the second wire, a third tension controller that controls a tension of the third wire, a fourth tension controller that controls a tension of the fourth wire, an obtainer that obtains information about a road surface where the user walks, and a controller, wherein the controller determines, based on the information about the road surface, a first stiffness target value of the first wire, a second stiffness target value of the second wire, a third stiffness target value of the third wire, and a fourth stiffness target value of the fourth wire, the controller causes the first tension controller to control the tension of the first wire using the first stiffness target value, the controller causes the second tension controller to control the tension of the second wire using the second stiffness target value, the controller causes the third tension controller to control the tension of the third wire using the third stiffness target value, the controller causes the fourth tension controller to control the tension of the fourth wire using the fourth stiffness target value, the tension of the first wire and the tension of the second wire are controlled at a same time, and the tension of the third wire and the tension of the fourth wire are controlled at a same time.

A seventeenth aspect of the present disclosure provides a control device for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, the control device including a fifth tension controller that controls a tension of the fifth wire, a sixth tension controller that controls a tension of the sixth wire, a seventh tension controller that controls a tension of the seventh wire, an eighth tension controller that controls a tension of the eighth wire, an obtainer that obtains information about a road surface where the user walks, and a controller, wherein the controller determines, based on the information about the road surface, a fifth stiffness target value of the fifth wire, a sixth stiffness target value of the sixth wire, a seventh stiffness target value of the seventh wire, and an eighth stiffness target value of the eighth wire, the controller causes the fifth tension controller to control the tension of the fifth wire using the fifth stiffness target value, the controller causes the sixth tension controller to control the tension of the sixth wire using the sixth stiffness target value, the controller causes the seventh tension controller to control the tension of the seventh wire using the seventh stiffness target value, the controller causes the eighth tension controller to control the tension of the eighth wire using the eighth stiffness target value, the tension of the fifth wire and the tension of the sixth wire are controlled at a same time, and the tension of the seventh wire and the tension of the eighth wire are controlled at a same time.

According to the sixteenth and seventeenth aspects, the tension of each wire is controlled by using a stiffness target value based on road surface information. Thus, the user can be prevented from falling to the left and falling to the right during walking.

An eighteenth aspect of the present disclosure provides a control method for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire being located along a right side surface of the right ankle, at least a portion of the second wire being located along a left side surface of the right ankle, at least a portion of the third wire being located along a right side surface of the left ankle, at least a portion of the fourth wire being located along a left side surface of the left ankle, the control method including obtaining information about a road surface where the user walks; determining, based on the information about the road surface, a first stiffness target value of the first wire, a second stiffness target value of the second wire, a third stiffness target value of the third wire, and a fourth stiffness target value of the fourth wire; controlling a tension of the first wire using the first stiffness target value; controlling a tension of the second wire using the second stiffness target value; controlling a tension of the third wire using the third stiffness target value; and controlling a tension of the fourth wire using the fourth stiffness target value, wherein the tension of the first wire and the tension of the second wire are controlled at a same time, and the tension of the third wire and the tension of the fourth wire are controlled at a same time.

A nineteenth aspect of the present disclosure provides a control method for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, the control method including obtaining information about a road surface where the user walks; determining, based on the information about the road surface, a fifth stiffness target value of the fifth wire, a sixth stiffness target value of the sixth wire, a seventh stiffness target value of the seventh wire, and an eighth stiffness target value of the eighth wire; controlling a tension of the fifth wire using the fifth stiffness target value; controlling a tension of the sixth wire using the sixth stiffness target value; controlling a tension of the seventh wire using the seventh stiffness target value; and controlling a tension of the eighth wire using the eighth stiffness target value, wherein the tension of the fifth wire and the tension of the sixth wire are controlled at a same time, and the tension of the seventh wire and the tension of the eighth wire are controlled at a same time.

According to the eighteenth and nineteenth aspects, the tension of each wire is controlled by using a stiffness target value based on road surface information. Thus, the user can be prevented from falling to the left and falling to the right during walking.

A twentieth aspect of the present disclosure provides a recording medium storing a program for causing a computer to execute a control method for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire being located along a right side surface of the right ankle, at least a portion of the second wire being located along a left side surface of the right ankle, at least a portion of the third wire being located along a right side surface of the left ankle, at least a portion of the fourth wire being located along a left side surface of the left ankle, the recording medium being a non-volatile computer-readable recording medium, the control method including obtaining information about a road surface where the user walks; determining, based on the information about the road surface, a first stiffness target value of the first wire, a second stiffness target value of the second wire, a third stiffness target value of the third wire, and a fourth stiffness target value of the fourth wire; controlling a tension of the first wire using the first stiffness target value; controlling a tension of the second wire using the second stiffness target value; controlling a tension of the third wire using the third stiffness target value; and controlling a tension of the fourth wire using the fourth stiffness target value, wherein the tension of the first wire and the tension of the second wire are controlled at a same time, and the tension of the third wire and the tension of the fourth wire are controlled at a same time.

A twenty-first aspect of the present disclosure provides a recording medium storing a program for causing a computer to execute a control method for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, the recording medium being a non-volatile computer-readable recording medium, the control method including obtaining information about a road surface where the user walks; determining, based on the information about the road surface, a fifth stiffness target value of the fifth wire, a sixth stiffness target value of the sixth wire, a seventh stiffness target value of the seventh wire, and an eighth stiffness target value of the eighth wire; controlling a tension of the fifth wire using the fifth stiffness target value; controlling a tension of the sixth wire using the sixth stiffness target value; controlling a tension of the seventh wire using the seventh stiffness target value; and controlling a tension of the eighth wire using the eighth stiffness target value, wherein the tension of the fifth wire and the tension of the sixth wire are controlled at a same time, and the tension of the seventh wire and the tension of the eighth wire are controlled at a same time.

According to the twentieth and twenty-first aspects, the tension of each wire is controlled by using a stiffness target value based on road surface information. Thus, the user can be prevented from falling to the left and falling to the right during walking.

The following describes embodiments of the present disclosure in detail with reference to the drawings.

First Embodiment

Figure 1B:
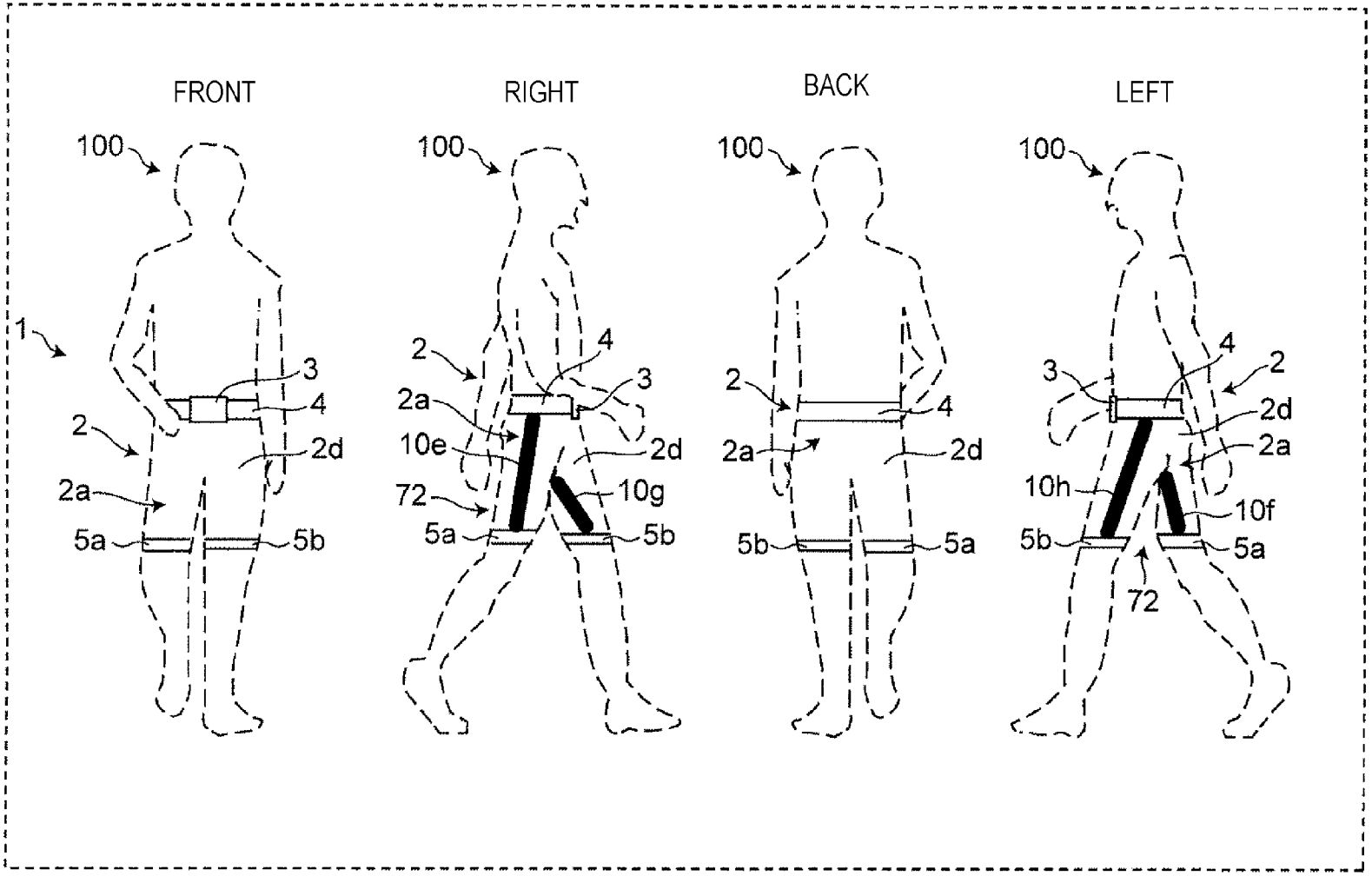
FIG. 1B is a diagram illustrating the arrangement of assist pants and wires as a second example of the assist garment.
Figure 1C:
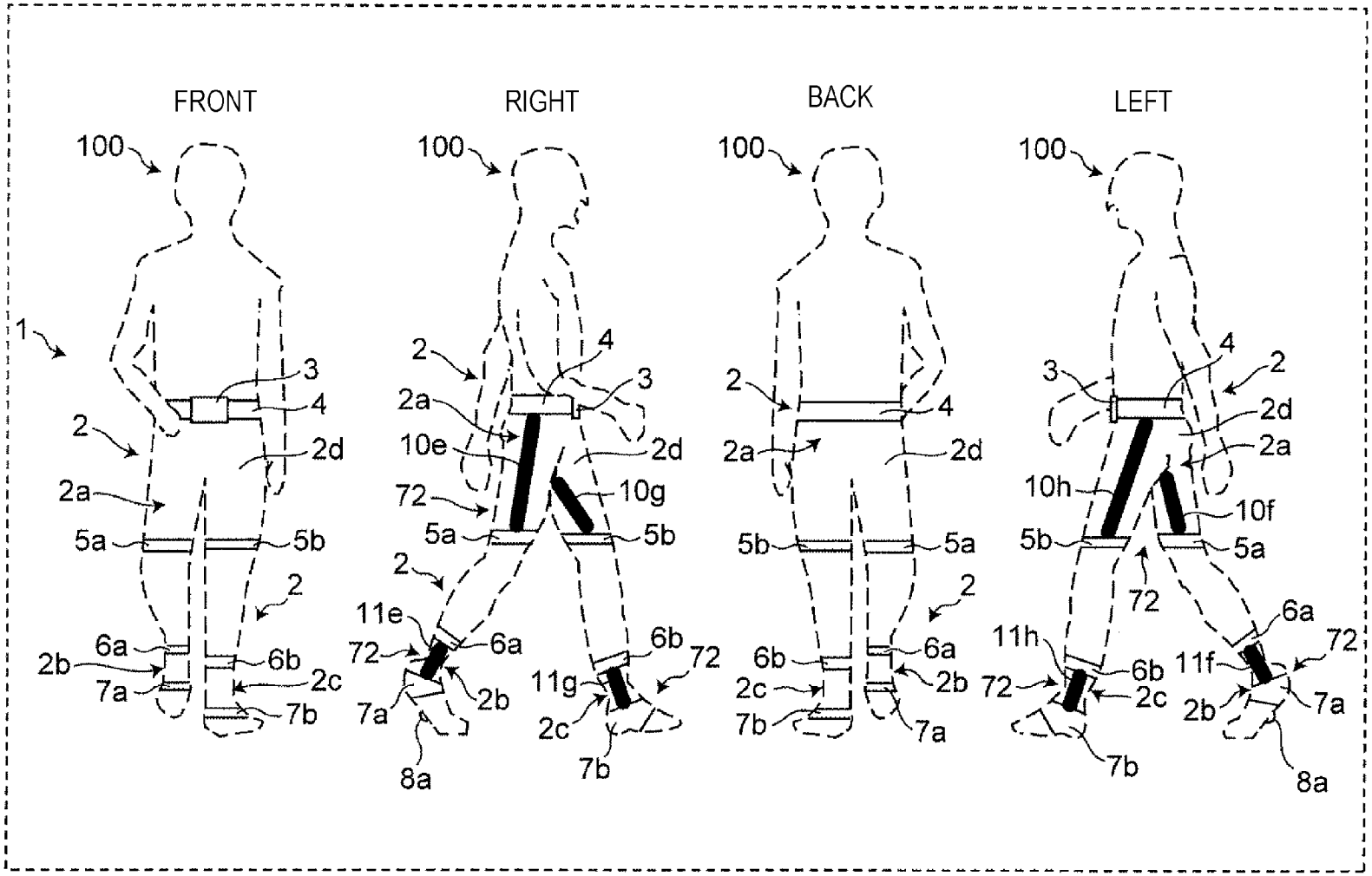
FIG. 1C is a diagram illustrating the arrangement of upper ankle belts, lower ankle belts, assist pants, and wires as a third example of the assist garment.
Figure 2:
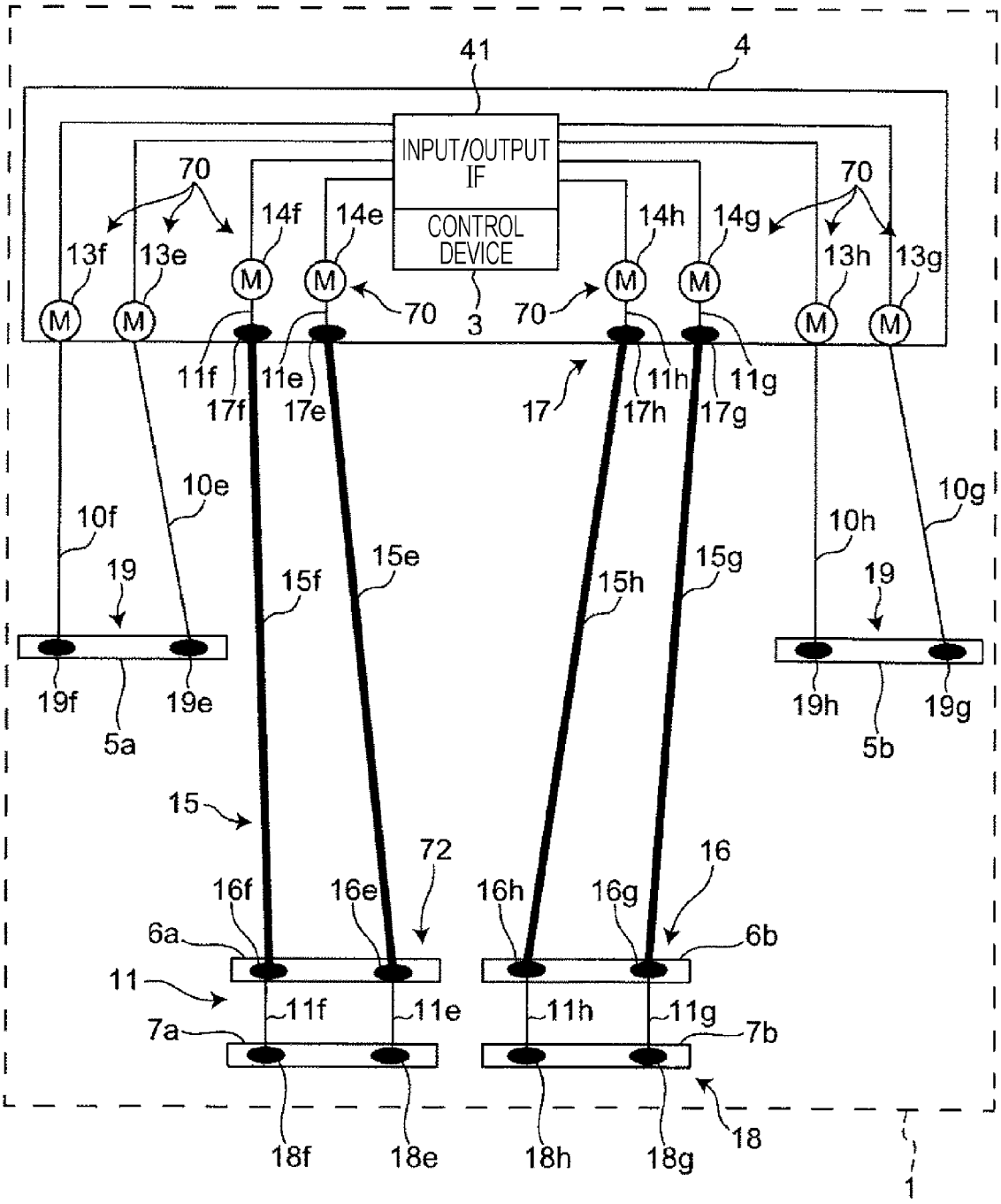
FIG. 2 is an explanatory diagram illustrating the configuration of the apparatus for fall prevention during walking in the first embodiment of the present disclosure.

FIG. 1A to FIG. 10 are diagrams illustrating three examples when a user wearing an assist mechanism 2 in an assist system 1, which is an example of an apparatus for fall prevention during walking according to a first embodiment of the present disclosure, uses the assist system 1. FIG. 2 is an explanatory diagram illustrating an overview of the assist system 1 illustrated in FIG. 10 as an example of an apparatus for fall prevention during walking according to the first embodiment of the present disclosure. FIG. 3A is an explanatory diagram describing how an outer wire 15 and an ankle wire 11 in the assist system 1 are attached. FIG. 3B and FIG. 3C are respectively a front view and a side view of an example of a tension application mechanism 70 in the assist system 1, illustrating the configuration of a motor 14 and so on.

The assist system 1 is an apparatus for preventing a user 100 from falling when the user 100 is walking. The assist system 1 includes an assist mechanism 2 that is worn by the user 100, and a control device 3 that controls the operation of the assist mechanism 2.

The assist mechanism 2 includes an assist garment 72 to be worn on at least a portion of the lower part of the body of the user 100, wires, and tension application mechanisms 70. The assist garment 72 has wires. The tension application mechanisms 70 respectively apply tensions to the wires, thereby imparting stiffnesses for fall prevention to the parts of the user 100 covered by the assist garment 72.

For example, reference numeral 11 is used to collectively refer to ankle wires described below, and individual ankle wires are referred to with individual reference numerals 11*e*, 11*f*, 11*g*, and 11*h*. Likewise, reference numeral 15 is used to collectively refer to ankle outer wires described below, and individual ankle outer wires are referred to with individual reference numerals 15*e*, 15*f*, 15*g*, and 15*h*. This also applies to thigh wires 10, motors 13 and 14, lower-end ankle outer wire attachment units 16, upper-end ankle outer wire attachment units 17, lower-end ankle wire attachment units 18, and lower-end thigh wire attachment units 19, described below.

The assist garment 72 is removably worn by the user 100 and will be described here with reference to three examples.

Figure 10:
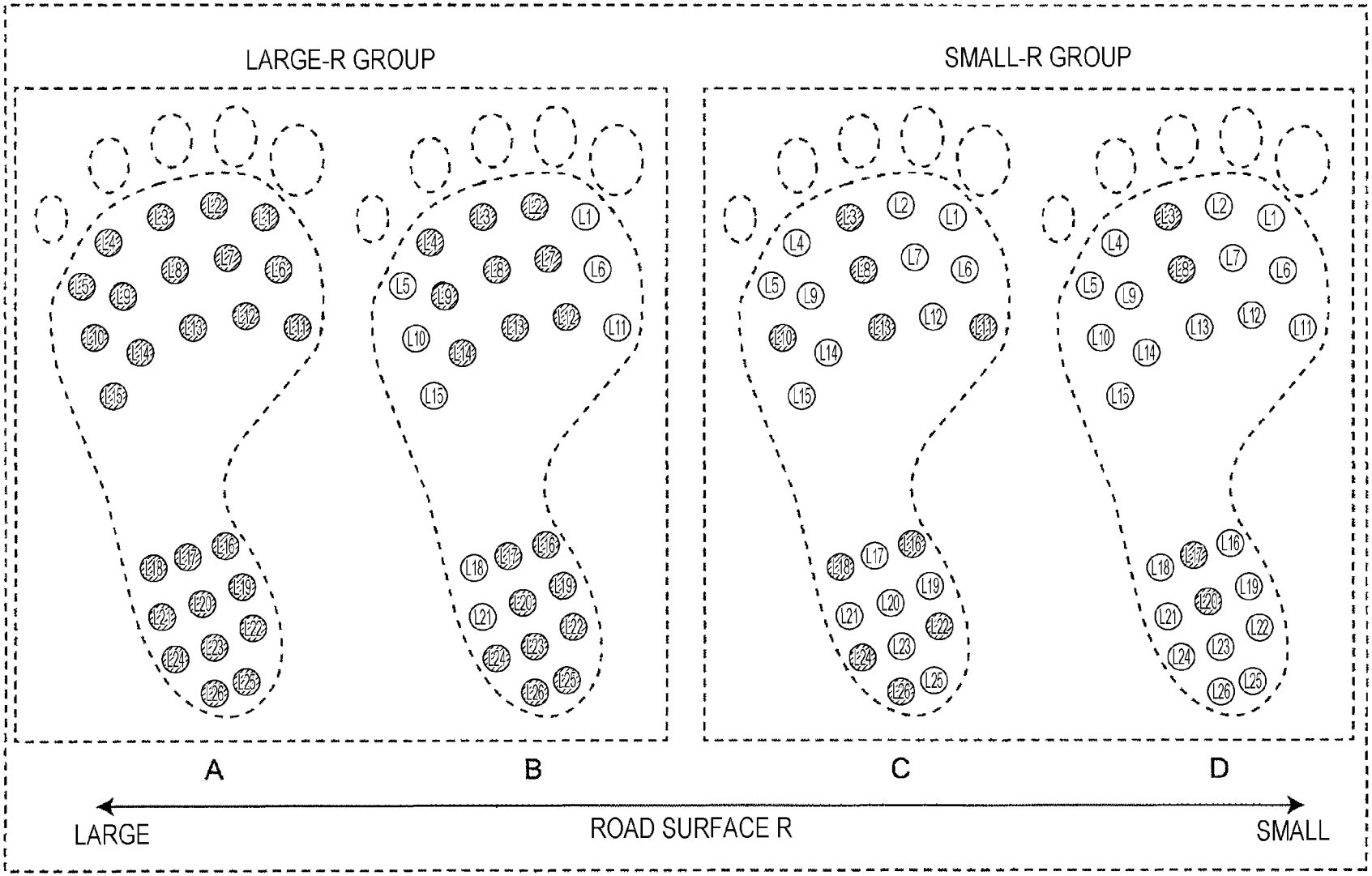
FIG. 10 is a diagram of signal models of the foot sensors corresponding to road surface curvatures.

As a first example, as illustrated in FIG. 1A, the assist garment 72 can include assist ankle bands 2*b* and 2*c*. As a second example, as illustrated in FIG. 1B, the assist garment 72 can include assist pants 2*a*. As a third example, as illustrated in FIG. 10, the assist garment 72 can include both the assist ankle bands 2*b* and 2*c* in the first example and the assist pants 2*a* in the second example. In the following description, the first example and then the second example will be described.

As illustrated in FIG. 1A and FIG. 10, the assist ankle bands 2*b* and 2*c* in the first example include left and right upper ankle belts 6*b* and 6*a* to be removably fixed on upper parts of the respective ankles of the left and right legs of the user 100, and left and right lower ankle belts, for example, heel belts 7*b* and 7*a*, which are to be removably fixed on lower parts of the left and right ankles, for example, on heels.

The left and right upper ankle belts 6*b* and 6*a* are each formed of a fabric belt, for example. The left and right heel belts 7*b* and 7*a* are each formed of a fabric belt, for example. The left and right upper ankle belts 6*b* and 6*a* and the left and right heel belts 7*b* and 7*a* are removably worn on the left and right ankles of the user 100.

The tension application mechanisms 70 are included in, for example, a waist belt 4 to be removably worn on the waist of the user 100.

The assist garment 72 in the first example has ankle wires 11 as wires. The ankle wires 11 include first to fourth ankle wires 11*e*, 11*f*, 11*g*, and 11*h* having flexibility but not allowed to expand or contract longitudinally, each of which is made of, for example, metal.

The first to fourth ankle wires 11*e*, 11*f*, 11*g*, and 11*h* each have an upper end fixed to a corresponding one of the tension application mechanisms 70, and are given tensions applied by the tension application mechanisms 70, thereby allowing the first to fourth ankle wires 11*e*, 11*f*, 11*g*, and 11*h* to act as pseudo-springs to change the stiffness for the thighs. The first to fourth ankle wires 11*e*, 11*f*, 11*g*, and 11*h* have lower ends extending through the upper ankle belts 6*b* and 6*a* and then fixed to the left and right heel belts 7*b* and 7*a*. Specifically, the lower ends of the first to fourth ankle wires 11*e*, 11*f*, 11*g*, and 11*h* are respectively fixed to lower-end ankle wire attachment units 18*e* and 18*f*, 18*g*, and 18*h* of the left and right heel belts 7*b* and 7*a*. A tension application mechanism may be referred to as a tension controller.

Specifically, the first ankle wire 11*e* is located in a portion corresponding to a right side surface of the right ankle of the user 100 in the longitudinal direction of the right leg of the user 100. The first ankle wire 11*e* extends through a lower-end ankle outer wire attachment unit 16*e* of the right upper ankle belt 6*a*, and the lower end thereof is coupled to the lower-end ankle wire attachment unit 18*e* of the right heel belt 7*a*.

The second ankle wire 11*f* is located in a portion corresponding to a left side surface of the right ankle of the user 100 in the longitudinal direction of the right leg of the user 100. The second ankle wire 11*f* extends through a lower-end ankle outer wire attachment unit 16*f* of the right upper ankle belt 6*a*, and the lower end thereof is coupled to the lower-end ankle wire attachment unit 18*f* of the right heel belt 7*a*.

The third ankle wire 11*g* is located in a portion corresponding to a right side surface of the left ankle of the user 100 in the longitudinal direction of the left leg of the user 100. The third ankle wire 11*g* extends through a lower-end ankle outer wire attachment unit 16*g* of the left upper ankle belt 6*b*, and the lower end thereof is coupled to the lower-end ankle wire attachment unit 18*g* of the left heel belt 7*b*.

The fourth ankle wire 11*h* is located in a portion corresponding to a left side surface of the left ankle of the user 100 in the longitudinal direction of the left leg of the user 100. The fourth ankle wire 11*h* extends through a lower-end ankle outer wire attachment unit 16*h* of the left upper ankle belt 6*b*, and the lower end thereof is coupled to the lower-end ankle wire attachment unit 18*h* of the left heel belt 7*b*.

Note that the ankle wires 11 merely extend through the lower-end ankle outer wire attachment units 16 of the upper ankle belts 6*a* and 6*b*, but are not fixed. As described in detail below with reference to FIG. 2, lower ends of the ankle outer wires 15 are fixed to the lower-end ankle outer wire attachment units 16, and tensile forces from the ankle wires 11 act between the lower-end ankle outer wire attachment units 16 and the lower-end ankle wire attachment units 18. Thus, the ankle wires 11 are substantially coupled to the lower-end ankle outer wire attachment units 16.

Each of the tension application mechanisms 70 is driven under control of the control device 3 to tighten or loosen the corresponding one of the first to fourth ankle wires 11*e*, 11*f*, 11*g*, and 11*h*. Accordingly, the tensile forces to be applied to the first to fourth ankle wires 11*e*, 11*f*, 11*g*, and 11*h* are individually adjusted in an independent way, thereby imparting stiffnesses for fall prevention to the ankles of the user 100 from the assist garment 72.

Each of the tension application mechanisms 70 can include, for example, an actuator such as a motor. As an example, an example of a motor will be described.

Figure 3A:
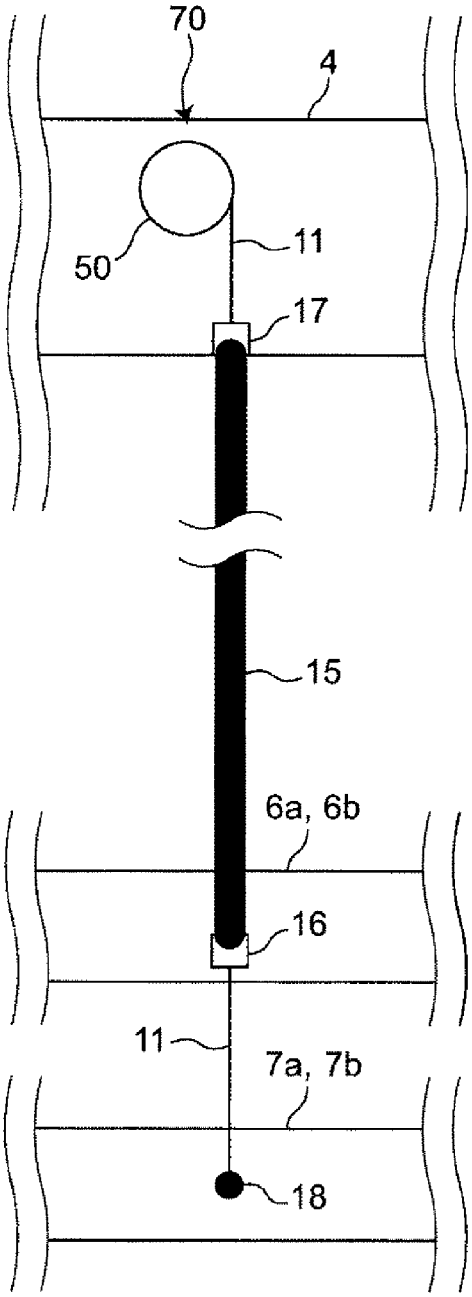
FIG. 3A is an explanatory diagram describing how a pulley, an outer wire, and an ankle wire in the apparatus for fall prevention during walking are attached.
Figure 3B:
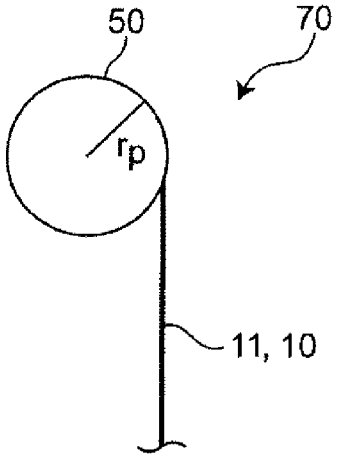
FIG. 3B is front view of an example of a tension application mechanism of the apparatus for fall prevention during walking, illustrating the configuration of a pulley and a wire.
Figure 3C:
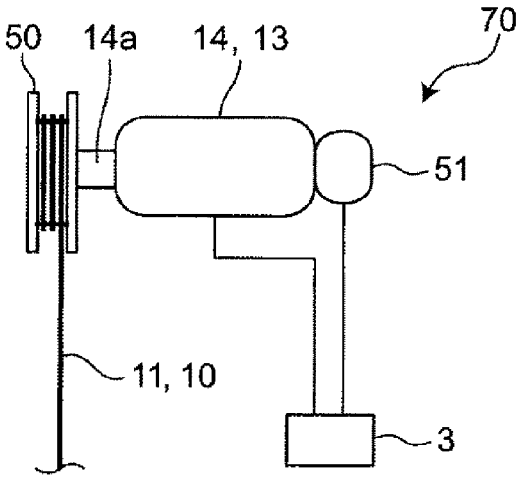

As illustrated in FIG. 3B and FIG. 3C, each of the tension application mechanisms 70 includes, for example, a motor 14, which is driven to rotate by the control device 3. FIG. 3B and FIG. 3C are diagrams illustrating a portion to which the motor 14 and the ankle wire 11 are attached. An encoder 51 is attached to the motor 14. The encoder 51 can detect the rotation angle of a rotating shaft 14*a* of the motor 14 and send the rotation angle to the control device 3. Further, a pulley 50 is fixed to the rotating shaft 14*a* of the motor 14 that rotates forward and in reverse. The upper end of the ankle wire 11, which is exposed above the upper end of the ankle outer wire 15 is fixed to the pulley 50, and then the ankle wire 11 is wound around the pulley 50. If the pulley 50 is assumed to have a radius $r_p$, the pulley 50 rotates one full turn in accordance with the forward or reverse rotation of the motor 14, thereby causing the ankle wire 11 to be pulled out by $2\pi r_p$ or to be wound up. Thus, a leading end of the ankle wire 11 moves by $2\pi r_p$. While no gear is illustrated in this example, the pulley 50 may be attached to the rotating shaft 14*a* of the motor 14 via a gear. The driving of the motor 14 is controlled by the control device 3 on the basis of the angle of the motor 14, which is detected by the encoder 51. Accordingly, the length of the ankle wire 11 is adjusted under control of the control device 3 in accordance with the forward or reverse rotation of the rotating shaft 14*a* of the motor 14 to impart or cancel imparting a tensile force to the ankle wire 11.

However, if tensile forces are caused to act on the first to fourth ankle wires 11*e*, 11*f*, 11*g*, and 11*h* by the tension application mechanisms 70 by using the configuration described above, the tensile forces pull the heel belts 7*b* and 7*a* toward the waist. This ensures that the tensile forces are less likely to act between the upper ankle belts 6*b* and 6*a* and the left and right heel belts 7*b* and 7*a*.

In the first example illustrated in FIG. 1A, accordingly, long hollow tubular ankle outer wires 15 having flexibility, which are made of, for example, metal or synthetic resin, are arranged and fixed between the waist belt 4 and the upper ankle belts 6*a* and 6*b*, and each of the ankle wires 11 is located in a corresponding one of the ankle outer wires 15 in such a manner as to extend therethrough and to be relatively movable. This configuration can prevent tensile forces from acting on the ankle wires 11 from the waist belt 4 to the upper ankle belts 6*b* and 6*a*. Specifically, long tubular ankle outer wires 15*e*, 15*f*, 15*g*, and 15*h* have upper ends fixed to upper-end ankle outer wire attachment units 17*e*, 17*f*, 17*g*, and 17*h* of the waist belt 4, respectively. The ankle outer wires 15*e*, 15*f*, 15*g*, and 15*h* have lower ends fixed to the lower-end ankle outer wire attachment units 16*e* and 16*f*, 16*g*, and 16*h* of the upper ankle belts 6*a* and 6*b*, respectively.

Accordingly, the ankle outer wires 15 allow the distances between the waist belt 4 and the upper ankle belts 6*a* and 6*b* to be fixed, and prevent the tensile forces from acting between the waist belt 4 and the upper ankle belts 6*a* and 6*b* even when the tensile forces act on the ankle wires 11 extending through the respective ankle outer wires 15. Thus, the tensile forces between the waist belt 4 and the upper ankle belts 6*a* and 6*b* can be considered to be negligible. In other words, tensions generated when the ankle wires 11 are tightened by the motors 14 are applied to points between the lower-end outer wire attachment units 16 and the lower-end ankle wire attachment units 18.

Thus, when a tensile force is applied to the ankle wire 11*e* on the outer side of the right leg, the tensile force to be transmitted from the ankle wire 11*e* on the outer side of the right leg to the right side surface (outer side) of the right ankle of the user 100 can be reliably increased between the upper ankle belt 6*a* and the heel belt 7*a*. When the application of the tensile force to the ankle wire 11*e* on the outer side of the right leg is canceled, conversely, the tensile force to be transmitted from the ankle wire 11*e* on the outer side of the right leg to the right side surface (outer side) of the right ankle of the user 100 can be decreased between the upper ankle belt 6*a* and the heel belt 7*a*.

Further, when a tensile force is applied to the ankle wire 11*f* on the inner side of the right leg, the tensile force to be transmitted from the ankle wire 11*f* on the inner side of the right leg to the left side surface (inner side) of the right ankle of the user 100 can be reliably increased between the upper ankle belt 6*a* and the heel belt 7*a*. When the application of the tensile force to the ankle wire 11*f* on the inner side of the right leg is canceled, conversely, the tensile force to be transmitted from the ankle wire 11*f* on the inner side of the right leg to the left side surface (inner side) of the right ankle of the user 100 can be decreased between the upper ankle belt 6*a* and the heel belt 7*a*.

When a tensile force is applied to the ankle wire 11*h* on the outer side of the left leg, the tensile force to be transmitted from the ankle wire 11*h* on the outer side of the left leg to the left side surface (outer side) of the left ankle of the user 100 can be reliably increased between the upper ankle belt 6*b* and the heel belt 7*b*. When the application of the tensile force to the ankle wire 11*h* on the outer side of the left leg is canceled, conversely, the tensile force to be transmitted from the ankle wire 11*h* on the outer side of the left leg to the left side surface (outer side) of the left ankle of the user 100 can be decreased between the upper ankle belt 6*b* and the heel belt 7*b*.

Further, when a tensile force is applied to the ankle wire 11*g* on the inner side of the left leg, the tensile force to be transmitted from the ankle wire 11*g* on the inner side of the left leg to the right side surface (inner side) of the left ankle of the user 100 can be reliably increased between the upper ankle belt 6*b* and the heel belt 7*b*. When the application of the tensile force to the ankle wire 11*g* on the inner side of the left leg is canceled, conversely, the tensile force to be transmitted from the ankle wire 11*g* on the inner side of the left leg to the right side surface (inner side) of the left ankle of the user 100 can be decreased between the upper ankle belt 6*b* and the heel belt 7*b*.

The lower-end ankle outer wire attachment units 16*e* of the upper ankle belt 6*a* is positioned in a portion corresponding to the right side surface of the right ankle. The lower-end ankle outer wire attachment units 16*f* of the upper ankle belt 6*a* is positioned in a portion corresponding to the left side surface of the right ankle. The lower-end ankle outer wire attachment units 16*g* of the upper ankle belt 6*b* is positioned in a portion corresponding to the right side surface of the left ankle. The lower-end ankle outer wire attachment units 16*h* of the upper ankle belt 6*b* is positioned in a portion corresponding to the left side surface of the left ankle. Further, the lower-end ankle wire attachment unit 18*e* of the heel belt 7*a* is positioned in a portion corresponding to the right side surface of the right ankle. The lower-end ankle wire attachment unit 18*f* of the heel belt 7*a* is positioned in a portion corresponding to the left side surface of the right ankle. The lower-end ankle wire attachment unit 18*g* of the heel belt 7*b* is positioned in a portion corresponding to the right side surface of the left ankle. The lower-end ankle wire attachment unit 18*h* of the heel belt 7*b* is positioned in a portion corresponding to the left side surface of the left ankle.

As a result of the configuration described above, the ankle wires 11*e* and 11*f* on the outer side and inner side of the right leg are in antagonistic relation to each other, and the ankle wires 11*g* and 11*h* on the inner side and outer side of the left leg are in antagonistic relation to each other. The motors 14*e* and 14*f* are rotated forward or in reverse independently under control of the control device 3, thereby independently adjusting the length of the ankle wire 11*e* on the outer side and the length of the ankle wire 11*f* on the inner side, respectively. Thus, the pair of ankle wires 11*e* and 11*f* on the outer side and inner side of the right leg, which are in antagonistic relation to each other, are driven to be pulled apart from each other, thereby imparting stiffness to the ankle of the right leg. Further, the motors 14*g* and 14*h* are rotated forward or in reverse independently under control of the control device 3, thereby independently adjusting the length of the ankle wire 11*g* on the inner side and the length of the ankle wire 11*h* on the outer side, respectively. Thus, the pair of ankle wires 11*g* and 11*h* on the inner side and outer side of the left leg, which are in antagonistic relation to each other, are driven to be pulled apart from each other, thereby imparting stiffness to the ankle of the left leg.

Accordingly, each of the motors 14 is rotated under control of the control device 3 on the basis of the rotation angle of the motor 14, which is detected by the encoder 51, to wind up the corresponding one of the ankle wires 11 on the pulley 50 via the rotating shaft 14*a*. Thus, the respective upper ends of the ankle wires 11 are pulled upward and tensile forces are applied to the ankle wires 11. Then, the heel belts 7*a* and 7*b* are pulled upward through the ankle wires 11 so as to approach the upper ankle belts 6*a* and 6*b*. As a result, stiffnesses are transmitted to the left side surfaces of the ankles and the right side surfaces of the ankles at the same time in such a manner that the left and right side surfaces of the ankles are pulled and remain pulled by elastic elements (springs) at the same time. Therefore, the effect of fall prevention can be achieved.

Conversely, when each of the motors 14 is rotated reversely under control of the control device 3 to unwind the corresponding one of the ankle wires 11, the ankle wires 11 move downward and the application of the tensile forces to the ankle wires 11 is canceled. Then, the forces exerted to pull the heel belts 7*a* and 7*b* upward so that the heel belts 7*a* and 7*b* can approach the upper ankle belts 6*a* and 6*b* through the ankle wires 11 disappear. As a result, no stiff body supports the left and right side surfaces of the ankles, making the ankles free to move.

Next, as illustrated in FIG. 1B and FIG. 10, the second example will be described in which the assist garment 72 includes the assist pants 2*a*.

In the second example, the assist mechanism 2 includes the assist garment 72, which is the assist pants 2*a*, thigh wires 10, and tension application mechanisms 70.

The assist pants 2*a* include an assist pants body 2*d* to be removably worn on the lower part of the body of the user 100, a waist belt 4, and left and right above-knee belts 5*b* and 5*a*.

The waist belt 4 is formed of, for example, a fabric belt fixed to an upper edge of the assist pants body 2*d*. The waist belt 4 is removably attached to the waist of the user 100 to restrain the waist. The left and right above-knee belts 5*b* and 5*a* are formed of, for example, fabric belts fixed to left and right lower edges (cuffs) of the assist pants body 2*d*. The left and right above-knee belts 5*b* and 5*a* are removably attached to the left and right knee portions of the user 100 to restrain the left and right knee portions.

As illustrated in FIG. 1B and FIG. 10, the thigh wires 10 are located between the waist belt 4 of the assist pants body 2*d* and the left and right above-knee belts 5*b* and 5*a* in the longitudinal direction of the left leg or right leg of the user 100. The thigh wires 10 include first to fourth thigh wires 10*e*, 10*f*, 10*g*, and 10*h* having flexibility but not allowed to expand or contract longitudinally, each of which is made of, for example, metal. The first to fourth thigh wires 10*e*, 10*f*, 10*g*, and 10*h* each have an upper end fixed to a corresponding one of the tension application mechanisms 70, and are given tensions applied by the tension application mechanisms 70, thereby allowing the first to fourth thigh wires 10*e*, 10*f*, 10*g*, and 10*h* to act as pseudo-springs to change the stiffness for the thighs.

Specifically, the thigh wire 10*e* is located in a portion of the assist pants body 2*d* corresponding to a right thigh outer side (right thigh right side surface) of the user 100. The thigh wire 10*e* has a lower end coupled to the waist belt 4 and a lower-end thigh wire attachment unit 19*e* of the above-knee belt 5*a* of the right leg. The thigh wire 10*f* is located in a portion of the assist pants body 2*d* corresponding to a right thigh inner side (right thigh left side surface) of the user 100. The thigh wire 10*e* has a lower end coupled to the waist belt 4 and a lower-end thigh wire attachment unit 19*f* of the above-knee belt 5*a* of the right leg. The thigh wire 10*g* is located in a portion of the assist pants body 2*d* corresponding to a left thigh inner side (left thigh right side surface) of the user 100. The thigh wire 10*g* has a lower end coupled to the waist belt 4 and a lower-end thigh wire attachment unit 19*g* of the above-knee belt 5*b* of the left leg. The thigh wire 10*h* is located in a portion of the assist pants body 2*d* corresponding to a left thigh outer side (left thigh left side surface) of the user 100. The thigh wire 10*h* has a lower end coupled to the waist belt 4 and a lower-end thigh wire attachment unit 19*h* of the above-knee belt 5*b* of the left leg.

As a result of the configuration described above, the thigh wires 10*e* and 10*f* on the outer side and inner side of the right leg are in antagonistic relation to each other, and the thigh wires 10*g* and 10*h* on the inner side and outer side of the left leg are in antagonistic relation to each other. The motors 13*e* and 13*f* are rotated forward or in reverse independently under control of the control device 3, thereby independently adjusting the length of the thigh wire 10*e* on the outer side and the length of the thigh wire 10*f* on the inner side, respectively. Thus, the pair of thigh wires 10*e* and 10*f* on the outer side and inner side of the right leg, which are in antagonistic relation to each other, are driven to be pulled apart from each other, thereby imparting stiffness to the thigh of the right leg. Further, the motors 13*g* and 13*h* are rotated forward or in reverse independently under control of the control device 3, thereby independently adjusting the length of the thigh wire 10*g* on the inner side and the length of the thigh wire 10*h* on the outer side, respectively. Thus, the pair of thigh wires 10*g* and 10*h* on the inner side and outer side of the left leg, which are in antagonistic relation to each other, are driven to be pulled apart from each other, thereby imparting stiffness to the thigh of the left leg.

Each of the tension application mechanisms 70 is driven under control of the control device 3 to tighten or loosen the corresponding one of the first to fourth thigh wires 10*e*, 10*f*, 10*g*, and 10*h*. Accordingly, the tensile forces to be applied to the first to fourth thigh wires 10*e*, 10*f*, 10*g*, and 10*h* are individually adjusted in an independent way, thereby imparting stiffnesses for fall prevention to the thighs of the user 100 from the assist garment 72.

The tension application mechanisms 70 are included in, for example, the waist belt 4. Similarly to the motor 14 illustrated in FIG. 3B and FIG. 3C, each of the tension application mechanisms 70 includes, for example, a motor 13 for driving thigh wires, which are driven to rotate by the control device 3. A portion to which each of the motors 13 and the corresponding one of the wires 10 are attached is the same as the portion illustrated in FIG. 3B and FIG. 3C to which one of the motors 14 and the corresponding one of the wires 11 are attached, with the corresponding reference numerals being displayed in parentheses in FIG. 3B and FIG. 3C, which will not be described herein.

The upper end of each of the thigh wires 10*e*, 10*f*, 10*g*, and 10*h* is coupled to a pulley 50 fixed to the rotating shaft of the corresponding one of the motors 13*e*, 13*f*, 13*g*, and 13*h*. Accordingly, the length of each of the thigh wires 10*e*, 10*f*, 10*g*, and 10*h* between the waist belt 4 and the left and right above-knee belts 5*b* and 5*a* is adjusted under control of the control device 3 in accordance with the forward or reverse rotation of the rotating shaft of the corresponding one of the motors 13*e*, 13*f*, 13*g*, and 13*h* on the basis of the rotation angle of the motor 13, which is detected by the encoder 51, to impart or cancel imparting a tensile force to the corresponding one of thigh wires 10.

Accordingly, each of the motors 13 is rotated under control of the control device 3 to wind up the corresponding one of the thigh wires 10 on the pulley 50 via the rotating shaft. Thus, the respective upper ends of the thigh wires 10 are pulled upward and tensile forces are applied to the thigh wires 10. Then, the above-knee belts 5*b* and 5*a* are pulled upward through the thigh wires 10 so as to approach the waist belt 4. As a result, stiffnesses are transmitted to the left side surfaces of the thighs and the right side surfaces of the thighs at the same time in such a manner that the left and right side surfaces of the thighs are pulled and remain pulled by elastic elements (springs) at the same time. Therefore, the effect of fall prevention can be achieved.

Conversely, when each of the motors 13 is rotated reversely under control of the control device 3 to unwind the corresponding one of the thigh wires 10, the thigh wires 10 move downward and the application of the tensile forces to the thigh wires 10 is canceled. Then, the forces exerted to pull the above-knee belts 5*b* and 5*a* upward so that the above-knee belts 5*b* and 5*a* can approach the waist belt 4 through the thigh wires 10 disappear. As a result, no stiff body supports the left and right side surfaces of the thighs, making the thighs free to move.

Figure 4A:
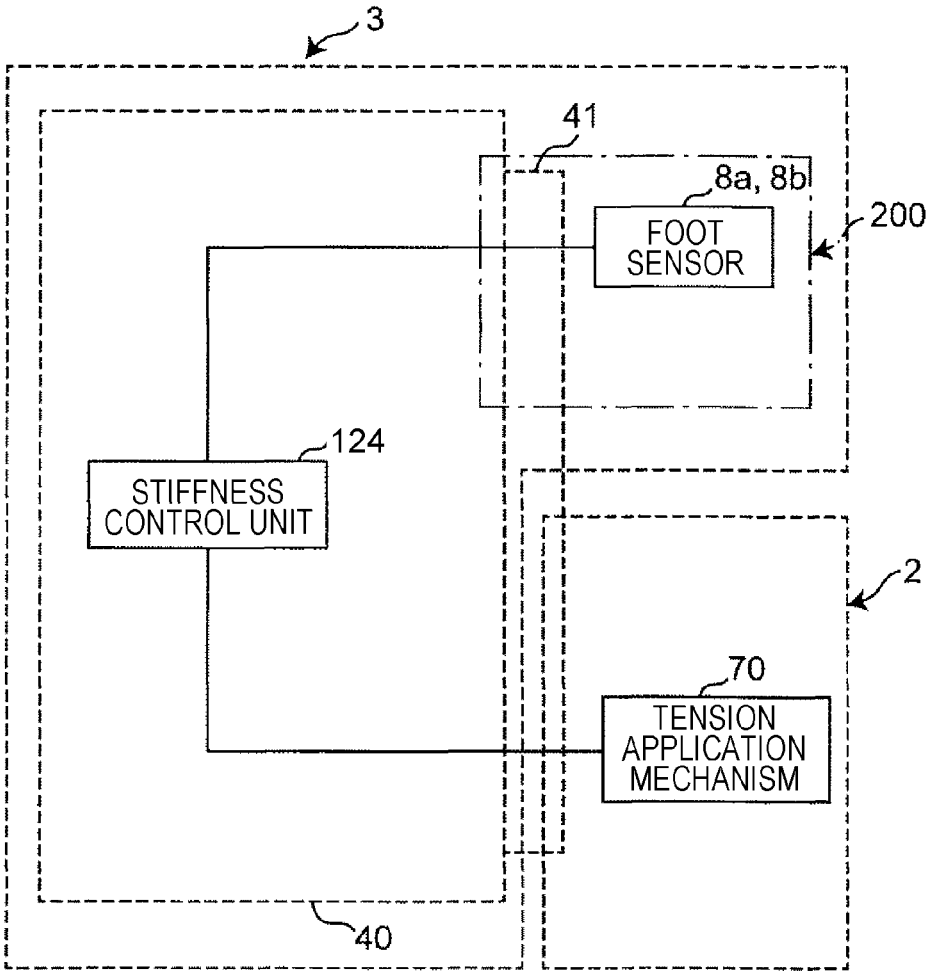
FIG. 4A is a block diagram illustrating a control device and a control target in the apparatus for fall prevention during walking according to the first embodiment of the present disclosure.

FIG. 4A is a block diagram illustrating the control device 3, a control target, namely, the tension application mechanism 70 in the assist mechanism 2, and an input interface unit 200 on the input side of the control device 3 in the first embodiment of the present disclosure. The schematic configuration of the control device 3 will be first described with reference to FIG. 4A. The input interface unit may be referred to as an obtainer.

The control device 3 controls the operation of the assist mechanism 2. The control device 3 includes the input interface unit 200 and a stiffness control unit 124.

The input interface unit 200 obtains information about a road surface 90 where the user 100 walks.

The stiffness control unit 124 controls a pair of tension application mechanisms 70 that are to control stiffnesses to be transmitted to parts of a user on the basis of information about the road surface 90, which is obtained by the input interface unit 200, to control the tensions of wires included in a pair of wires corresponding to the pair of tension application mechanisms 70 at the same time. Thus, stiffnesses to be transmitted to the right side surface and left side surface of the left ankle, which are parts of the user corresponding to a first pair of wires, are changed at the same time, stiffnesses to be transmitted to the right side surface and left side surface of the right ankle, which are parts of the user corresponding to a second pair of wires, are changed at the same time, stiffnesses to be transmitted to the right side surface and left side surface of the left thigh, which are parts of the user corresponding to a third pair of wires, are changed at the same time, and stiffnesses to be transmitted to the right side surface and left side surface of the right thigh, which are parts of the user corresponding to a fourth pair of wires, are changed at the same time.

A pair including the ankle wire 11*e* on the outer side (right side surface) of the right leg and the ankle wire 11*f* on the inner side (left side surface) of the right leg corresponds to the right ankle of the user. A pair including the ankle wire 11*g* on the inner side (right side surface) of the left leg and the ankle wire 11*h* on the outer side (left side surface) of the left leg corresponds to the left ankle of the user. A pair including the thigh wire 10*e* on the outer side (right side surface) of the right leg and the thigh wire 10*f* on the inner side (left side surface) of the right leg corresponds to the right thigh of the user. A pair including the thigh wire 10*g* on the inner side (right side surface) of the left leg and the thigh wire 10*h* on the outer side (left side surface) of the left leg corresponds to the left thigh of the user.

This control will be described in more detail.

Figure 4B:
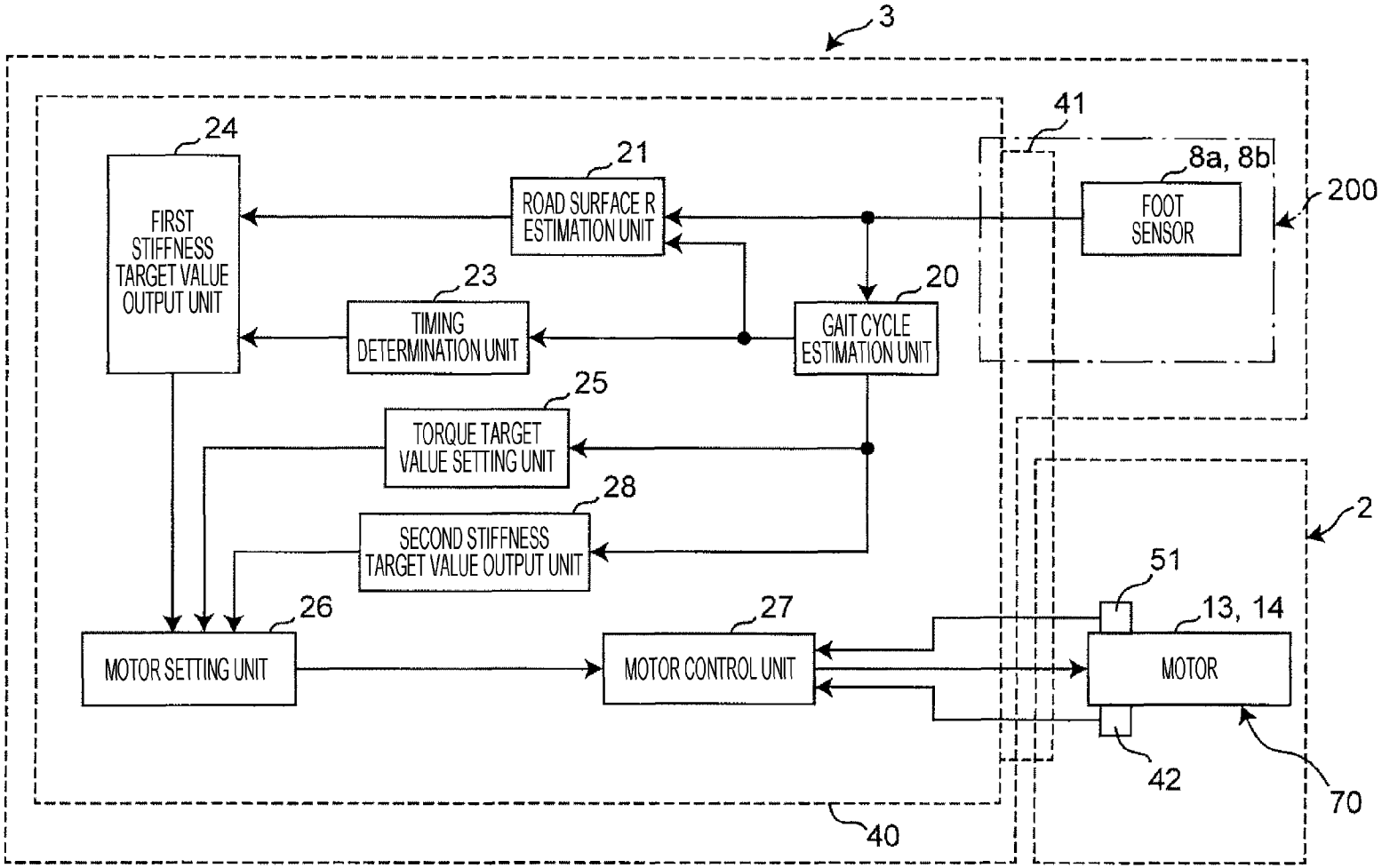
FIG. 4B is a block diagram more specifically illustrating the control device and the control target in the apparatus for fall prevention during walking according to the first embodiment of the present disclosure.

FIG. 4B is a block diagram illustrating a specific configuration when the tension application mechanism 70 is the motor 13 or 14. The following describes a configuration common to the first to third examples, whether information to be handled is information concerning the ankles, information concerning the thighs, or information concerning both the ankles and the thighs. Since a basic operation of imparting or canceling imparting stiffnesses to the corresponding parts of the user is the same, the description will be given based on mainly information concerning the ankles or the thighs.

In the first embodiment, the control device 3 is constituted by a typical microcomputer, by way of example. The control device 3 includes a control program 40, which is a controller including a first stiffness target value output unit 24 functioning as an example of a stiffness control unit, and the input interface unit 200 that obtains information about the road surface 90 where the user 100 walks. Thus, the control device 3 activates the motor 13 or 14 to change the tension of the wire 11 or 10 connected to the motor 13 or 14. A tension is generated so that the tension of the wire 10 or 11 is equal to a tension proportional to the amount of change in length, as with a spring, thereby generating stiffness on the thigh or ankle defined between two points connected by the thigh wire 10 or the ankle wire 11, as described above.

The first stiffness target value output unit 24 controls the driving of a pair of motors 13 or a pair of motors 14 to adjust the lengths of a pair of thigh wires 10 or a pair of ankle wires 11, which are in antagonistic relation to each other, at the same time, thereby changing the stiffnesses to be transmitted to the left side surface and right side surface of the left thigh, the right thigh, the left ankle, or the right ankle at the same time.

Specifically, the first stiffness target value output unit 24 controls the pair of motors 14*e* and 14*f* on the basis of the information about the road surface 90, which is obtained by the input interface unit 200, to independently control the respective tensions of the pair of ankle wires 11*e* and 11*f*, thereby changing the stiffnesses to be transmitted to the left side surface and right side surface of the right ankle at the same time. Further, at the same time, the first stiffness target value output unit 24 further performs control to control the pair of motors 14*g* and 14*h* to independently control the respective tensions of the pair of ankle wires 11*g* and 11*h*, thereby changing the stiffnesses to be transmitted to the left side surface and right side surface of the left ankle at the same time.

Further, specifically, the first stiffness target value output unit 24 controls the pair of motors 13*e* and 13*f* on the basis of the information about the road surface 90, which is obtained by the input interface unit 200, to independently control the respective tensions of the pair of thigh wires 10*e* and 10*f*, thereby changing the stiffnesses to be transmitted to the left side surface and right side surface of the right thigh at the same time. Further, at the same time, the first stiffness target value output unit 24 performs control to control the pair of motors 13*g* and 13*h* to independently control the respective tensions of the pair of thigh wires 10*g* and 10*h*, thereby changing the stiffnesses to be transmitted to the left side surface and right side surface of the left thigh at the same time.

The input interface unit 200 functions as an example of an information obtaining unit at least including foot sensors 8*a* and 8*b* functioning as an example of a road surface information obtaining unit and as an example of a walk information obtaining device that obtains walk information about a walking action of the user 100. As a specific example, the input interface unit 200 includes an input/output IF 41 and the foot sensors 8*a* and 8*b* that obtain walk information concerning, for example, walking conditions under which the user 100 is walking.

The input/output IF (interface) 41 includes, for example, a D/A board, an A/D board, and a counter board, which are connected to expansion slots of a PCI bus or the like of a microcomputer.

The control device 3 sends a control signal to the motor 13 or 14 via the input/output IF 41 as an example of an output unit. Further, as an input unit, the control device 3 accepts the input from the foot sensors 8*a* and 8*b* via the input/output IF 41. As a specific example, the control device 3 at least includes a gait cycle estimation unit 20, a road surface R estimation unit 21 functioning as a road surface information estimation unit, a timing determination unit 23, the first stiffness target value output unit 24, a motor setting unit 26, and a motor control unit 27. In FIG. 4B, a torque target value setting unit 25 and a second stiffness target value output unit 28 are illustrated to be also included, which are not necessary in the first embodiment but necessary in a modification, which will be described below. The road surface R estimation unit may be referred to as a road surface R estimator.

The foot sensors 8*a* and 8*b* are included in the assist pants 2*a*. Specifically, the foot sensors 8*a* and 8*b* are included in the heel belts 7*a* and 7*b*, the soles of socks including the heel belts 7*a* and 7*b*, or the like. The foot sensors 8*a* and 8*b* detect the contact states of both feet of the user 100 and outputs road surface information to the gait cycle estimation unit 20 and the road surface R estimation unit 21 via the input/output IF 41. Among the contact states of both feet, the contact states of both feet when the soles or the entire soles are in contact with the ground also indicate the state of a contact surface that the feet are in contact with, for example, the state of the road surface 90, and information about the road surface 90 is also detected.

Figure 5:
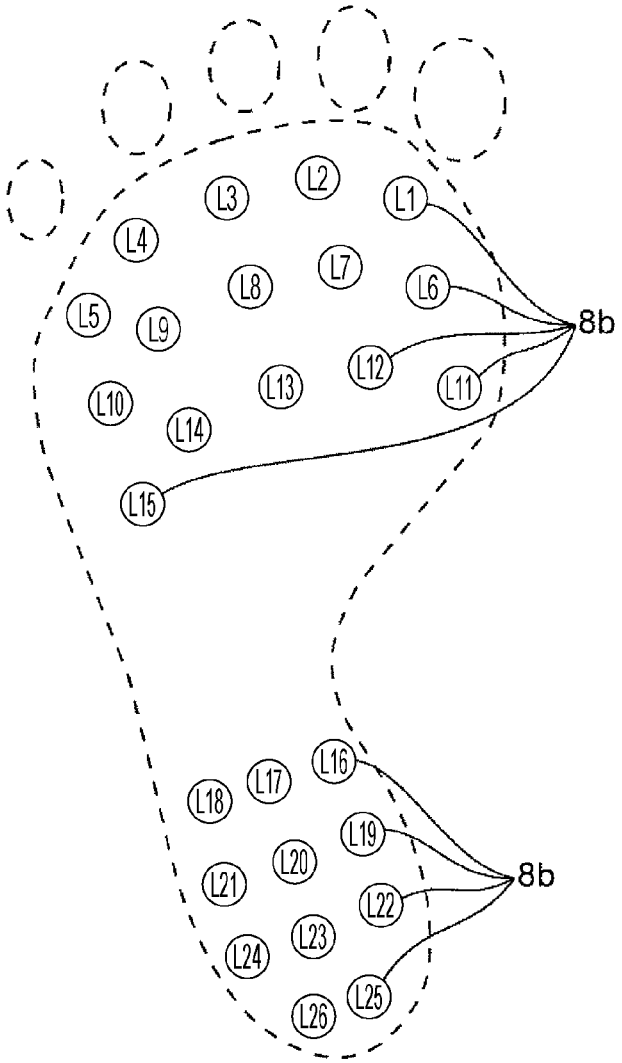
FIG. 5 is a diagram illustrating an example of the arrangement of foot sensors in the first embodiment of the present disclosure.

FIG. 5 is a diagram illustrating an example of the arrangement of multiple foot sensors 8*b* included in the sole of the left foot sock or the like. The sole of the right foot sock or the like also includes multiple foot sensors 8*a* in a manner similar to that for the left foot in FIG. 5.

The foot sensors 8*a* and 8*b* include 26 foot sensors L1 to L26 for the left foot and 26 foot sensors R1 to R26 (not illustrated) for the right foot, which are arranged symmetrically with the foot sensors L1 to L26 for the left foot. When the portions having the foot sensors 8*a* and 8*b* are in contact with the road surface 90, the foot sensors 8*a* and 8*b* output ON signals, whereas when the portions having the foot sensors 8*a* and 8*b* are not in contact with the road surface 90, the foot sensors 8*a* and 8*b* output OFF signals. Identification information (for example, position information such as a heel and a toe) on the 52 foot sensors 8*a* and 8*b* and ON/OFF information about the 52 foot sensors 8*a* and 8*b* are all collectively referred to as contact state information. Since the contact state information includes identification information on the foot sensors 8*a* and 8*b* and ON/OFF information about the foot sensors 8*a* and 8*b*, for example, information about whether the heels of the feet are in contact with the road surface 90, information about a convex and concave state of the road surface 90, and so on can be extracted as road surface information or road surface convex-and-concave state information.

Figure 6:
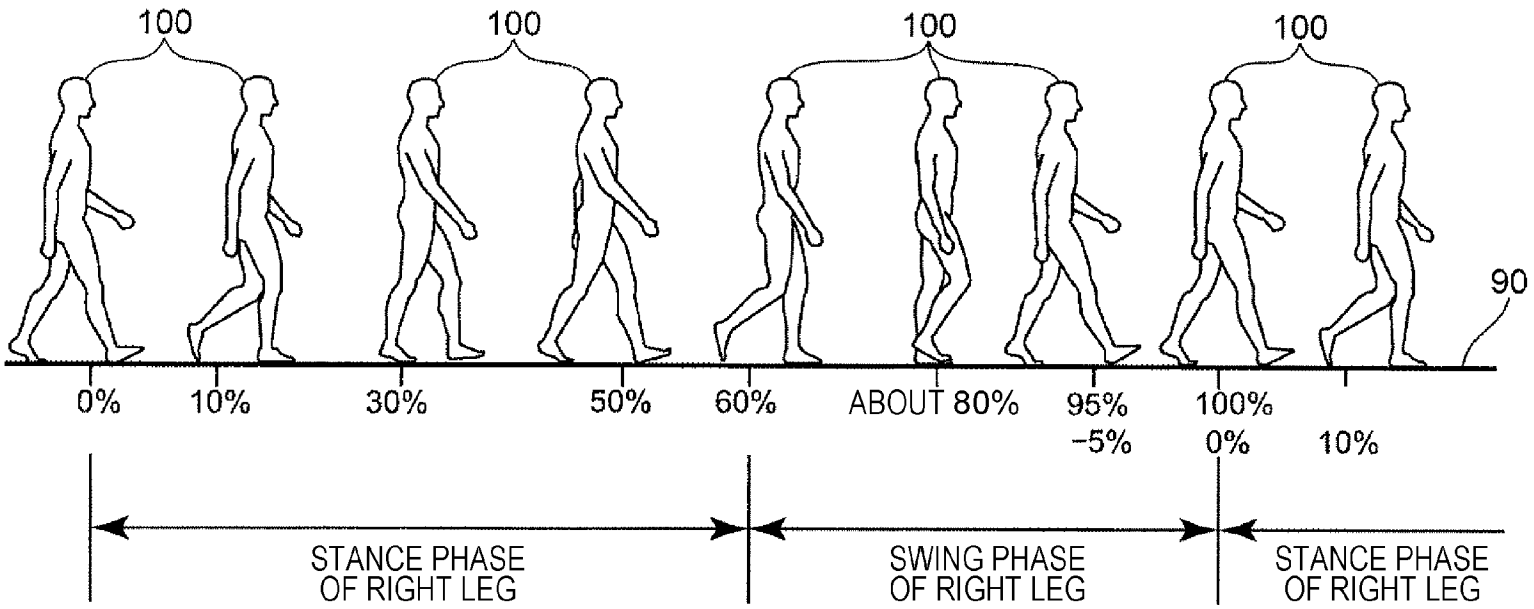
FIG. 6 is a diagram illustrating a gait cycle of a right foot in the first embodiment of the present disclosure.

The gait cycle estimation unit 20 receives contact state information about the left and right feet from the foot sensors 8*a* and 8*b* via the input/output IF 41. The gait cycle estimation unit 20 calculates a gait cycle of the user 100 wearing the assist pants 2*a* or the assist ankle bands 2*b* and 2*c* on the basis of the contact state information from the foot sensors 8*a* and 8*b* and time information on the time from when either of the foot sensors 8*a* and 8*b* is brought into an on-signal state (i.e., information about a walking time), which is obtained from an internal timer. FIG. 6 illustrates a gait cycle of the right leg as an example. As illustrated in FIG. 6, the gait cycle estimation unit 20 defines 0% of the gait cycle when the heel of the right foot contacts the ground. Further, 10% of the gait cycle is set when the left foot completely leaves the road surface 90, 30% of the gait cycle is set when the heel of the right foot leaves the road surface 90, 50% of the gait cycle is set when the heel of the left foot contacts the ground, 60% of the gait cycle is set when the right foot completely leaves the road surface 90, and 100%=0% of the gait cycle is set when the heel of the right foot contacts the ground again. Then, the gait cycle estimation unit 20 outputs information indicating the current percentage of the walking cycle of the user 100 and information about the walking time of the user 100 to the timing determination unit 23, the torque target value setting unit 25, the road surface R estimation unit 21, and the second stiffness target value output unit 28 as gait cycle information. When the moment at which a foot contacts the ground is defined as 0% of one gait cycle, the time when a state where none of the foot sensors 8*a* and 8*b* is in an ON state is changed to a state where at least one of the foot sensors 8*a* or 8*b* is brought into the ON state is instantaneously determined to correspond to 0% of the gait cycle. Thereafter, an amount of time per cycle is calculated from, for example, information about the preceding cycle (or the previous several cycles) and is added from 0% to define a gait cycle.

The road surface R estimation unit 21 estimates, based on the contact state information of the feet respectively input from the right and left foot sensors 8*a* and 8*b* and the gait cycle information input from the gait cycle estimation unit 20, a curvature R of the road surface 90 with which a foot of the user 100 comes into contact as curvature information and outputs the estimated information about the curvature R of the road surface 90 (curvature information) to the first stiffness target value output unit 24. That is, the road surface R estimation unit 21 obtains information about the curvature R of the road surface 90 as road surface information on the basis of ON/OFF signals of the foot sensors 8*a* and 8*b* when the sole or the entire sole is in contact with the road surface 90.

Figure 7:
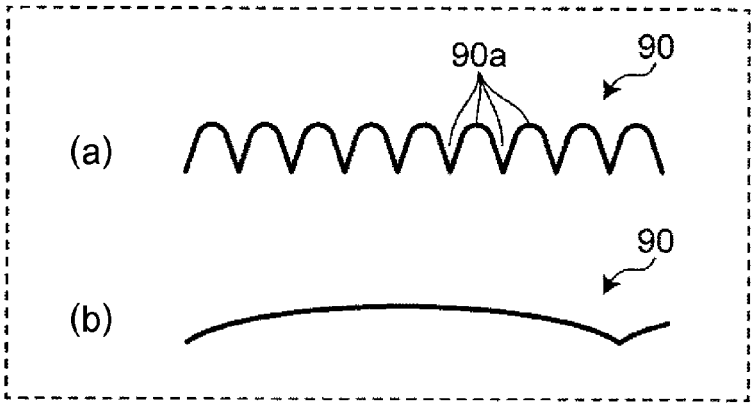
FIG. 7 is a diagram illustrating curvature states of a road surface in the first embodiment of the present disclosure.

FIGS. 7(*a*) and 7(*b*) are diagrams schematically illustrating enlarged cross sections of the road surface 90. In a state illustrated in FIG. 7(*a*), the road surface 90 has fine convex and concave portions 90*a*, where in a state illustrated in FIG.

7(*b*), the road surface 90 has no fine convex and concave portions but is substantially flat. The curvature of the convex portions on the road surface 90 in the illustrated states is represented as a radius of curvature R. Typically, as in FIG. 7(*b*), when the road surface 90 has no fine convex and concave portions but is substantially flat, the user 100 is less likely to fall and thus high stiffness is not required. As in FIG. 7(*a*), when the road surface 90 has the fine convex and concave portions 90*a*, in contrast, the user 100 is more likely to fall and thus the control device 3 performs operation control to increase the stiffness compared with that described above.

Figure 8:
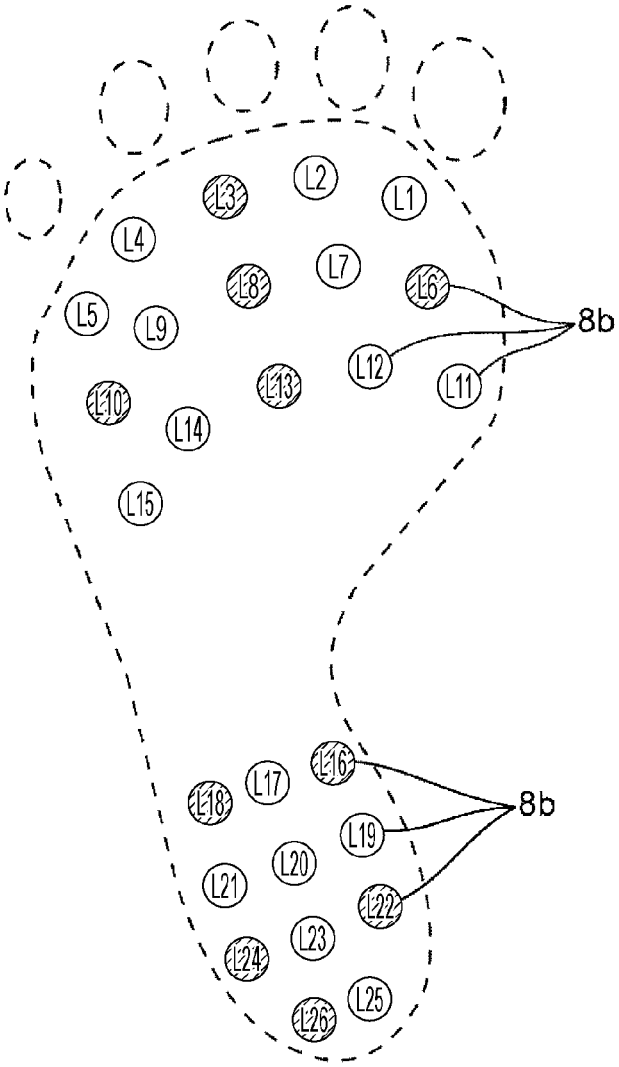
FIG. 8 is a diagram illustrating an example of the output of foot sensors in the first embodiment of the present disclosure.

FIG. 8 is a diagram illustrating the state of the foot sensors 8*b* when the foot of the user 100 is on the road surface 90 having the state illustrated in FIG. 7(*a*). The foot sensors 8*b* illustrated with hatching indicate an ON state when touching the road surface 90, and the foot sensors 8*b* illustrated without hatching indicate an OFF state when touching the road surface 90. The road surface 90 having the state illustrated in FIG. 7(*a*) has the fine convex and concave portions 90*a*, and many portions of point contact between the sole and the road surface 90 appear on the road surface 90. The contact portions between the foot of the user 100 and the road surface 90 are sparse in the heel and the toe.

Figure 9:
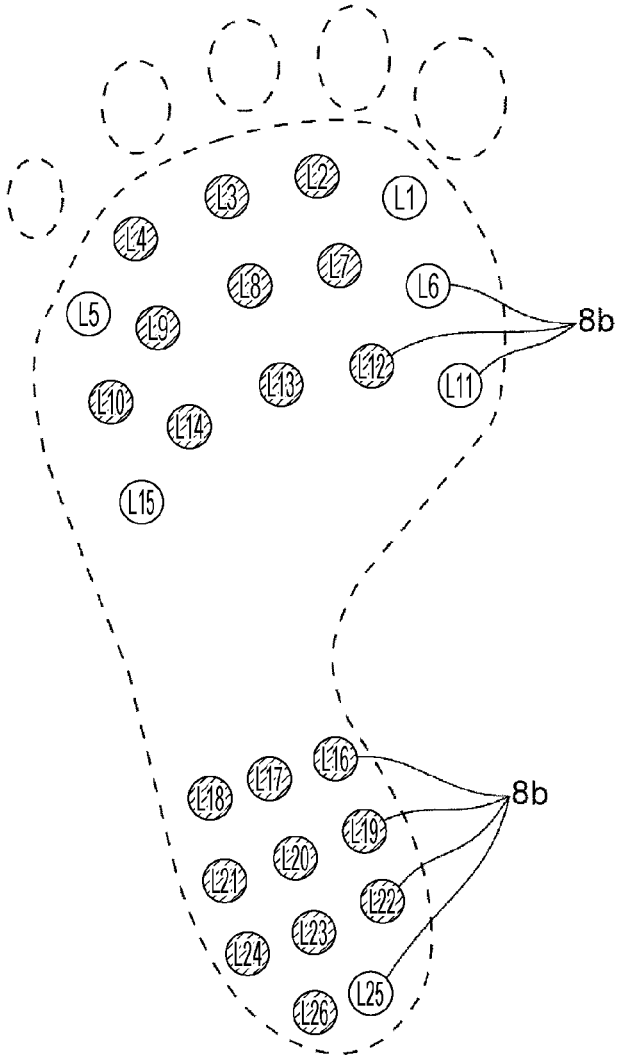
FIG. 9 is a diagram illustrating an example of the output of the foot sensors in the first embodiment of the present disclosure.

FIG. 9 is a diagram illustrating the state of the foot sensors 8*b* when the foot of the user 100 is on the road surface 90 having the state illustrated in FIG. 7(*b*). As in FIG. 8, the foot sensors 8*b* illustrated with hatching indicate an ON state when touching the road surface 90, and the foot sensors 8*b* illustrated without hatching indicate an OFF state when touching the road surface 90. The road surface 90 having the state illustrated in FIG. 7(*b*) is substantially flat, and many portions of plane contact between the sole and the road surface 90 appear. Thus, a large number of foot sensors 8*b* are in the ON state together with adjacent foot sensors 8*b* in the heel and the toe.

Accordingly, the state illustrated in FIG. 8 in which adjacent foot sensors 8*b* are in the on-signal state and the off-signal state indicates that the curvature R in the state illustrated in FIG. 7(*a*) is smaller than the curvature R in the state illustrated in FIG. 7(*b*), compared with the state illustrated in FIG. 9 in which adjacent foot sensors 8*b* are in the on-signal state. Thus, in the state illustrated in FIG. 7(*a*), in other words, in the state illustrated in FIG. 8 in which adjacent foot sensors 8*b* are in the on-signal state and the off-signal state, the control device 3 attempts to perform control to increase the stiffnesses to be transmitted to the left side surface and right side surface of the thigh or ankle of the leg.

The road surface R estimation unit 21 specifically obtains road surface information in the following way. The road surface R estimation unit 21 includes in advance signal models of the foot sensors 8*b*, which are associated with road surface curvatures as illustrated in FIG. 10. In an example in FIG. 10, a signal model A has the largest road surface curvature, with the road surface curvature decreasing toward a signal model D from the signal model A, and the signal model D has the smallest road surface curvature. Further, the signal model A and the signal model B are determined in advance to be in a "large-road-surface-R group" (a group having a large road surface curvature), and the signal model C and the signal model D are determined in advance to be in a "small-road-surface-R group" (a group having a small road surface curvature). For an input signal of each of the foot sensors 8*b*, the percentages of coincidence with the signal model A and the signal model B are calculated. The description will be given with reference to the state diagrams of the foot sensors 8*b* in FIG. 8 and FIG. 9, by way of example. FIG. 11A and FIG. 11B are diagrams respectively illustrating the states of the foot sensors 8*b* in FIG. 8 and FIG. 9 and the percentages of coincidence of the foot sensors 8*b* with the signal models A to D illustrated in FIG. 10. According to this, the states of the foot sensors 8*b* illustrated in FIG. 8 have the highest percentage of coincidence with the signal model C. Thus, when the signals illustrated in FIG. 8 are input, the road surface R estimation unit 21 determines that the states of the road surface curvatures match the signal model C. In this case, the road surface R estimation unit 21 determines that the road surface curvatures are in the small-road-surface-R group. The states of the foot sensors 8*b* illustrated in FIG. 9 have the highest percentage of coincidence with the signal model B. Thus, when the signals illustrated in FIG. 9 are input, the road surface R estimation unit 21 selects the signal model B as the states of the road surface curvatures. In this case, the road surface R estimation unit 21 determines that the road surface curvatures are in the large-road-surface-R group. In this way, the road surface R estimation unit 21 determines the degree of the curvature R and outputs information about the determination.

In the example in FIG. 10, one signal model is shown for each of the road surface states of the signal models A, B, C, and D. However, it is assumed that signal models indicating slight shifts of the foot in the forward, back, left, and right directions are prepared and multiple signal models are prepared in advance for each road surface state. This example describes ON/OFF binary models as a non-limiting example. When the foot sensors 8*b* are configured to provide stepwise output, the percentages of coincidence can be obtained by using a typical image matching technique or the like.

Since contact state information of a foot at the timing when the sole or the entire sole is in contact with the road surface 90 is road surface information, the road surface R estimation unit 21 estimates approximate calculation of the curvature R of the road surface 90 as road surface information, for example, on the basis of the gait cycle information input from the gait cycle estimation unit 20 from contact state information of the right foot or left foot during 10% to 15% of the gait cycle, and the estimated road surface information, or curvature information, is output from the road surface R estimation unit 21 to the first stiffness target value output unit 24.

Figures 12A, 12B:
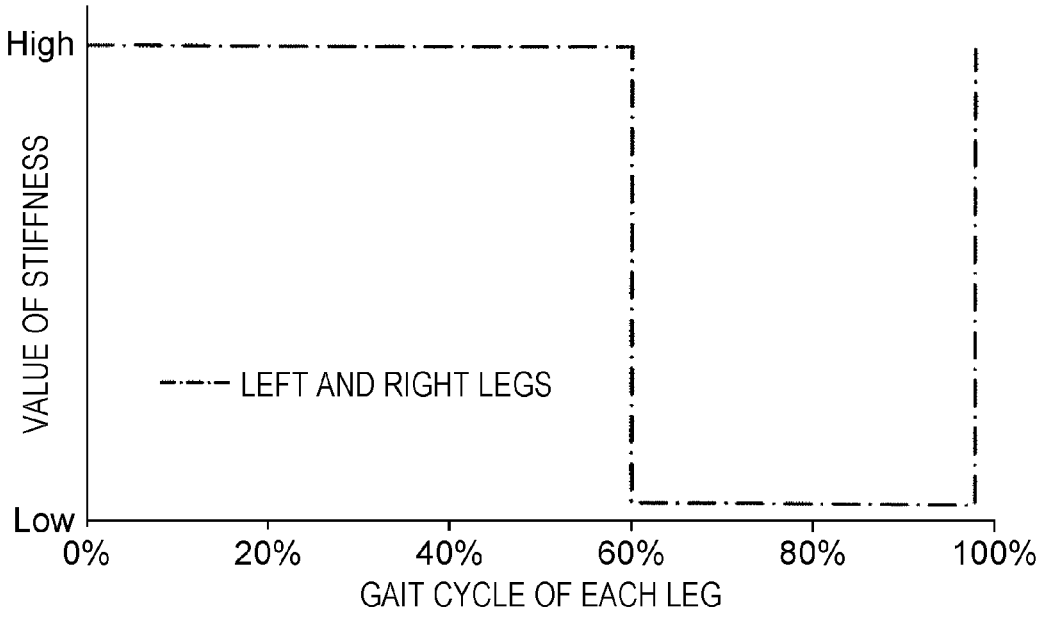
FIG. 12A is a diagram illustrating an example of the operation of a timing determination unit in the first embodiment of the present disclosure.
FIG. 12B is a diagram illustrating a graph depicting an example of the operation of the timing determination unit in the first embodiment of the present disclosure.

The timing determination unit 23 outputs, based on the gait cycle information output from the gait cycle estimation unit 20, an instruction for changing the stiffnesses to be transmitted to the left side surface and right side surface of the intended part of the user at the same time (i.e., a stiffness change timing signal or stiffness change timing information) to the first stiffness target value output unit 24, thereby controlling the timing when the first stiffness target value output unit 24 changes the stiffnesses to be transmitted to the left side surface and right side surface of the left leg at the same time and controlling the timing when the first stiffness target value output unit 24 changes the stiffnesses to be transmitted to the left side surface and right side surface of the right leg at the same time. The intended part of the user includes at least one of the left thigh, the right thigh, the left ankle, and the right ankle. As an example, FIG. 12A and FIG. 12B illustrate the operation of the timing determination unit 23. "Up" indicates that a signal for increasing the stiffness to be transmitted to the corresponding part of the user is output as a stiffness change timing signal, and "Down" indicates that a signal for decreasing the stiffness to be transmitted to the corresponding part of the user is output as a stiffness change timing signal. In the example in FIG. 12A and FIG. 12B, in a period from 0% to less than 60% of the gait cycle of the right leg, the timing determination unit 23 outputs a signal for increasing the stiffness to be transmitted to the corresponding part of the user. In a period from 60% to less than 98% of the gait cycle of the right leg, the timing determination unit 23 outputs a signal for decreasing the stiffness to be transmitted to the corresponding part of the user. In a period from 98% to 100% (=0%) of the gait cycle of the right leg, the timing determination unit 23 outputs a signal for increasing the stiffness to be transmitted to the corresponding part of the user. In a period from 0% to less than 10% of the gait cycle of the left leg, the timing determination unit 23 outputs a signal for increasing the stiffness to be transmitted to the corresponding part of the user. In a period from 10% to less than 48% of the gait cycle of the left leg, the timing determination unit 23 outputs a signal for decreasing the stiffness to be transmitted to the corresponding part of the user. In a period from 48% to 100% (=0%) of the gait cycle of the left leg, the timing determination unit 23 outputs a signal for increasing the stiffness to be transmitted to the corresponding part of the user. The timing for changing the stiffness to be transmitted to the ankle or thigh of the right leg indicates the timing for changing the stiffnesses to be transmitted to the left side surface and right side surface of the ankle or the left side surface and right side surface of the thigh of the right leg, that is, the timing for changing the stiffnesses for both the ankle wires 11*f* and 11*e* or the stiffnesses for both the thigh wires 10*f* and 10*e*. The timing for changing the stiffness to be transmitted to the ankle or thigh of the left leg indicates the timing for changing the stiffnesses to be transmitted to the left side surface and right side surface of the ankle or the left side surface and right side surface of the thigh of the left leg, that is, the timing for changing the stiffnesses for both the ankle wires 11*h* and 11*g* or the stiffnesses for both the thigh wires 10*h* and 10*g*. Accordingly, stiffnesses for the left and right wires of the ankle or thigh of each leg are always changed at the same time.

Figure 13:
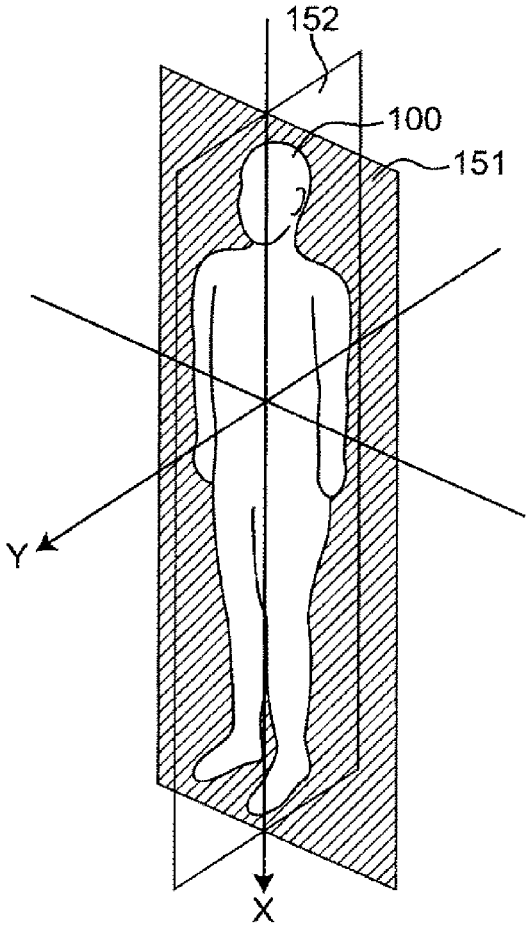
FIG. 13 is a perspective view of the body of a user, illustrating a frontal plane and a sagittal plane.
Figures 14A, 14B:
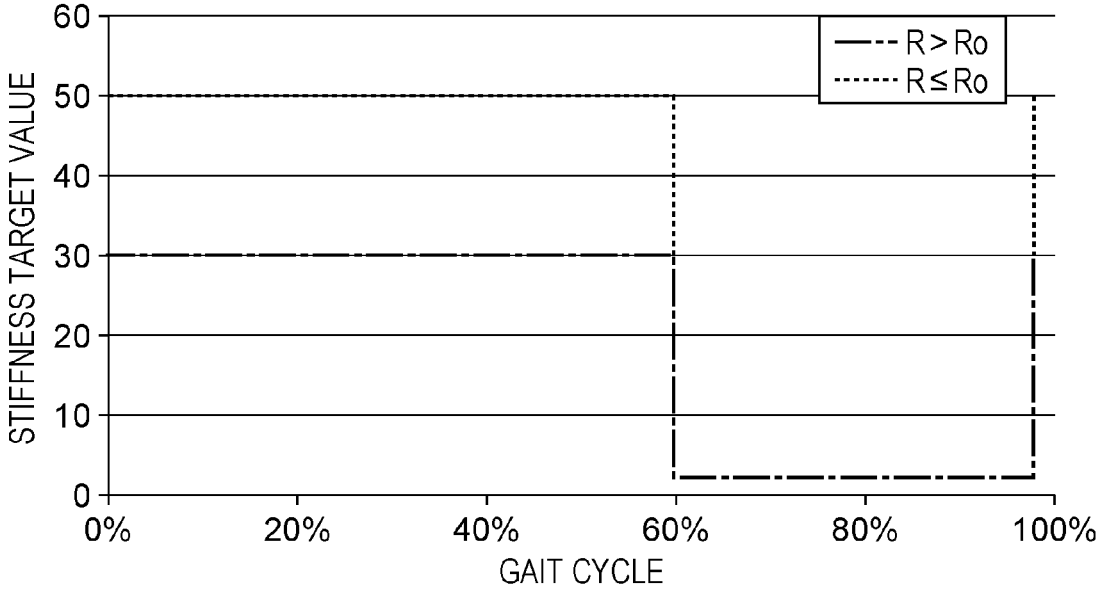
FIG. 14A is a diagram illustrating an example of the operation of a stiffness target value output unit in the first embodiment of the present disclosure.
FIG. 14B is a diagram illustrating a graph depicting an example of the operation of the stiffness target value output unit in the first embodiment of the present disclosure.

The first stiffness target value output unit 24 determines a stiffness target value for motion in the frontal direction when the stiffness is increased, on the basis of the curvature information of the road surface 90 as the road surface information output from the road surface R estimation unit 21, and then selects whether the determined stiffness target value is a higher stiffness target value or a lower stiffness target value than a current stiffness value (i.e., before assistance) in accordance with the stiffness change timing signal output from the timing determination unit 23. The frontal direction refers to a direction within a frontal plane. As illustrated in FIG. 13, a frontal plane 151 refers to a plane that divides the body of the user 100 on a longitudinal plane extending in a left-right direction. That is, the frontal direction is approximately the horizontal direction in a plane that divides the body of the user 100 into front and back halves. Note that a plane perpendicular to the frontal plane 151, which divides the body on a longitudinal plane extending in an anterior-posterior direction, is a sagittal plane 152. The frontal direction of the user may be referred to as the left-right direction of the body of the user or the left-right direction of the user. FIG. 14A and FIG. 14B illustrate the output of the stiffness for the right leg as an example of the operation of the first stiffness target value output unit 24. In FIG. 14A and FIG. 14B, the stiffness target values are expressed in Nm/θ. In FIG. 14A and FIG. 14B, "R" denotes the curvature of the convex portions detected as on-signals of the foot sensors 8*a* and 8*b* on the road surface 90 when the sole is in contact with the ground, and the "large-road-surface-R group" refers to a group for which the estimated curvature R of the road surface 90 is larger than a threshold Ro of the curvature R of the road surface 90, which is determined in advance as an example of a first predetermined value. Examples of the large-road-surface-R group include the signal models A and B. The "small-road-surface-R group" refers to a group for which the estimated curvature R of the road surface 90 is smaller than the threshold Ro of the curvature R of the road surface 90. Examples of the small-road-surface-R group include the signal models C and D. The signal models C and D have poorer contact states than the signal models A and B, and thus the stiffness for the signal models C and D is assumed to be set higher than that for the signal models A and B. As an example, the threshold Ro is 1 m. The value of the threshold Ro indicates, as an example, a curvature obtained when the road surface 90 decreases by about 5 mm from the right edge to the left edge of the sole, where the width of the sole of an adult is assumed to be less than 100 mm.

Specifically, the first stiffness target value output unit 24 first determines a stiffness value for a high-stiffness timing from the information about the curvature R of the road surface, which is output from the road surface R estimation unit 21. In other words, in FIG. 14A and in FIG. 14B, the signal model A or B for the large-road-surface-R group or the signal model C or D for the small-road-surface-R group is determined on the basis of the threshold Ro.

Then, the first stiffness target value output unit 24 determines a current stiffness target value (i.e., before assistance) from the signal output from the timing determination unit 23 for changing the stiffness and outputs the current stiffness target value as a control signal. In other words, the first stiffness target value output unit 24 determines whether the stiffness change timing signal indicates "Up" or "Down" from FIG. 12A and selects the first row, namely, the "increase time" row or the second row, namely, the "decrease time" row in FIG. 14A. Then, the determined stiffness target value is output to the motor setting unit 26 as a control signal. For example, in FIG. 14A and FIG. 14B, when the curvature R estimated by the road surface R estimation unit 21 is included in the "large-road-surface-R group" and the "increase time" is obtained, the first stiffness target value output unit 24 outputs "30" to the motor setting unit 26 as the stiffness target value. When the curvature R estimated by the road surface R estimation unit 21 is included in the "large-road-surface-R group" and the "decrease time" is obtained, the first stiffness target value output unit 24 outputs "2" to the motor setting unit 26 as the stiffness target value. On the other hand, when the curvature R estimated by the road surface R estimation unit 21 is included in the "small-road-surface-R group" and the "increase time" is obtained, the first stiffness target value output unit 24 outputs "50" to the motor setting unit 26 as the stiffness target value. When the curvature R estimated by the road surface R estimation unit 21 is included in the "small-road-surface-R group" and the "decrease time" is obtained, the first stiffness target value output unit 24 outputs "2" to the motor setting unit 26 as the stiffness target value.

Accordingly, the first stiffness target value output unit 24 determines a stiffness target value for assistance, and the determined stiffness target value is output from the first stiffness target value output unit 24 to the motor setting unit 26 as a control signal.

The motion in the frontal direction refers to, among the following four motions, first and second two motions, third and fourth two motions, or all of the four motions.

The first motion is the motion of the right thigh in the left-right direction, which is generated by controlling the driving of the pair of motors 13*e* and 13*f* corresponding to the thigh wires 10*e* and 10*f* on the outer side and inner side of the right leg.

The second motion is the motion of the left thigh in the left-right direction, which is generated by controlling the driving of the pair of motors 13*g* and 13*h* corresponding to the thigh wires 10*g* and 10*h* on the inner side and outer side of the left leg.

The third motion is the motion of the right ankle joint in the left-right direction, which is generated by controlling the driving of the pair of motors 14*e* and 14*f* corresponding to the ankle wires 11*e* and 11*f* on the outer side and inner side of the right ankle.

The fourth motion is the motion of the left ankle joint in the left-right direction, which is generated by controlling the driving of the pair of motors 14*g* and 14*h* corresponding to the ankle wires 11*g* and 11*h* on the inner side and outer side of the left ankle.

Figure 15:
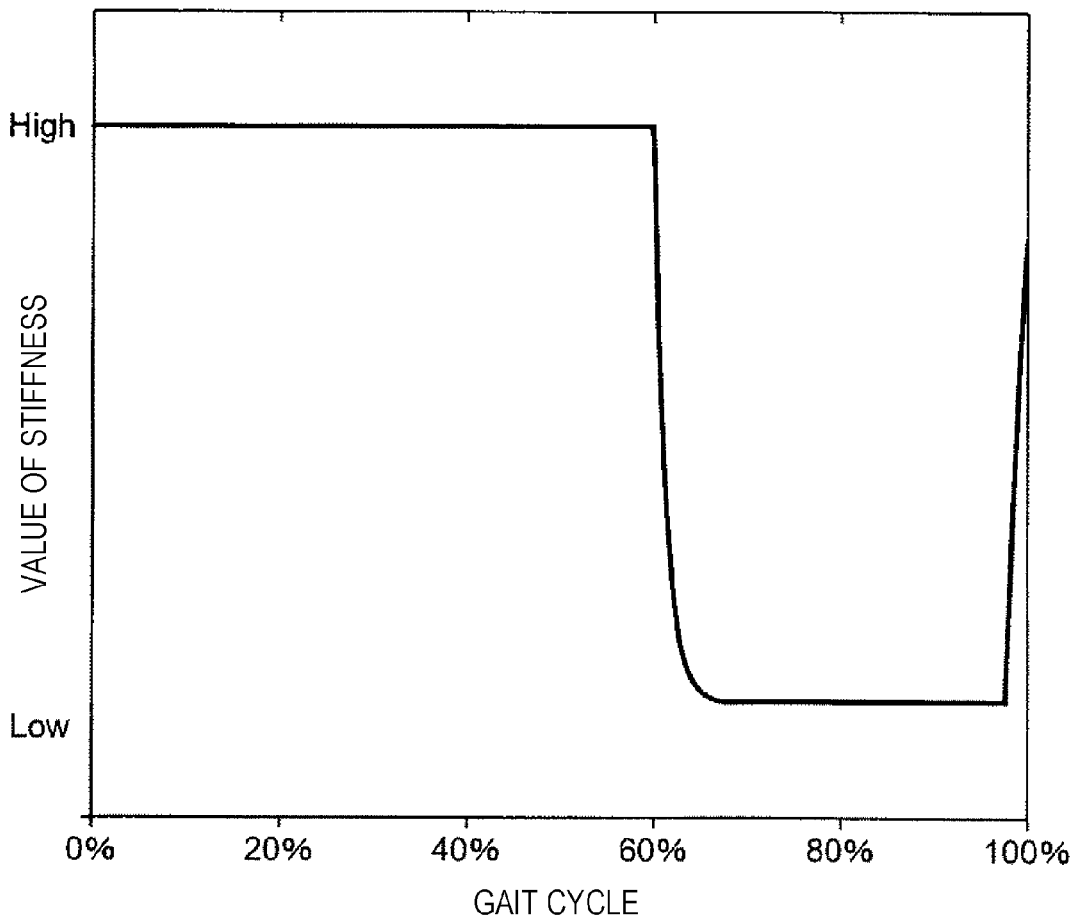
FIG. 15 is a diagram illustrating an example of a modification of the stiffness target value output unit in the first embodiment of the present disclosure.

The stiffness value refers to tensile stiffness imparted to the wires 10 or 11 by controlling the rotational driving of the motors 13 or 14, and is expressed in Nm/θ. In FIG. 15, as indicated when the stiffness value is increased in the period of 98% to 100% of the gait cycle and as indicated when the stiffness value is decreased in a period around 60% of the gait cycle, the stiffness may be changed smoothly.

The motor setting unit 26 sets the setting values of the thigh motors 13*e*, 13*f*, 13*g*, and 13*h* or the ankle motors 14*e*, 14*f*, 14*g*, and 14*h* on the basis of the stiffness target values output from the first stiffness target value output unit 24, and the set values of the thigh motors 13*e*, 13*f*, 13*g*, and 13*h* or the ankle motors 14*e*, 14*f*, 14*g*, and 14*h* are output from the motor setting unit 26 to the motor control unit 27 as motor control signals.

Figure 16:
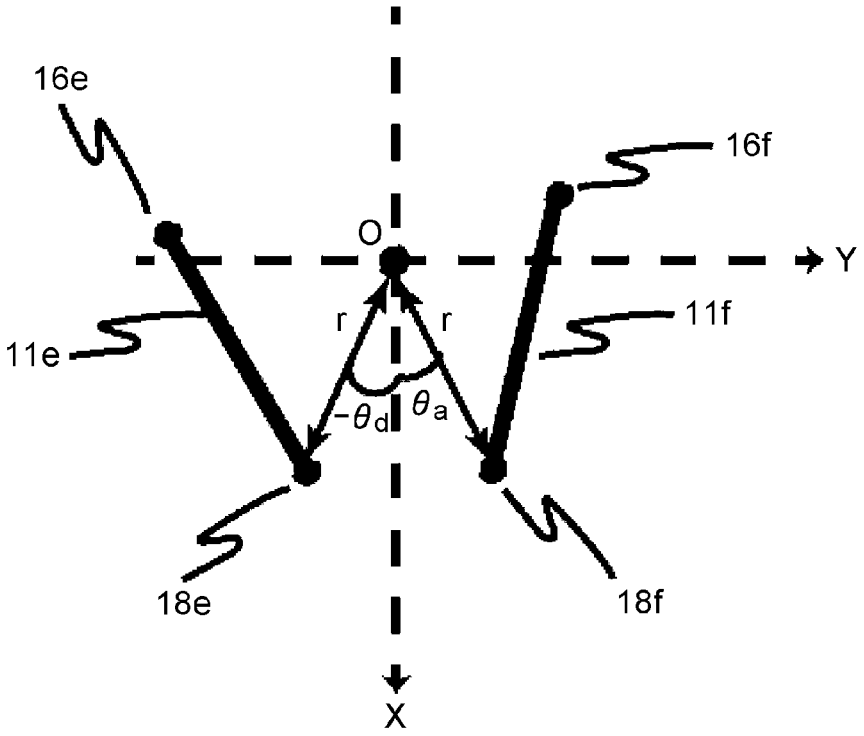
FIG. 16 is a diagram illustrating the arrangement of wires in the first embodiment of the present disclosure.

FIG. 16 illustrates the arrangement of the left and right wires 11*e* and 11*f* of the right ankle as an example. The same applies to the left thigh, the right thigh, and the left ankle. In the following, a relationship between a left-right torque t and a stiffness target value, that is, a modulus of elasticity K (hereinafter referred to as a stiffness value K) of rotational stiffnesses with respect to a center of rotation O, which are generated by both the wire 11*e* and the wire 11*f*, will be described with reference to FIG. 16. The left-right torque t and the stiffness value K of the thigh or ankle of each leg in the wires 10 or 11, which is generated by the other motors 13 or 14, can also be determined in a similar way.

In FIG. 16, O denotes a center of leftward and rightward rotations viewed from the front of the right ankle joint (in the case of a thigh, a hip joint) of the user 100, 18*e* denotes a lower-end ankle wire attachment unit serving as the point of application for the ankle wire 11*e* on the outer side of the right ankle, 18*f* denotes a lower-end ankle wire attachment unit serving as the point of application for the ankle wire 11*f* on the inner side of the right ankle, 16*e* denotes a starting point of the ankle wire 11*e*, 16*f* denotes a starting point of the ankle wire 11*f*, *r* denotes a distance between the point O and the point 16*e* (in other words, the distance between the point O and the point 16*f*), $\theta_a$ denotes an angle defined by a line segment O16*e* and the X axis, and $\theta_d$ denotes an angle defined by a line segment O16*f* and the X axis. $x_{A0}$ and $y_{A0}$ denote the x coordinate and the y coordinate of the point 16*e*, respectively. The distance r, the position of the point 16*e*, and the position of the point 16*f* are calculated in advance from design values of the assist pants 2*a* and are stored in the motor setting unit 26.

At this time, a torque $\tau_a$ relative to the center of rotation O, which is generated in the ankle wire 11*e*, is given by the following equation.

If $$f(\theta_a)=x_{A0}^2+y_{A0}^2+r^2-2r(x_{A0}\cos\theta_a+y_{A0}\sin\theta_a) \quad \text{(Eq. 1)}$$

then, $$\tau_a=K_a\{r(y_{A0}\cos\theta_a-x_{A0}\sin\theta_a)\cdot(f(\theta_a)-I_a)\}, \quad \text{(Eq. 2)}$$

where $K_a$ is the modulus of elasticity of the wire 11*e* in the linear movement direction, and $I_a$ is the natural length $L_0$ of the wire 11*e*. The modulus of elasticity $K_{\theta a}$ of the wire 11*e* in the rotation direction is given by the following equation.

$$K_{\theta a} = K_a\left\{r(l_a - f(\theta_a))(y_{A0}\sin\theta_a + x_{A0}\cos\theta_a) - \frac{r^2}{f(\theta_a)}(y_{A0}\cos\theta_a - x_{A0}\sin\theta_a)^2\right\} \quad \text{(Eq. 3)}$$

Further, the left-right torque τ relative to the center of rotation O, which is generated by both the wire 11*e* and the wire 11*f*, is given by $$\tau=\tau_a-\tau_b, \quad \text{(Eq. 4)}$$

where $\tau_b$ denotes a torque generated by the wire 11*f* relative to the center of rotation O and can be calculated in a way similar to that for $\tau_a$. The stiffness value K relative to the center of rotation O, which is generated by both the wire 11*e* and the wire 11*f*, can be represented by $$K=K_{\theta a}-K_{\theta d}, \quad \text{(Eq. 5)}$$

where $K_{\theta d}$ is a modulus of elasticity of the wire 11*f* in the rotation direction and can be calculated in a way similar to that for $K_{\theta a}$.

If there is not need to generate a difference in the left-right direction, the following equation is used.

$$K_{\theta d}=K_{\theta a} \quad \text{(Eq. 6)}$$

The moduli of elasticity $K_a$ and $K_d$ in the linear movement direction are calculated by using Eqs. 1 to 6 above and are output as the respective motor control signals of the motors. Specifically, $K_a$ represents a motor control signal $K_{14f}$ for the motor 14*f*, and $K_d$ represents a motor control signal $K_{14e}$ for the motor 14*e*.

Eq. 6 is not limited to that given above. For example, $K_{\theta d}=2K_{\theta a}$ or the like may be used depending on, for example, conditions of the road surface, the characteristics of joints of a person, and so on, in which case calculation can be performed in a similar way.

Figure 17:
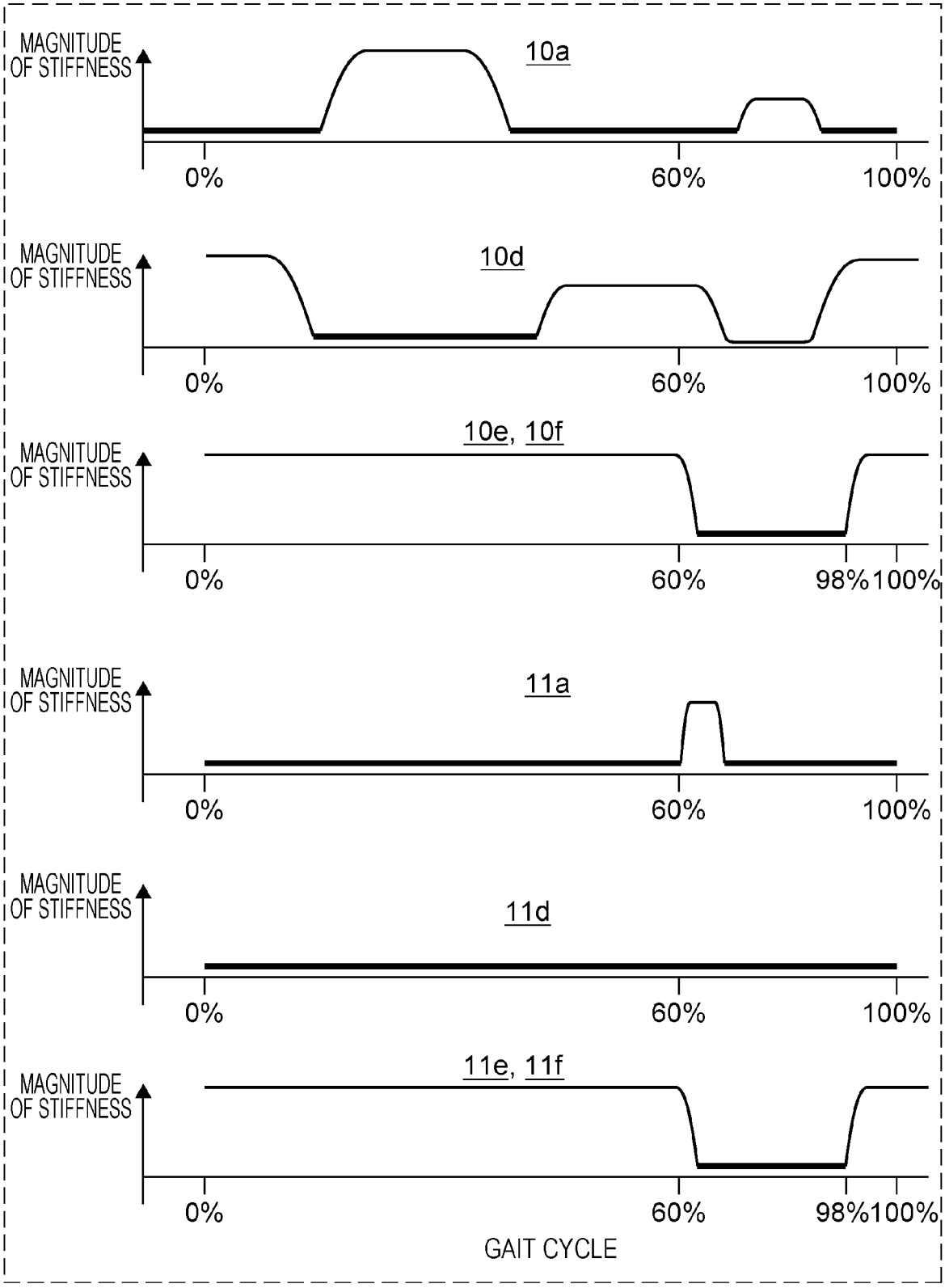
FIG. 17 is a diagram illustrating example timing charts of target moduli of elasticity of respective wires in the first embodiment of the present disclosure.

FIG. 17 illustrates an example relationship between the gait cycle of the right leg and the stiffness target value of the thigh wires 10 or the ankle wires 11. In FIG. 17, the horizontal axis represents the gait cycle of the right leg and the vertical axis represents the magnitude of the stiffness target value. The third graph in FIG. 17 illustrates an example relationship between the gait cycle and the stiffness target value of the thigh wires 10*e* and 10*f*. The sixth graph in FIG. 17 illustrates an example relationship between the gait cycle and the stiffness target value of the ankle wires 11*e* and 11*f*. The first and second graphs in FIG. 17 illustrate example relationships between the gait cycle and the stiffness target value of front and back wires 10*a* and 10*d* of the thigh of the right leg according to a modification described below. The fourth and fifth graphs in FIG. 17 illustrate example relationships between the gait cycle and the stiffness target value of front and back wires 11*a* and 11*d* of the right ankle according to the modification described below.

As illustrated in the third graph from the top in FIG. 17, in the transverse direction of the thighs, only stiffness is assisted without generating an assistance torque. Thus, the first stiffness target value output unit 24 performs control to increase the stiffness target values of the left and right thigh wires 10 of a leg, namely, the thigh wires 10*e* and 10*f* on the outer side and inner side of the right leg, at the same time to increase the stiffnesses to be transmitted to the left side surface and right side surface of the thigh of the right leg. As an example, the moduli of elasticity of the pair of thigh wires 10*e* and 10*f* are set to the same value so that the same stiffness can be imparted to the thigh wires 10*e* and 10*f* on the outer side and inner side of the right leg. The same applies to the left leg.

As illustrated in the sixth graph from the top in FIG. 17, in the transverse direction of the ankles, only stiffness is assisted without generating an assistance torque. Thus, the first stiffness target value output unit 24 performs control to increase the moduli of elasticity, which simulate virtual spring stiffnesses, of the left and right ankle wires 11 of a leg, namely, the ankle wires 11*e* and 11*f* on the outer side and inner side of the right ankle, at the same time to increase the stiffnesses to be transmitted to the left side surface and right side surface of the ankle of the right leg. In addition, the first stiffness target value output unit 24 performs control so as not to generate a rotation torque in the transverse direction. As an example, the moduli of elasticity of the pair ankle wires 11*e* and 11*f* are set to the same value, when converted into stiffness values relative to the center of rotation O, and the tensile force is set so as not to generate a left-right assistance torque. The same applies to the left leg.

The motor control unit 27 controls a pair of motors 13 or a pair of motors 14 on the basis of the stiffness target value input from the motor setting unit 26. As a result, for example, the first stiffness target value output unit 24 can control a tension, with the stiffness for a pair of wires 10 or a pair of wires 11 simulating virtual springs for each of the left and right feet, so that the stiffnesses to be transmitted to the left side surface and right side surface of the thigh or ankle in a period from when the heel of the foot contacts the ground to when the heel of the foot completely leaves the road surface 90 are greater than the stiffnesses in any other period (see, for example, the third graph depicting the pair of wires 10*e* and 10*f* or the sixth graph depicting the pair of wires 11*e* and 11*f* in FIG. 17). That is, the first stiffness target value output unit 24 can decrease the second stiffness target value compared with the first stiffness target value on the basis of the road surface information and the gait cycle information of the user 100 and can also increase the stiffnesses to be transmitted to the left side surface and right side surface of each thigh or ankle by changing from the second stiffness target value to the first stiffness target value immediately before the foot contacts the road surface 90. The first stiffness target value indicates the magnitude of the stiffnesses to be transmitted to the left side surface and right side surface of each thigh or ankle when the foot of the user 100 is in contact with the road surface 90, and the second stiffness target value indicates the magnitude of the stiffnesses to be transmitted to the left side surface and right side surface of each thigh or ankle when the foot of the user 100 is not in contact with the road surface 90. In this way, the stiffness target value is changed so as to increase the stiffness for each thigh or ankle in a period from immediately before a foot contacts the road surface 90 to when the foot leaves the road surface 90, thereby limiting the movement of each thigh or ankle in the left-right direction. As a result, the user 100 can be prevented from falling in their left-right direction during walking.

The following more specifically describes the operation of the motor control unit 27.

The motor control unit 27 performs force control calculation by using the stiffness target value in the linear movement direction (in other words, linear-movement moduli of elasticity) Kn input from the motor setting unit 26 to the motor control unit 27 (where n denotes a corresponding motor sign) and the respective motor torques τ obtained from a pair of motors 13 or a pair of motors 14 that control the stiffnesses to be transmitted to the left side surface and right side surface of each of the left and right thighs or ankles, so that the pair of wires 10 or the pair of wires 11 corresponding to the pair of motors 13 or the pair of motors 14 each simulates a virtual spring. The target positions of the motors 13 or 14 (in other words, the target positions of the lower ends of the wires 10 or 11) x, which are determined through force control calculation, are respectively output from the motor control unit 27 to the pair of motors 13 or the pair of motors 14. It is common that a motor torque τ can be determined by $\tau = Kt \times i$ using a motor current i. Kt is a constant unique to each motor.

An example of the force control calculation is as follows.

When a motor torque is represented by t and the tension of each of wires 10 or 11 that are paired with each other at this time is represented by F, the tension F of each of the paired wires 10 or the paired wires 11 can be determined by the following equation.

$$F = G\tau$$

G denotes a conversion coefficient determined from the gear ratio and the pulley radius $r_p$.

The target positions x of the motors 13 or 14 at this time can be determined as below using the stiffness target value Kn in the linear movement direction.

$$x = (1/G)x(F/Kn)$$

As a result of the foregoing operation, the target positions x of the motors 13 or 14 are determined and output to the motors 13 or 14 via the input/output IF 41.

The pair of motors 13 or the pair of motors 14 move to the input target positions x of the motors 13 or 14. Thus, each of the paired wires 10 or the paired wires 11 respectively connected to the paired motors 13 or 14 can operate to simulate a virtual spring and can generate a tension equivalent to the tension generated by a spring having the linear-movement stiffness target value Kn.

The foregoing describes an example in which a pair of motors 13 or a pair of motors 14 operates in position control. Operation in torque control can also be implemented in a similar way.

Figure 18A:
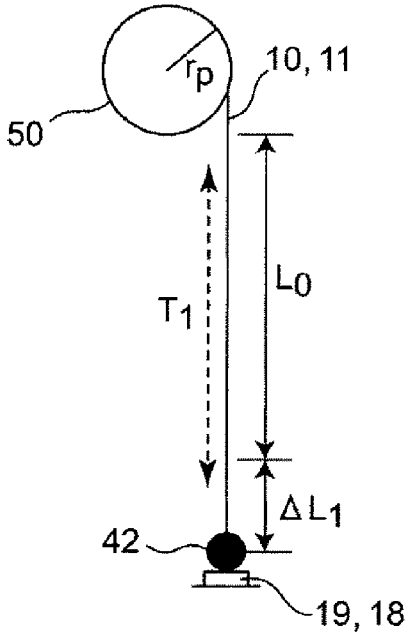
FIG. 18A is a diagram illustrating the operation of a motor control unit in the first embodiment of the present disclosure.
Figure 18B:
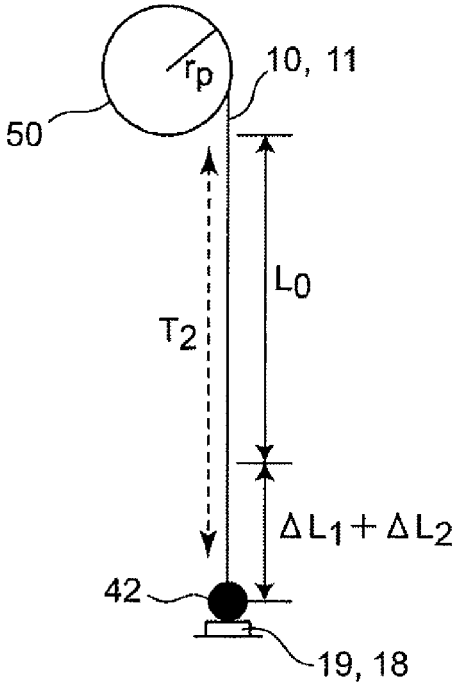
FIG. 18B is a diagram illustrating the operation of the motor control unit in the first embodiment of the present disclosure.

FIG. 18A and FIG. 18B are diagrams schematically illustrating the operation of the motor control unit 27. The tension of each wire 10 or 11 can be detected by a force sensor 42, such as a strain gage or a torque sensor. A strain gage as an example of the force sensor 42 can be located, for example, in the middle of the wire 10 or 11 or between an end of the wire 10 or 11 and the lower-end thigh wire attachment unit 19 or the lower-end ankle wire attachment unit 18 (see FIG. 18A and FIG. 18B) to detect the tension generated in the wire 10 or 11. Further, an amount of change ΔL in the length L of the wire 10 or 11 can be determined as follows. The rotational speed of the pulley 50 is detected by using the encoder 51 of the motor 13 or 14. Since the radius $r_p$ of the pulley 50 is known, computation using the radius $r_p$ and the rotational speed is performed to determine the amount of change ΔL of the length L of the wire 10 or 11 wound up on the pulley 50.

In the motor control unit 27, as illustrated in FIG. 18A, the natural length $L_0$ of a virtual spring is determined in advance. That is, when the length L of the wire 10 or 11 is equal to $L_0$, the tension F generated in the wire 10 or 11 is 0. When the user 100 wears the assist ankle bands 2*b* and 2*c* or the assist pants 2*a* as the assist garment 72 with the wires 10 or 11 being worn at positions longer than the wire length $L_0$ of the wires, tensile forces are generated in the wires 10 or 11 and the tension is $T_1$. At this time, in the case of the linear-movement stiffness target value Kn, if the tension F generated in the motor 13 or 14 is $T_1$, the target position x of the motor 13 or 14 is determined so that the wire 10 or 11 has a length given by $L_0+\Delta L_1$.

In this case, $$\Delta L_1=T_1/Kn.$$

When the gear ratio is 1 and the radius of the pulley 50 is represented by $r_p$, the conversion coefficient G is given by $2\pi r_p$. Thus, the target position x of the motor 13 or 14 is represented by $$x=\{1/(2\pi r_p)\}\times(L_0+\Delta L_1).$$

Next, a case is considered in which when the user 100 wearing the assist garment 72 is moving by walking, running, or the like, the stiffnesses to be transmitted to the left side surface and right side surface of the thighs or ankles of the left and right legs are increased in accordance with the road surface conditions to prevent falling. At this time, as illustrated in FIG. 18B, it is considered that the tension F generated in the wire 10 or 11 is changed from $T_1$ to $T_2$.

At this time, the length L of the wire 10 or 11 is given by $L_0+\Delta L_2$, where $\Delta L_2$ can be calculated by the following equation.

$$\Delta L_2=T_2/Kn$$

At this time, the target position x of the motor 13 or 14 is represented by $$x=\{1/(2\pi r_p)\}\times(L_0+\Delta L_2).$$

When the motor 13 or 14 is operating in torque control, the motor control unit 27 performs force control using the linear-movement stiffness target value Kn input from the motor setting unit 26 and the target position x, which is position information of the motor 13 or 14 obtained from the motor 13 or 14, so that the wire 10 or 11 can operate to simulate a virtual spring. To this end, the motor control unit 27 calculates the motor torque τ and outputs the motor torque τ to the motor 13 or 14.

The motor control unit 27 controls the forward and reverse rotation operation of the motor 13 or 14 to implement the motor torque τ determined through calculation, thereby tightening or loosening the wire 10 or 11 connected to the motor 13 or 14 so as to simulate a virtual spring. As a result, a tension equivalent to the tension generated by a spring having the linear-movement stiffness target value Kn can be generated in the wire 10 or 11.

Figure 19A:
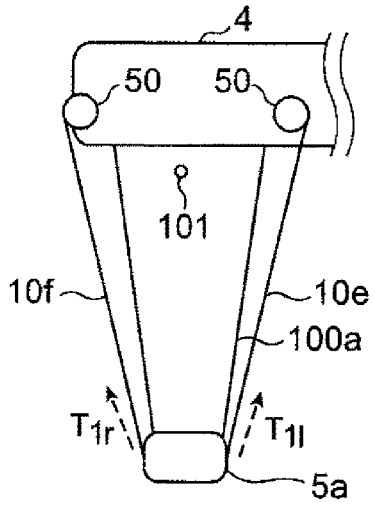
FIG. 19A is a diagram illustrating the operation of an assist system in the first embodiment of the present disclosure.
Figure 19B:
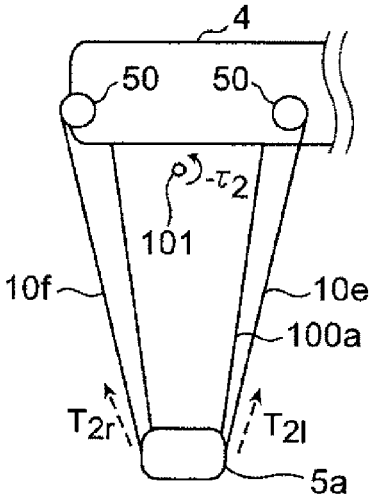
FIG. 19B is a diagram illustrating the operation of the assist system in the first embodiment of the present disclosure.
Figure 19C:
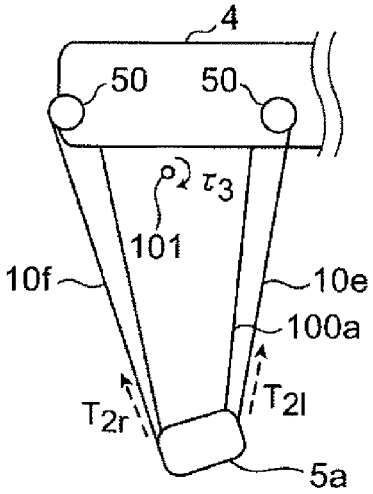
FIG. 19C is a diagram illustrating the operation of the assist system in the first embodiment of the present disclosure.

FIG. 19A to FIG. 19C are diagrams illustrating how an assist system operates in a portion of the right thigh. In FIG. 19A, a tension generated in the thigh wire 10*f* is represented by $T_{1r}$ and a tension generated in the thigh wire 10*e* is represented by $T_{1l}$. The torques generated by the respective tensions with respect to a center of rotation 101 of the hip joints are represented by $\tau_0$ and $-\tau_0$, which are in balance with each other. At this time, no torque is exerted to cause the thighs to rotate to the left and right.

Then, it is assumed that, for example, the user 100 places their foot on a step, thereby exerting a torque $-\tau_2$ on the center of rotation 101 for the thigh (the state in FIG. 19B). As a result, the tension exerted on the thigh wire 10*f* becomes $T_{2r}$, and the tension exerted on the thigh wire 10*e* becomes $T_{2l}$. At this time, the tensions have the following relationship.

$$T_{1r}<T_{2r}, T_{1l}>T_{2l}$$

If a linear-movement stiffness target value that is set for the thigh wire 10*f* is represented by $K_1$ and a stiffness target value that is set for the thigh wire 10*e* is represented by $K_2$, regarding the thigh wire 10*f* and the thigh wire 10*e*, the amounts of changes $\Delta L_r$ and $\Delta L_l$ of the target lengths of the wires 10*f* and 10*e* can be calculated using the following equations.

$$\Delta L_r=(T_{2r}-T_{1r})/K_1, \Delta L_1=(T_{2l}-T_{1l}/K_2$$

The motors 13*f* and 13*e* individually operate in accordance with the target lengths of the wires 10*f* and 10*e* to change the lengths of the wires 10*f* and 10*e*. The thigh wire 10*f* is pulled out and the thigh wire 10*e* is wound up. As a result, as illustrated in FIG. 19C, the hip joints are adducted. Further, due to the tension of the thigh wire 10*f*, the torque exerted on the center of rotation 101 of the hip joints becomes $\tau_{3r}$, and, likewise, due to the tension of the thigh wire 10*e*, the torque exerted on the center of rotation 101 of the hip joints becomes $\tau_{3l}$ (<0). Since the torques generated by the left and right thigh wires 10*f* and 10*e* differ, the balance is disrupted and a torque given by $\tau_3=\tau_{3r}+\tau_{3l}$ is generated in the hip joints. The torque $\tau_3$ is directed opposite to the torque $-\tau_2$, which is generated in the hip joints because a foot is placed on a step. Since the torque $\tau_3$ and the torque $-\tau_2$ are canceled out, the adduction angle of the hip joints becomes smaller than that when the assist system is not used. If no torque is exerted from outside, the balanced state, that is, the state illustrated in FIG. 19A, can be obtained again.

As described above, in the first embodiment, in the first example or the third example, the pair of ankle wires 11*e* and 11*f*, which are located in corresponding portions of the right side surface and left side surface of the right ankle of the user 100 in the longitudinal direction of the right leg of the user 100 and extend through the lower-end ankle outer wire attachment units 16*e* and 16*f* of the right upper ankle belt 6*a*, with the lower ends thereof being coupled to the lower-end ankle wire attachment units 18*e* and 18*f* of the right heel belt 7*a*, and the pair of ankle wires 11*g* and 11*h*, which are located in corresponding portions of the right side surface and left side surface of the left ankle of the user 100 in the longitudinal direction of the left leg of the user 100 and extend through the lower-end ankle outer wire attachment units 16*g* and 16*h* of the left upper ankle belt 6*b*, with the lower ends thereof being coupled to the lower-end ankle wire attachment units 18*g* and 18*h* of the left heel belt 7*b*, are included. In the second example or the third example, the thigh wires 10*e* and 10*f* included in the assist pants body 2*d*, which are located in corresponding portions of the outer side of the right thigh (the right side surface of the right thigh) and the inner side of the right thigh (the left side surface of the right thigh) of the user 100 and have lower ends coupled to the waist belt 4 and the lower-end thigh wire attachment units 19*e* and 19*f* of the above-knee belt 5*a* of the right leg, and the thigh wires 10*g* and 10*h* included in the assist pants body 2*d*, which are located in corresponding portions of the inner side of the left thigh (the right side surface of the left thigh) and the outer side of the left thigh (the left side surface of the left thigh) of the user 100 and have lower ends coupled to the waist belt 4 and the lower-end thigh wire attachment units 19*g* and 19*h* of the above-knee belt 5*b* of the left leg, are included. Further, the control device 3 independently controls the forward and reverse rotation operations of the motors 14 or 13 to adjust the respective lengths of the wires 11 or 10 to adjust the stiffnesses to be transmitted to the left side surface and right side surface of each ankle or thigh, which are to be imparted to the wires 11 or 10. That is, on the basis of at least the contact state information from the foot sensors 8*a* and 8*b*, for example, the first stiffness target value output unit 24 changes, for each of the left and right feet, the stiffnesses to be transmitted to the left side surface and right side surface of the ankle or thigh in a period from 0% of the gait cycle, at which the heel of the foot contacts the ground, to 60% of the gait cycle, at which the foot completely leaves the road surface 90, to be larger than the stiffnesses in any other period. As a result, the user 100 can be prevented from falling in their left-right direction during walking.

As an example, the control device 3 includes the gait cycle estimation unit 20, the road surface R estimation unit 21, the timing determination unit 23, the first stiffness target value output unit 24, the motor setting unit 26, and the motor control unit 27. The first stiffness target value output unit 24 determines target values of stiffness for the thighs or ankles in the left-right direction on the basis of the road surface information from the road surface R estimation unit 21 and the stiffness change timing information from the timing determination unit 23. Then, the first stiffness target value output unit 24 controls the motors 13 or 14 connected to the left and right thigh wires 10*h*, 10*f*, 10*e*, and 10*g* or the left and right ankle wires 11*h*, 11*f*, 11*e*, and 11*g* by an operation with the motor setting unit 26 and the motor control unit 27. This configuration enables the control device 3 to control the stiffnesses to be transmitted to the left side surfaces and right side surfaces of the thighs or ankles as tensions that simulate those of virtual springs in accordance with the target values. Thus, the assist system 1 can maximally prevent the user 100 to be assisted from falling during walking.

Further, when the road surface R estimation unit 21 estimates the curvature R of a road surface and the road surface R estimation unit 21 determines that the estimated curvature R is included in the small-road-surface-R group, the motor setting unit 26 can set a larger stiffness target value than an initially set stiffness target value to perform fall prevention. Conversely, when the road surface R estimation unit 21 determines that the estimated curvature R is included in the large-road-surface-R group, the motor setting unit 26 can set a stiffness target value to be less than or equal to the initially set stiffness target value to facilitate a comparatively free movement of the thigh or ankle of the leg.

As an example, the motor setting unit 26 can set the initially set stiffness target value to, for example, 50%, where the maximum stiffness target value is 100%. If the road surface 90 is not flat and has convex and concave portions that are more likely to cause falling, the motor setting unit 26 can set the stiffness target value to be as high as about 100%, which is the maximum stiffness target value, whereas, if the road surface 90 is flat and is less likely to cause falling, the motor setting unit 26 can set the stiffness target value to be as low as about 30%. Note that the initially set stiffness target value may be set to be lower, namely, 30%, instead of 50%.

Figure 20:
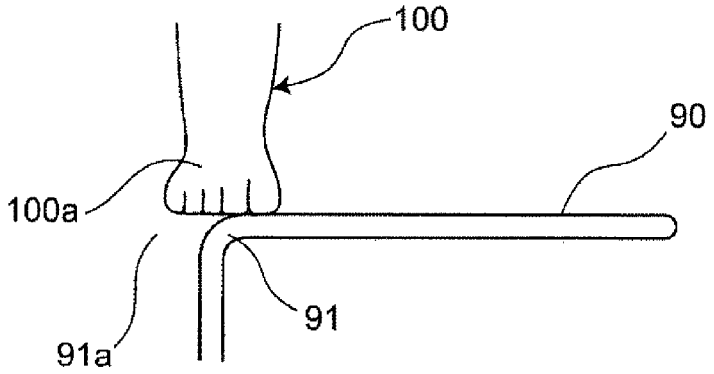
FIG. 20 is a diagram illustrating a relationship between a road surface shape of a step and a foot of the user in the first embodiment of the present disclosure.
Figure 21:
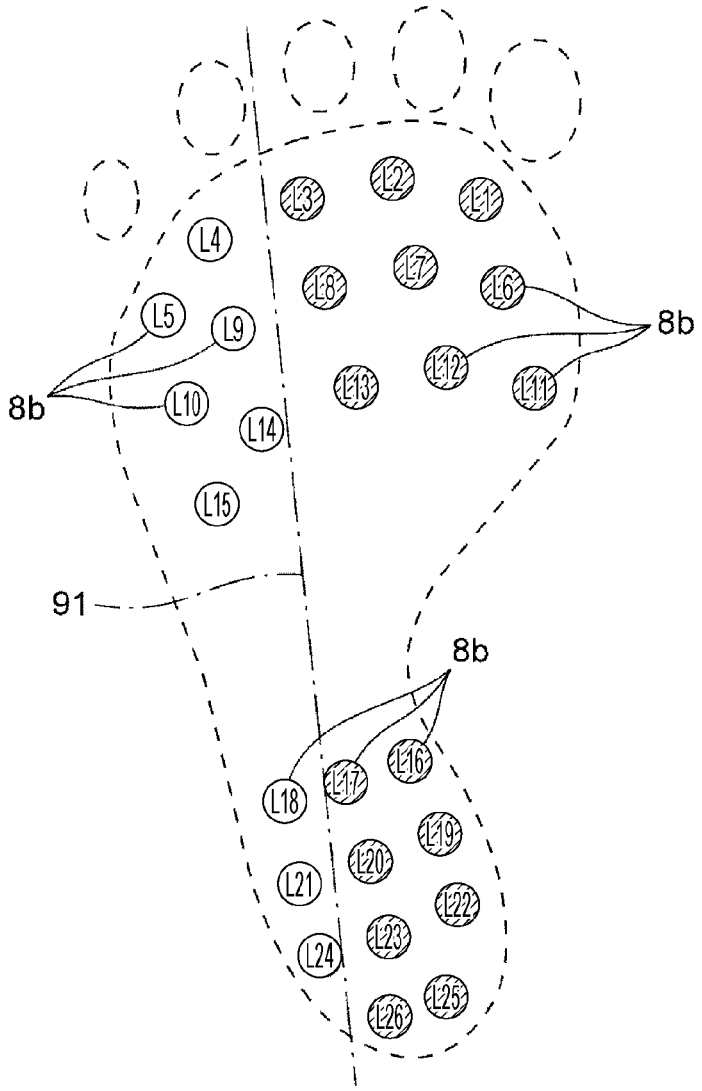
FIG. 21 is a diagram illustrating an example of the output of foot sensors in the first embodiment of the present disclosure.

Further, as illustrated in FIG. 20, when the user 100 places a right foot 100*a* on a portion (such as a ditch) having a step 91 on the road surface 90, the output states of the foot sensors 8*b* illustrated in FIG. 21 are obtained. In FIG. 21, for example, an area to the left of the step 91 indicated by a one-dot chain line is estimated to be a space 91*a* corresponding to the ditch, and an area to the right of the step 91 is estimated to be an edge portion of the ditch on the road surface 90. Here, the foot sensors 8*b* illustrated without hatching in the left portion of the sole of the right foot, which are included in the space 91*a* corresponding to the ditch, output off-state signals, and the foot sensors 8*b* illustrated with hatching in the right portion of the sole of the right foot, which are included in the edge portion of the ditch on the road surface 90, output on-state signals. In this way, when the foot sensors 8*b* in the ON state are located in one side (i.e., in FIG. 21, in the right portion) and the foot sensors 8*b* in the OFF state are located on the opposite side, the road surface R estimation unit 21 determines the presence of a "step" and sets R=0.

Figure 22:
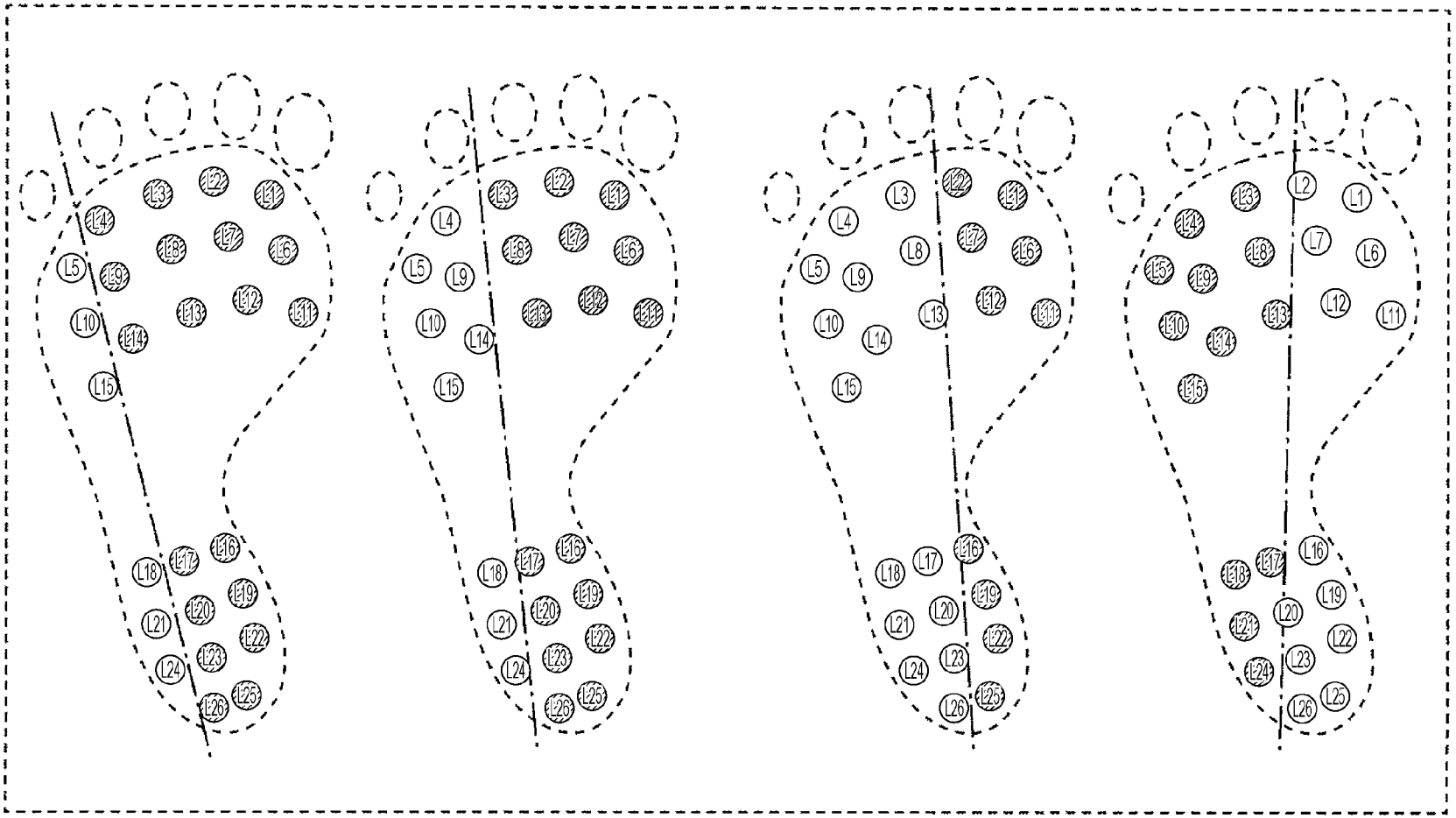
FIG. 22 is a signal model diagram when the foot is placed on a step.

To address such non-uniform location of the foot sensors 8*b*, the road surface R estimation unit 21 includes in advance a non-uniform signal model, and the presence or absence of non-uniform location is determined from the percentage of coincidence with the non-uniform signal model. FIG. 22 illustrates an example of signal model diagrams indicating a case where a foot is placed on the step 91. The road surface R estimation unit 21 includes in advance multiple signal model diagrams, examples of which are illustrated in FIG. 22. When the percentage of coincidence with any one of the multiple signal model diagrams exceeds a predetermined threshold (such as 95%, as an example), the road surface R estimation unit 21 determines the presence of a step, and the road surface R estimation unit 21 sets R=0. For example, the states of the signals of the foot sensors 8*b* illustrated in FIG. 21 completely coincide with those in the second signal model diagram from the left in FIG. 22. Thus, the road surface R estimation unit 21 can determine the presence of a step.

The timing determination unit 23 outputs a signal for increasing the stiffness, based on gait cycle information that is an example of walk information about the user 100, which is output from the gait cycle estimation unit 20, during a period from immediately before a foot of the user 100 contacts the ground to when the foot leaves the road surface 90, thereby preventing the user 100 from falling and, at the same time, reducing the stiffness so as not to hinder the mobility of the joints of the foot when the foot is off the ground. Thus, for example, when the user 100 walks on the road surface 90 with an obstacle while adjusting the location to place their foot on, the user 100 can be prevented from falling without hindrance to the mobility of their foot.

As described above, in the first embodiment, stiffness is increased on the basis of road surface information in a state where the road surface 90 is a convex and concave surface which is likely to cause falling, thus preventing a user falling in their left-right direction during walking. For example, when the user 100 feels a fall while walking or running on the road surface 90, the stiffnesses for both side portions of the ankle or thigh of any one leg that is on the ground in the left-right direction can be increased at the same time to prevent the user 100 from falling. In contrast, when the road surface 90 is a flat surface with less convex and concave which is less likely to cause falling, the stiffnesses can be decreased to facilitate walking. In addition, for example, when about half the sole of a foot of the user 100 is above a ditch or an opening during walking, the road surface R estimation unit 21 can estimate information indicating that the leg touches the step 91 on the basis of the curvature R of the road surface 90 which is zero. As a result, the first stiffness target value output unit 24 can perform control to increase the stiffnesses to be transmitted to the left side surface and right side surface of the thigh or ankle to prevent a fall.

Second Embodiment

Figure 23:
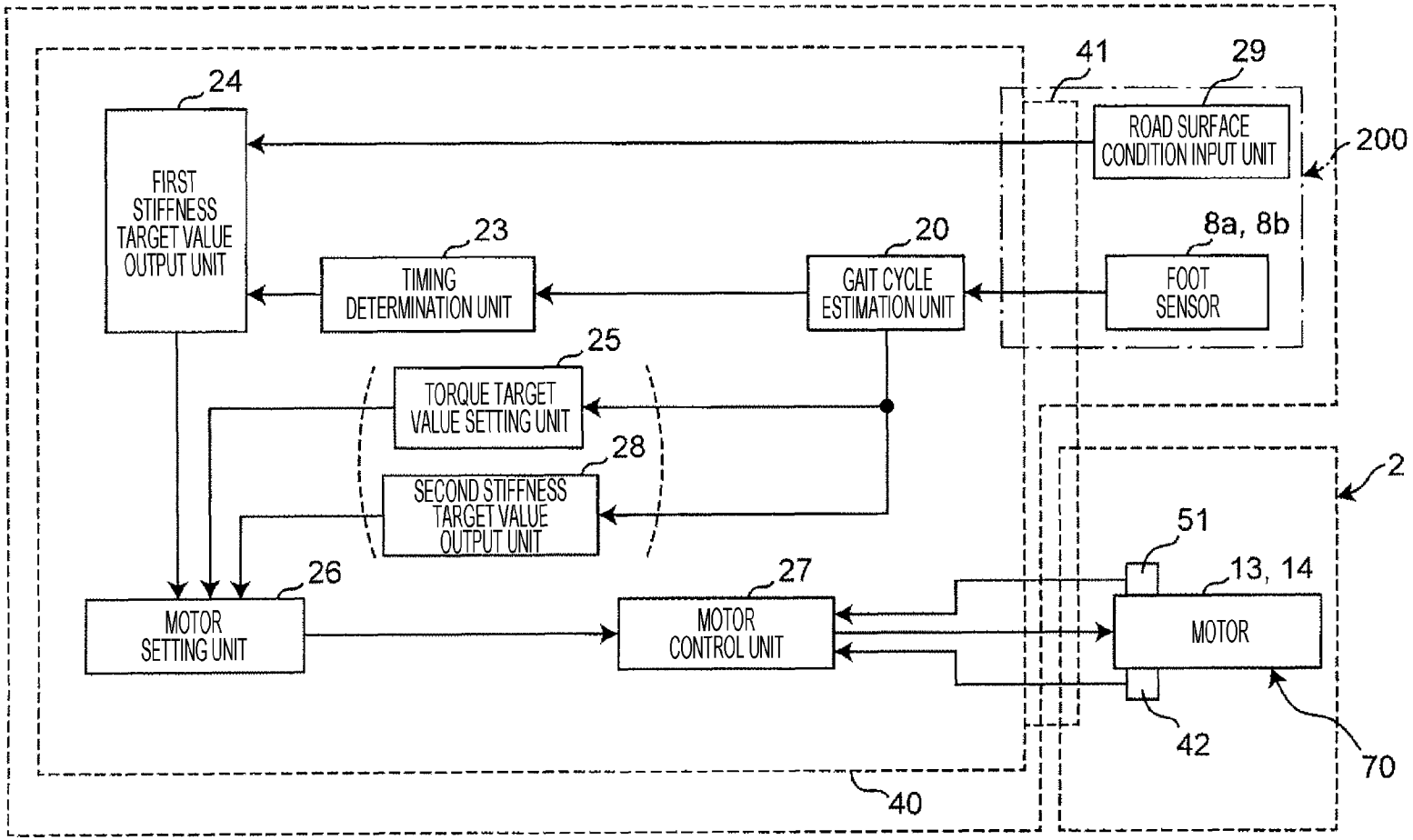
FIG. 23 is a block diagram illustrating a control device and a control target in an apparatus for fall prevention during walking according to a second embodiment of the present disclosure.

FIG. 23 is a block diagram illustrating a control device 3 and a control target in an assist system 1 as an example of an apparatus for fall prevention during walking according to a second embodiment of the present disclosure.

The control device 3 at least includes a gait cycle estimation unit 20, a timing determination unit 23, a first stiffness target value output unit 24, a motor setting unit 26, and a motor control unit 27.

The assist pants 2*a* include, as a portion of constituent elements of the input interface unit 200, a road surface condition input unit 29 as an example of a road surface condition obtaining unit that obtains information about road surface conditions (for example, road surface conditions that are likely to cause falling) as road surface information. The road surface condition input unit 29 functions as an example of an information obtaining unit. Specifically, for example, the road surface condition input unit 29 can be implemented as a touch panel attached to the assist pants 2*a* and connected to the control device 3 or as a mobile device such as a smartphone separate from the assist pants 2*a* and connectable with the control device 3. The road surface condition obtaining unit may be referred to as a road surface condition obtainer.

The road surface condition input unit 29 includes an input unit operated by the user 100 to input current road surface conditions (i.e., at the start of walking or during walking). The road surface condition input unit 29 outputs information about the current road surface conditions (i.e., at the start of walking or during walking) input by the user 100 to the first stiffness target value output unit 24. For example, the road surface condition input unit 29 is a device used by the user 100 to input information about road surface conditions that are likely to cause falling, such as a wet state of the road surface 90 when the weather is snowy or rainy, a slippery material of the road surface 90, or any other road surface condition that is likely to cause falling.

Figure 24:
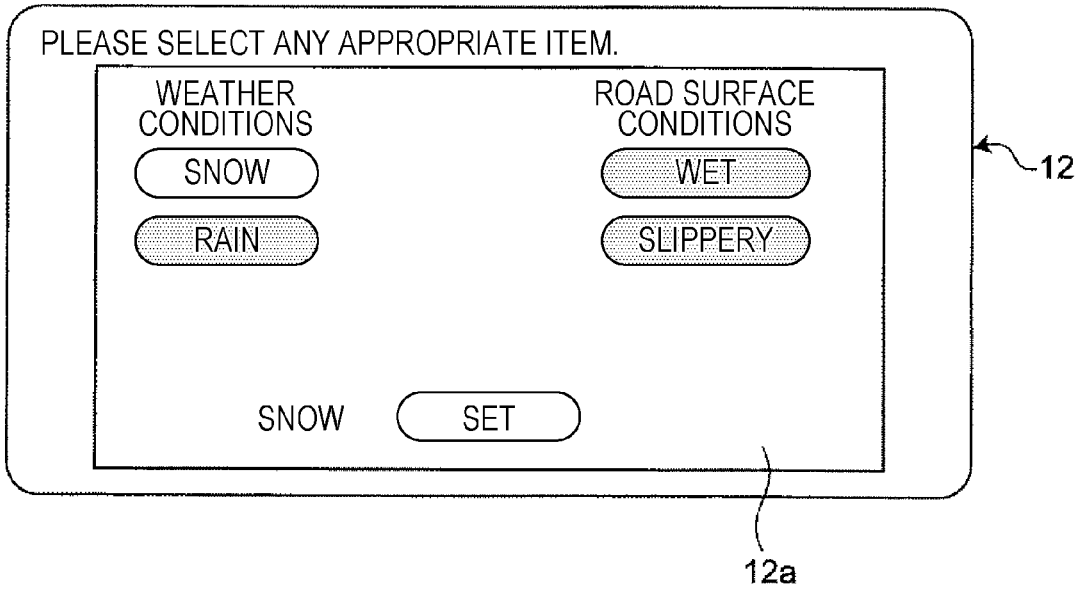
FIG. 24 is a diagram illustrating an example of a road surface condition input unit in the second embodiment of the present disclosure.

FIG. 24 is a diagram illustrating a display screen 12*a* of a touch panel 12 as an example of the road surface condition input unit 29. The user 100 is able to select conditions of the road surface 90 at the time when, as an example of conditions that are likely to cause falling, the weather is snowy or rainy, when the road surface 90 is wet, or when the road surface 90 is made of a slippery material. The example in FIG. 24 describes a state where the user 100 selects a "snow" button and presses a "set" button, thereby being able to output information about road surface conditions indicating "snow" to the first stiffness target value output unit 24. The road surface condition input unit 29 outputs the information selected by the user 100 to the first stiffness target value output unit 24 as road surface information.

The first stiffness target value output unit 24 determines a stiffness target value for motion in the frontal direction when the stiffness is increased, on the basis of the road surface information input from the road surface condition input unit 29. Then, the first stiffness target value output unit 24 selects whether the determined stiffness target value is a higher stiffness target value or a lower stiffness target value than a current stiffness value (during walking or at the start of walking) in accordance with the stiffness change timing signal output from the timing determination unit 23.

Figures 25A, 25B, 25C:
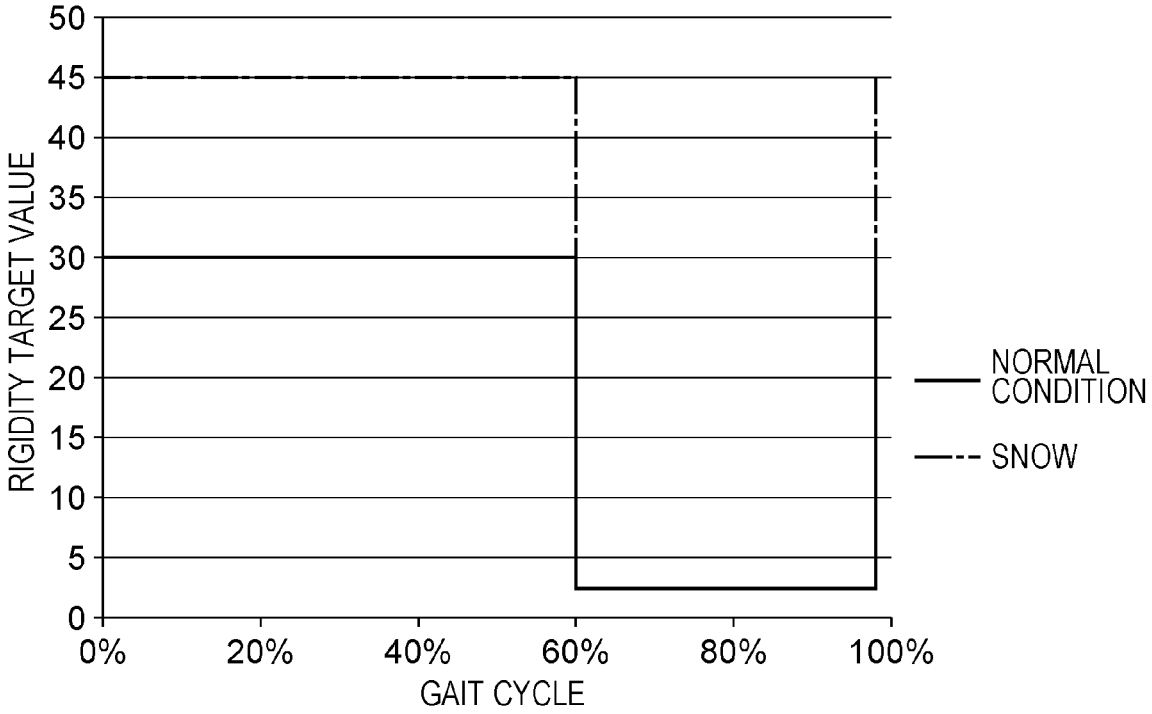
FIG. 25A is a diagram illustrating an example of the operation of a first stiffness target value output unit in the second embodiment of the present disclosure.
FIG. 25B is a diagram illustrating an example of the operation of the first stiffness target value output unit in the second embodiment of the present disclosure.
FIG. 25C is a diagram illustrating a graph depicting an example of the operation of the first stiffness target value output unit in the second embodiment of the present disclosure.

As an example, FIG. 25A to FIG. 25C illustrate the output of the stiffness for the right foot as an example of the operation of the first stiffness target value output unit 24.

In the example illustrated in FIG. 25A to FIG. 25C, first, FIG. 25A illustrates relationship information on a relationship between road surface conditions and a rate of increase in stiffness value. As illustrated in FIG. 25A, a value indicating how high to set each stiffness target value relative to a stiffness value under normal conditions is stored in the first stiffness target value output unit 24 in advance. For example, a stiffness target value under normal conditions is set to 1.0 time. In this case, in an example in which "snow" is selected, the first stiffness target value output unit 24 sets the stiffness target value to be 1.5 times that under normal conditions.

Then, as illustrated in FIG. 25B, stiffness target values for which stiffnesses under normal conditions are increased for the right foot are stored. In this example, high stiffness target values are set in a period from 98% of the current gait cycle to 60% of the next gait cycle. In this example, "snow" is selected as road surface conditions. Since the rate of increase is 1.5 times, high stiffness target values under normal conditions are 30, whereas stiffness target values for "snow" are calculated to be 1.5 times those under normal conditions, that is, 45, by the first stiffness target value output unit 24. Even if "snow" is selected, the right foot is not on the ground in 60% to 98% of the current gait cycle and there is no need to increase the stiffness target value. Thus, the stiffness target value is not changed.

A comparison between stiffness target values to be output in the gait cycle of the right foot under normal conditions and snow conditions is illustrated in FIG. 25C.

Other configuration and operation are similar to those in the first embodiment.

According to the second embodiment, therefore, the forward and reverse rotation operations of the motors 13 or 14 are independently controlled based on the road surface information obtained by the road surface condition input unit 29, such as slippery road surface conditions, thereby adjusting the respective lengths of the wires 10 or 11, and the first stiffness target value output unit 24 can change the stiffnesses to be transmitted to the left side surface and right side surface of each thigh or ankle, which are imparted to the wires 10 or 11, to larger values. As a result, the user 100 can be prevented from falling in their left-right direction during walking.

The first and second embodiments described above describe, as a non-limiting example, the assist pants 2*a* for assisting in the stiffnesses to be transmitted to the left side surface and right side surface of the thighs and the ankle joints.

Modifications

Figure 26:
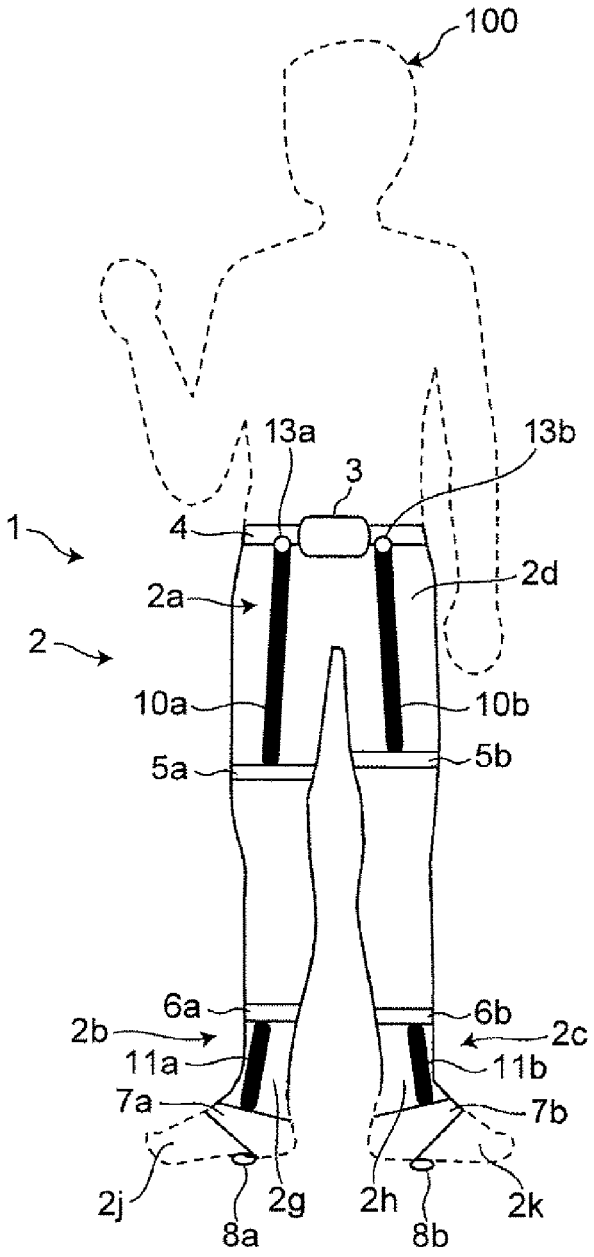
FIG. 26 is a diagram illustrating an overview of an assist system in a modification of the first and second embodiments of the present disclosure.
Figure 27:
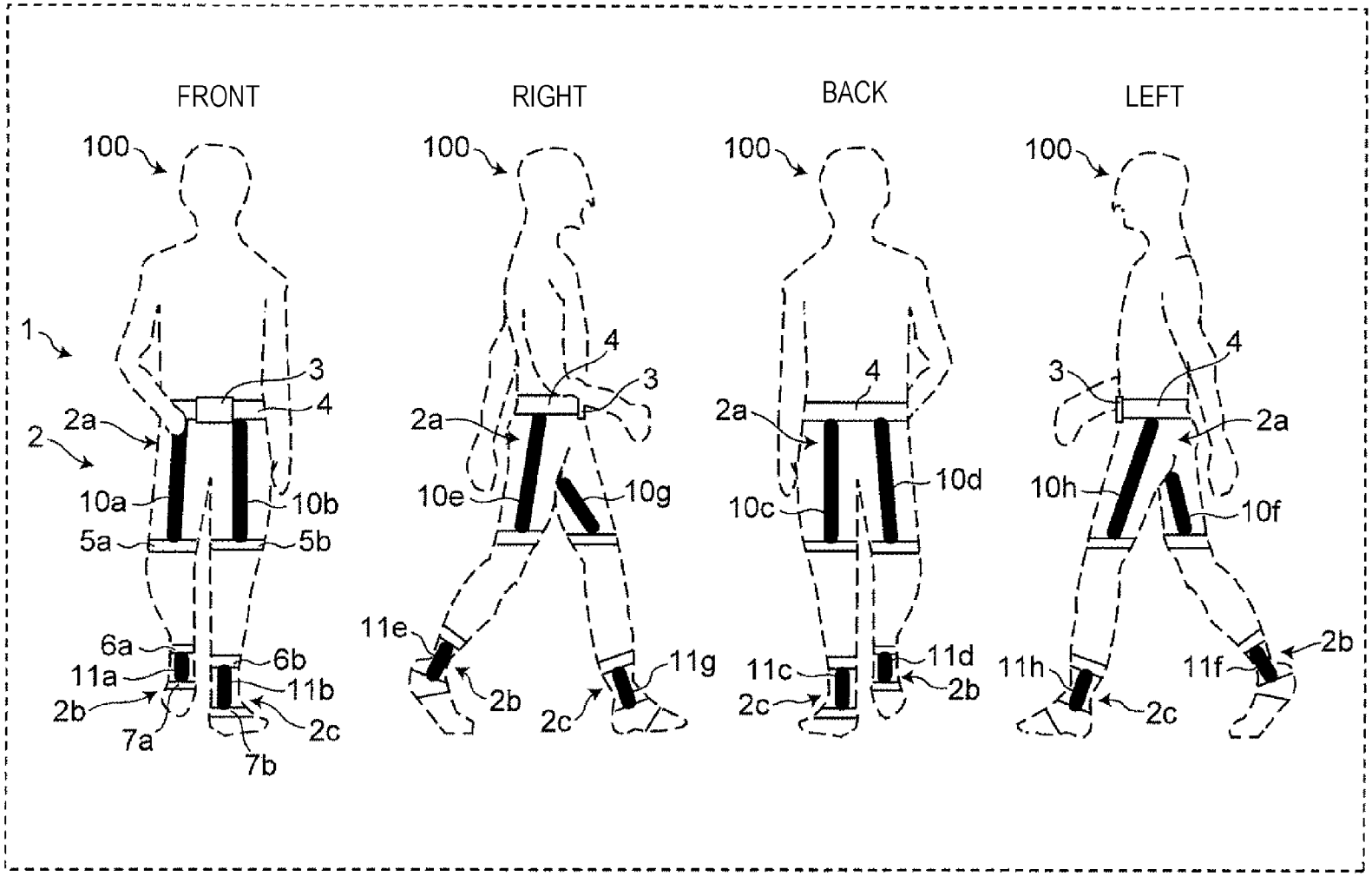
FIG. 27 is a diagram illustrating the arrangement of wires in assist pants in the modification of the first and second embodiments of the present disclosure.
Figure 29:
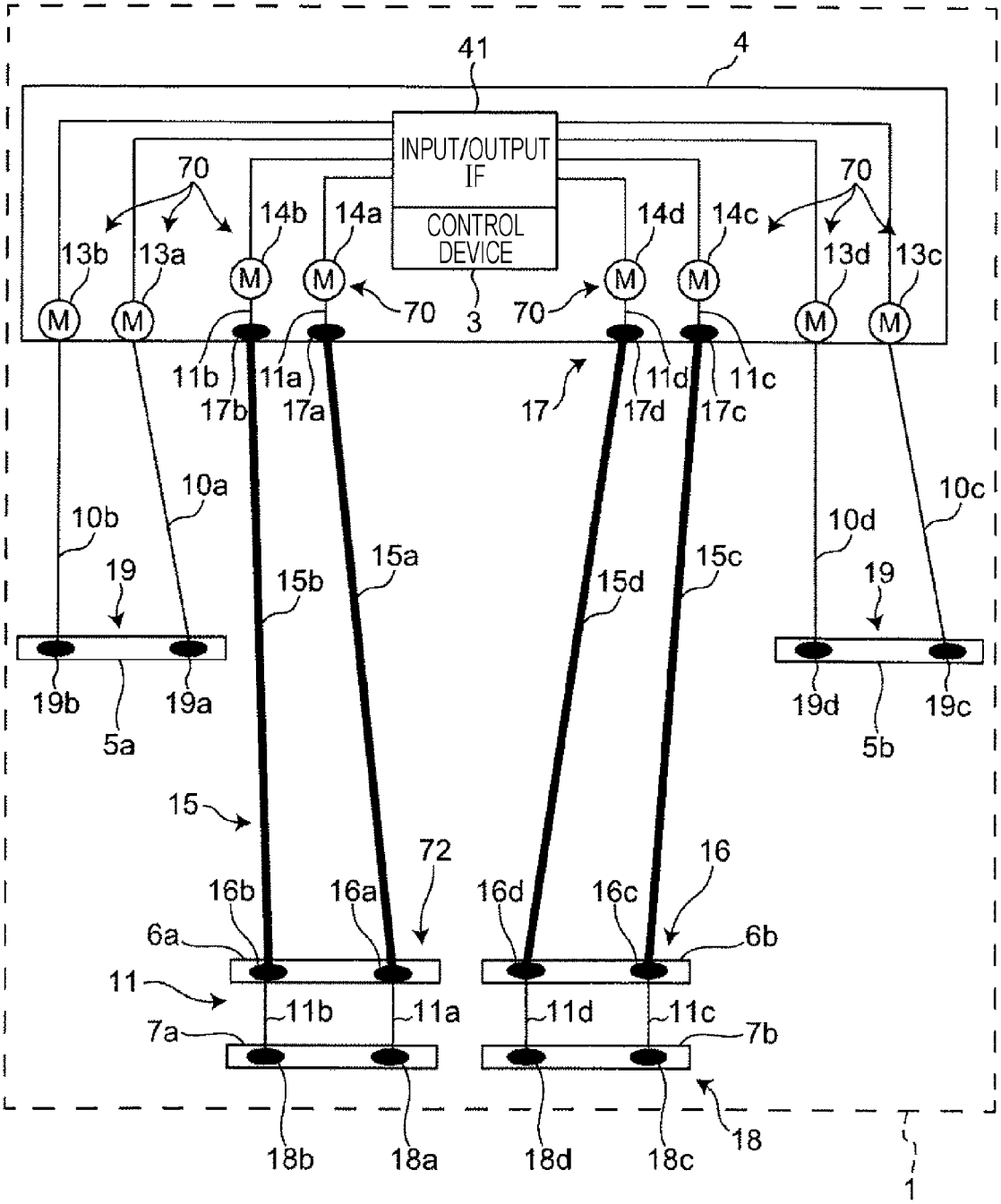
FIG. 29 is an explanatory diagram illustrating the configuration of an apparatus for fall prevention during walking in the modification of the first and second embodiments of the present disclosure.

As a modification of the embodiment, a function of assisting the user 100 in their walking activities in the forward-backward direction may be added. In this case, as illustrated in FIG. 26, FIG. 27, and FIG. 29, the thigh wires 10 may additionally include front and back wires 10*a* and 10*d* of the thigh of the right leg and front and back wires 10*b* and 10*c* of the thigh of the left leg. Further, the motors 13 may additionally include motors 13*a*, 13*d*, 13*b*, and 13*c* respectively corresponding to the wires 10*a*, 10*d*, 10*b*, and 10*c*. For similar purposes, the ankle wires 11 may further include front and back wires 11*a* and 11*d* of the right ankle and front and back wires 11*b* and 11*c* of the left ankle. Further, the motors 14 may further include motors 14*a*, 14*d*, 14*b*, and 14*c* respectively corresponding to the wires 11*a*, 11*d*, 11 *b*, and 11*c*. The control device 3 performs control to independently control the additional motors 13*a*, 13*d*, 13*b*, and 13*c* and the additional motors 14*a*, 14*d*, 14*b*, and 14*c* on the basis of user information and walk information, thereby changing the forward/backward assistance forces of the thighs or the ankles.

Specifically, as illustrated in FIG. 26, FIG. 27, and FIG. 29, the assist pants 2*a* include, as the additional thigh wires 10, the thigh wires 10*a* and 10*b* on the front side, which are located in portions of the assist pants body 2*d* corresponding to anterior surfaces of the right leg and left leg, and the thigh wires 10*d* and 10*c* on the back side, which are located in portions corresponding to posterior surfaces of the right leg and the left leg. Further, the assist ankle bands 2*b* and 2*c* include, as the additional ankle wires 11, the ankle wires 11*a* and 11*b* on the front side, which are located in portions corresponding to anterior surfaces of the ankles between the upper ankle belts 6*a* and 6*b* and the heel belts 7*a* and 7*b*, and the ankle wires 11*d* and 11*c* on the back side, which are located in portions corresponding to posterior surfaces of the ankles between the upper ankle belts 6*a* and 6*b* and the heel belts 7*a* and 7*b*. Note that elements similar to those illustrated in FIG. 2, such as the ankle outer wires 15, the lower-end ankle outer wire attachment units 16, the upper-end ankle outer wire attachment units 17, the lower-end ankle wire attachment units 18, and the lower-end thigh wire attachment units 19, are assigned similar numerals and will not be described herein.

The thigh wires 10*a* and 10*d* are in antagonistic relation to each other, and the thigh wires 10*b* and 10*c* are in antagonistic relation to each other. The control device 3 performs operation control to drive the pair of thigh wires 10*a* and 10*d* on the front side and back side of the right leg, which are in antagonistic relation to each other, to be pulled apart from each other, thereby allowing a forward/backward torque of the right thigh to be generated in the thigh of the right leg. Further, the control device 3 performs operation control to drive the pair of thigh wires 10*b* and 10*c* on the front side and back side of the left leg, which are in antagonistic relation to each other, to be pulled apart from each other, thereby allowing a forward/backward torque of the left thigh to be generated in the thigh of the left leg.

Also for the ankle wires 11, the ankle wires 11*a* and 11*d* are in antagonistic relation to each other, and the ankle wires 11*b* and 11*c* are in antagonistic relation to each other. The control device 3 performs operation control to drive the pair of right ankle wires 11*a* and 11*d*, which are in antagonistic relation to each other, to be pulled apart from each other, thereby generating a forward/backward torque of the right ankle. Further, the control device 3 performs operation control to drive the pair of left ankle wires 11*b* and 11*c*, which are in antagonistic relation to each other, to be pulled apart from each other, thereby generating a forward/backward torque of the left ankle.

In this modification, as an example, the control device 3 can further include the torque target value setting unit 25 and the second stiffness target value output unit 28 for walking assistance.

The torque target value setting unit 25 outputs a torque target value for assisting in walking on the basis of the gait cycle information output from the gait cycle estimation unit 20. The torque target value setting unit 25 stores in advance target torque values for the gait cycle information, determines torque values for assisting in walking, that is, target values of torque in the sagittal direction for moving the left and right legs in the forward-backward direction, on the basis of the target torque values, and outputs the determined target values of torque in the sagittal direction to the motor setting unit 26. The torques in the sagittal direction for moving the left and right legs in the forward-backward direction refer to the forward/backward torque of the right thigh, which is generated by the pair of thigh wires 10*a* and 10*d*, the forward/backward torque of the left thigh, which is generated by the pair of thigh wires 10*b* and 10*c*, the forward/backward torque of the right ankle joint, which is generated by the pair of ankle wires 11*a* and 11*d*, and the forward/backward torque of the left ankle joint, which is generated by the pair of ankle wires 11*b* and 11*c*. The torque target value setting unit 25 outputs the torque target value 0 for the motion in the frontal direction.

Figure 28:
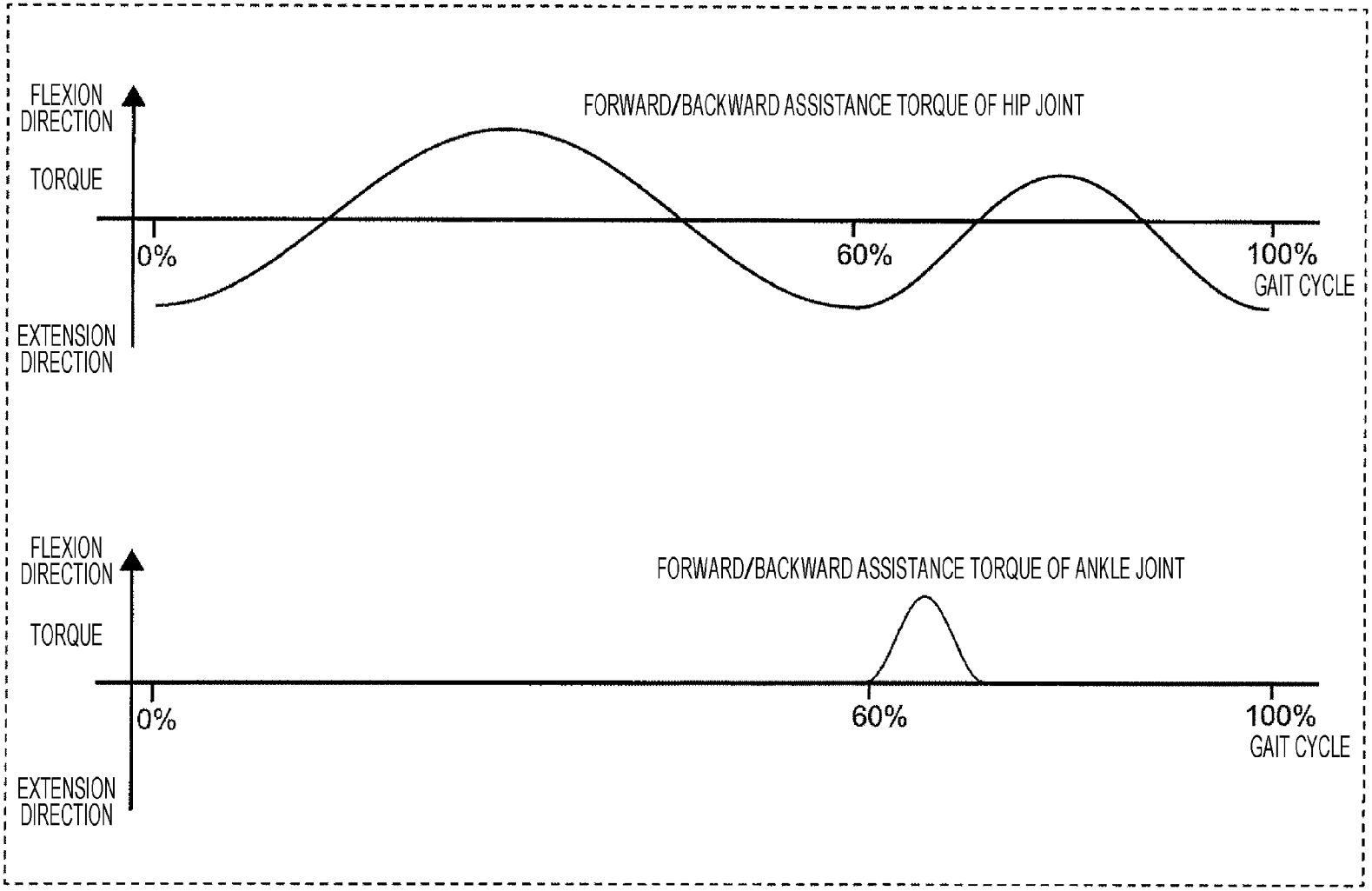
FIG. 28 is a diagram illustrating example torques of a thigh and an ankle joint in the modification of the first and second embodiments of the present disclosure.

The upper and lower graphs in FIG. 28 are diagrams illustrating an example of torque target values for the forward and backward movement of the hip joint of a leg, or the thigh, and the ankle joint (in other words, the forward/backward assistance torque of the thigh and the forward/backward assistance torque of the ankle joint), respectively. The forward/backward assistance torque of the thigh refers to an assistance torque for the forward and backward movement of the thigh, which is generated by the pair of wires 10*a* and 10*d* and the pair of wires 10*b* and wire 10*c*. The forward/backward assistance torque of the ankle joint refers to an assistance torque for the forward and backward movement of the ankle joints, which is generated by the pair of wires 11*a* and 11*d* and the pair of wires 11*b* and 11*c*. In the example in FIG. 28, the pair of wires 10*a* and 10*d* and the pair of wires 10*b* and 10*c* cause the left foot to flex and then extend during a period within the gait cycle from when the left foot contacts the road surface 90 to when the foot leaves the road surface 90 to generate an assistance force. Likewise, the pair of wires 11*a* and 11*d* and the pair of wires 11*b* and 11*c* cause the left ankle to flex during a period within the gait cycle from when the left foot contacts the road surface 90 to when the foot leaves the road surface 90 to generate an assistance force.

The second stiffness target value output unit 28 determines a stiffness target value for the movement in the sagittal direction on the basis of the gait cycle information output from the gait cycle estimation unit 20, and the determined stiffness target value for the movement in the sagittal direction is output from the second stiffness target value output unit 28 to the motor setting unit 26. The stiffness target value for the movement in the sagittal direction is determined in advance as a function of the gait cycle information and is stored in the second stiffness target value output unit 28.

As in the first and second embodiments, the motor setting unit 26 sets the setting values of the motors 13 and 14 corresponding to the thigh and ankle wires 10 and 11 on the basis of the target values of stiffness output from the second stiffness target value output unit 28 and the torque target values output from the torque target value setting unit 25 in addition to the target values of stiffness output from the first stiffness target value output unit 24, and the set values of the motors 13 and 14 corresponding to the thigh and ankle wires 10 and 11 are output from the motor setting unit 26 to the motor control unit 27.

The first, second, fourth, and fifth graphs in FIG. 17 illustrate example relationships between the gait cycles of the thigh wires 10*a*, 10*d*, 11*a*, and 11*d* of the right foot and target moduli of elasticity to be simulated, respectively.

As depicted in the first and second graphs in FIG. 17, the wires 10*a* and 10*d* are wires for assisting in the forward/backward torque of the thigh and stiffness simulated as spring stiffness. In the example, stiffness is simulated as spring stiffness in the forward-backward direction but is not assisted, whereas only the torque is assisted. In this case, the first stiffness target value output unit 24 performs control to increase the tension of the wire 10*d*, which is a wire on the back side of the thigh, when an assistance torque in an extension direction in which the leg is swung backwards is necessary on the basis of information about the gait cycle, and to increase the tension of the wire 10*a*, which is a wire on the front side of the thigh, when an assistance torque in an opposite direction is necessary on the basis of the information about the gait cycle.

As depicted in the fourth and fifth graphs FIG. 17, also for the ankle, when generating an assistance torque for causing the ankle to flex, the first stiffness target value output unit 24 performs control to increase the tension of the wire 11*d*, which is a wire on the back side of the ankle, when an assistance torque in an extension direction in which the ankle is flexed backwards is necessary on the basis of information about the gait cycle, and to increase the tension of the wire 11*a*, which is a wire on the front side of the ankle, when an assistance torque in an opposite direction is necessary on the basis of the information about the gait cycle.

According to this modification, forward-backward assistance provided to the user 100 while walking and assistance for the stiffnesses on the left side surface and right side surface of the intended portion of the user can be achieved at the same time.

Figure 30:
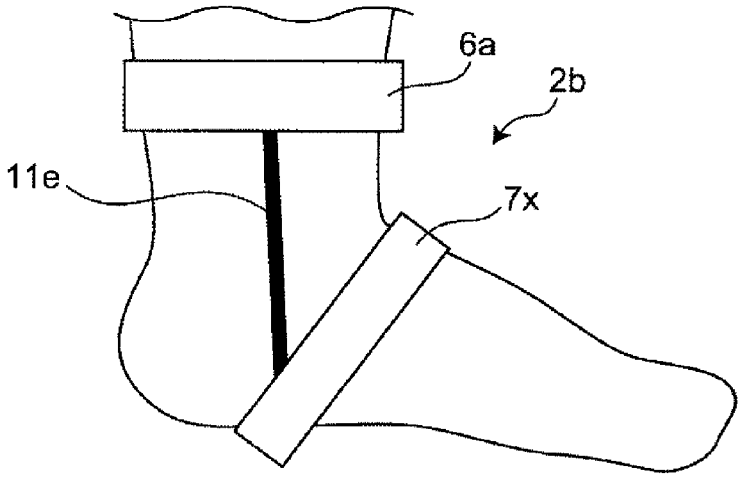
FIG. 30 is an explanatory diagram illustrating another example lower ankle belt of the apparatus for fall prevention during walking in the modification of the first and second embodiments of the present disclosure.

FIG. 30 is an explanatory diagram illustrating another example of a lower ankle belt of the apparatus for fall prevention during walking. The lower ankle belt is not limited to the heel belt 7*a*, which extends across the heel, but may be a lower ankle belt 7*x* extending from the instep to a portion closer to the toe, rather than extending across the heel.

Further, the tension application mechanism 70 that applies a tension has been described in the embodiment described above in the context of the configuration of the motor 14 and the like, as a non-limiting example. A linear actuator can also achieve similar operational effects.

While the present disclosure has been described with reference to the first and second embodiments and modification, it goes without saying that the present disclosure is not limited to the first and second embodiments and modification described above. Following configurations are also included in the present disclosure.

The entirety or part of the control device 3 is a computer system including, specifically, a microprocessor, a ROM, a RAM, a hard disk unit, and so on. The RAM or the hard disk unit stores a computer program. The microprocessor operates in accordance with the computer program, thereby allowing each unit to achieve its function. The computer program is constituted by a combination of multiple command codes for providing instructions to a computer to achieve a predetermined function.

For example, a software program recorded on a recording medium such as a hard disk or a semiconductor memory is read and executed by a program execution unit such as a CPU. Accordingly, each constituent element can be implemented.

Software implementing some or all of the elements constituting a control device according to the first and second embodiments or modification described above includes a program as follows.

That is, this program is a program for causing a computer to execute a control method for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire being located along a right side surface of the right ankle, at least a portion of the second wire being located along a left side surface of the right ankle, at least a portion of the third wire being located along a right side surface of the left ankle, at least a portion of the fourth wire being located along a left side surface of the left ankle, the control method including obtaining information about a road surface where the user walks; determining, based on the information about the road surface, a first stiffness target value of the first wire, a second stiffness target value of the second wire, a third stiffness target value of the third wire, and a fourth stiffness target value of the fourth wire; controlling a tension of the first wire using the first stiffness target value; controlling a tension of the second wire using the second stiffness target value; controlling a tension of the third wire using the third stiffness target value; and controlling a tension of the fourth wire using the fourth stiffness target value, wherein the tension of the first wire and the tension of the second wire are controlled at a same time, and the tension of the third wire and the tension of the fourth wire are controlled at a same time.

Another program is a program for causing a computer to execute a control method for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, the control method including obtaining information about a road surface where the user walks; determining, based on the information about the road surface, a fifth stiffness target value of the fifth wire, a sixth stiffness target value of the sixth wire, a seventh stiffness target value of the seventh wire, and an eighth stiffness target value of the eighth wire; controlling a tension of the fifth wire using the fifth stiffness target value; controlling a tension of the sixth wire using the sixth stiffness target value; controlling a tension of the seventh wire using the seventh stiffness target value; and controlling a tension of the eighth wire using the eighth stiffness target value, wherein the tension of the fifth wire and the tension of the sixth wire are controlled at a same time, and the tension of the seventh wire and the tension of the eighth wire are controlled at a same time.

The program may be downloaded from a server or the like and executed. Alternatively, the program may be executed by reading a program recorded on a predetermined recording medium (for example, an optical disk such as a CD-ROM, a magnetic disk, a semiconductor memory, or the like).

The program may be executed by a single computer or multiple computers. That is, centralized processing or distributed processing may be performed.

Any of the various embodiments or modifications described above may be combined as appropriate to achieve advantages included in each embodiment or modification. In addition, a combination of embodiments, a combination of modifications, or a combination of an embodiment and a modification is possible. Additionally, a combination of features in different embodiments or modifications is also possible.

An apparatus for fall prevention during walking, a control device, a control method, and a program according to the aspects of the present disclosure described above are suitable for use as an apparatus for fall prevention during walking, which is worn by a user to assist the user in activities, a control device and control method for the apparatus for fall prevention during walking, and a control program for the apparatus for fall prevention during walking.

What is claimed is:

1. An apparatus for fall prevention during walking, comprising:

a left upper ankle belt to be fixed on an upper part of a left ankle of a user;

a right upper ankle belt to be fixed on an upper part of a right ankle of the user;

a left lower ankle belt to be fixed on a lower part of the left ankle of the user;

a right lower ankle belt to be fixed on a lower part of the right ankle of the user;

a first wire coupled to the right upper ankle belt and the right lower ankle belt;

a second wire coupled to the right upper ankle belt and the right lower ankle belt, at least a portion of the first wire configured to be located along a right side surface of the right ankle, at least a portion of the second wire configured to be located along a left side surface of the right ankle;

a third wire coupled to the left upper ankle belt and the left lower ankle belt;

a fourth wire coupled to the left upper ankle belt and the left lower ankle belt, at least a portion of the third wire configured to be located along a right side surface of the left ankle, at least a portion of the fourth wire configured to be located along a left side surface of the left ankle;

a first tension controller configured to control a tension of the first wire;

a second tension controller configured to control a tension of the second wire;

a third tension controller configured to control a tension of the third wire;

a fourth tension controller configured to control a tension of the fourth wire;

an obtainer configured to obtain information about a road surface where the user walks; and a controller, wherein the controller determines, based on the information about the road surface, a first stiffness target value of the first wire, a second stiffness target value of the second wire, a third stiffness target value of the third wire, and a fourth stiffness target value of the fourth wire, the controller causes the first tension controller to control the tension of the first wire using the first stiffness target value, the controller causes the second tension controller to control the tension of the second wire using the second stiffness target value, the controller causes the third tension controller to control the tension of the third wire using the third stiffness target value, the controller causes the fourth tension controller to control the tension of the fourth wire using the fourth stiffness target value, the tension of the first wire and the tension of the second wire are controlled at a same time, and the tension of the third wire and the tension of the fourth wire are controlled at a same time.

2. The apparatus for fall prevention during walking according to claim 1, wherein the first tension controller includes a first motor having a first rotating shaft to which the first wire is coupled, the first motor controlling rotation of the first rotating shaft to thereby control the tension of the first wire, the second tension controller includes a second motor having a second rotating shaft to which the second wire is coupled, the second motor controlling rotation of the second rotating shaft to thereby control the tension of the second wire, the third tension controller includes a third motor having a third rotating shaft to which the third wire is coupled, the third motor controlling rotation of the third rotating shaft to thereby control the tension of the third wire, the fourth tension controller includes a fourth motor having a fourth rotating shaft to which the fourth wire is coupled, the fourth motor controlling rotation of the fourth rotating shaft to thereby control the tension of the fourth wire, and the controller instructs the first motor to control the rotation of the first rotating shaft, instructs the second motor to control the rotation of the second rotating shaft, instructs the third motor to control the rotation of the third rotating shaft, and instructs the fourth motor to control the rotation of the fourth rotating shaft.

3. The apparatus for fall prevention during walking according to claim 2, wherein the controller (i) provides an instruction to control the rotation of the first rotating shaft on the basis of a force generated in the first wire, provides an instruction to control the rotation of the second rotating shaft on the basis of a force generated in the second wire, provides an instruction to control the rotation of the third rotating shaft on the basis of a force generated in the third wire, and provides an instruction to control the rotation of the fourth rotating shaft on the basis of a force generated in the fourth wire, or (ii) provides an instruction to control the rotation of the first rotating shaft on the basis of a length of the first wire, provides an instruction to control the rotation of the second rotating shaft on the basis of a length of the second wire, provides an instruction to control the rotation of the third rotating shaft on the basis of a length of the third wire, and provides an instruction to control the rotation of the fourth rotating shaft on the basis of a length of the fourth wire.

4. The apparatus for fall prevention during walking according to claim 1, further comprising:

a waist belt to be fixed on a waist of the user;

a left above-knee belt to be fixed above a knee of the left leg;

a right above-knee belt to be fixed above a knee of the right leg;

a fifth wire coupled to the waist belt and the right above-knee belt;

a sixth wire coupled to the waist belt and the right above-knee belt;

a seventh wire coupled to the waist belt and the left above-knee belt;

an eighth wire coupled to the waist belt and the left above-knee belt, at least a portion of a fifth wire configured to be located on a right side surface of a right thigh of the user, at least a portion of a sixth wire configured to be located on a left side surface of the right thigh, at least a portion of the seventh wire configured to be located on a right side surface of a left thigh of the user, at least a portion of the eighth wire configured to be located on a left side surface of the left thigh;

a fifth tension controller configured to control a tension of the fifth wire;

a sixth tension controller configured to control a tension of the sixth wire;

a seventh tension controller configured to control a tension of the seventh wire; and an eighth tension controller configured to control a tension of the eighth wire, wherein the controller determines, based on the information about the road surface, a fifth stiffness target value of the fifth wire, a sixth stiffness target value of the sixth wire, a seventh stiffness target value of the seventh wire, and an eighth stiffness target value of the eighth wire, the controller causes the fifth tension controller to control the tension of the fifth wire using the fifth stiffness target value, the controller causes the sixth tension controller to control the tension of the sixth wire using the sixth stiffness target value, the controller causes the seventh tension controller to control the tension of the seventh wire using the seventh stiffness target value, the controller causes the eighth tension controller to control the tension of the eighth wire using the eighth stiffness target value, the tension of the fifth wire and the tension of the sixth wire are controlled at a same time, and the tension of the seventh wire and the tension of the eighth wire are controlled at a same time.

5. The apparatus for fall prevention during walking according to claim 4, wherein the fifth tension controller includes a fifth motor having a fifth rotating shaft to which the fifth wire is coupled, the fifth motor controlling rotation of the fifth rotating shaft to thereby control the tension of the fifth wire, the sixth tension controller includes a sixth motor having a sixth rotating shaft to which the sixth wire is coupled, the sixth motor controlling rotation of the sixth rotating shaft to thereby control the tension of the sixth wire, the seventh tension controller includes a seventh motor having a seventh rotating shaft to which the seventh wire is coupled, the seventh motor controlling rotation of the seventh rotating shaft to thereby control the tension of the seventh wire, the eighth tension controller includes an eighth motor having an eighth rotating shaft to which the eighth wire is coupled, the eighth motor controlling rotation of the eighth rotating shaft to thereby control the tension of the eighth wire, and the controller instructs the fifth tension controller to control the rotation of the fifth rotating shaft, instructs the sixth tension controller to control the rotation of the sixth rotating shaft, instructs the seventh tension controller to control the rotation of the seventh rotating shaft, and instructs the eighth tension controller to control the rotation of the eighth rotating shaft.

6. The apparatus for fall prevention during walking according to claim 5, wherein the controller (i) provides an instruction to control the rotation of the fifth rotating shaft on the basis of a force generated in the fifth wire, provides an instruction to control the rotation of the sixth rotating shaft on the basis of a force generated in the sixth wire, provides an instruction to control the rotation of the seventh rotating shaft on the basis of a force generated in the seventh wire, and provides an instruction to control the rotation of the eighth rotating shaft on the basis of a force generated in the eighth wire, or (ii) provides an instruction to control the rotation of the fifth rotating shaft on the basis of a length of the fifth wire, provides an instruction to control the rotation of the sixth rotating shaft on the basis of a length of the sixth wire, provides an instruction to control the rotation of the seventh rotating shaft on the basis of a length of the seventh wire, and provides an instruction to control the rotation of the eighth rotating shaft on the basis of a length of the eighth wire.

7. The apparatus for fall prevention during walking according to claim 4, wherein the fifth stiffness target value is equal to the sixth stiffness target value, and the seventh stiffness target value is equal to the eighth stiffness target value.

8. The apparatus for fall prevention during walking according to claim 1, wherein the first stiffness target value is equal to the second stiffness target value, and the third stiffness target value is equal to the fourth stiffness target value.

9. The apparatus for fall prevention during walking according to claim 1, wherein the obtainer includes first foot sensors configured to be located on a sole of a right foot of the user, second foot sensors configured to be located on a sole of a left foot of the user, and a road surface R estimator, the first foot sensors are configured to obtain first contact state information about a contact between the right foot and the road surface when the user is walking, the second foot sensors are configured to obtain second contact state information about a contact between the left foot and the road surface when the user is walking, the road surface R estimator obtains, based on contact state information including the first contact state information and the second contact state information, information about a curvature of the road surface as the information about the road surface, and the controller sets the first stiffness target value to be larger than an initially set value and sets the second stiffness target value to be larger than an initially set value when the information about the road surface includes a curvature of the road surface less than or equal to a threshold.

10. The apparatus for fall prevention during walking according to claim 1, wherein the obtainer includes first foot sensors configured to be located on a sole of a right foot of the user, second foot sensors configured to be located on a sole of a left foot of the user, and a road surface R estimator, the first foot sensors are configured to obtain first contact state information about a contact between the right foot and the road surface when the user is walking, the second foot sensors are configured to obtain second contact state information about a contact between the left foot and the road surface when the user is walking, the road surface R estimator obtains information about a curvature of the road surface as the information about the road surface on the basis of contact state information including the first contact state information and the second contact state information, and the controller sets the first stiffness target value to be smaller than an initially set value and sets the second stiffness target value to be smaller than an initially set value when the information about the road surface includes a curvature of the road surface larger than a threshold.

11. The apparatus for fall prevention during walking according to claim 1, wherein the obtainer includes first foot sensors configured to be located on a sole of a right foot of the user, second foot sensors configured to be located on a sole of a left foot of the user, and a road surface R estimator, the first foot sensors are configured to obtain first contact state information about a contact between the right foot and the road surface when the user is walking, the second foot sensors are configured to obtain second contact state information about a contact between the left foot and the road surface when the user is walking, and the road surface R estimator obtains information about a curvature of the road surface as the information about the road surface on the basis of contact state information obtained at a timing when the sole of the right foot touches the road surface and/or a timing when the sole of the left foot touches the road surface, the contact state information being included in the first contact state information and the second contact state information.

12. The apparatus for fall prevention during walking according to claim 1, wherein the obtainer includes first foot sensors configured to be located on a sole of a right foot of the user, second foot sensors configured to be located on a sole of a left foot of the user, and a road surface R estimator, the first foot sensors are configured to obtain first contact state information about a contact between the right foot and the road surface when the user is walking, the second foot sensors are configured to obtain second contact state information about a contact between the left foot and the road surface when the user is walking, the road surface R estimator obtains information about presence or absence of a step on the road surface as the information about the road surface on the basis of the first contact state information and the second contact state information, and the controller independently sets the first stiffness target value and the second stiffness target value, sets the first stiffness target value to be larger than an initially set value, and sets the second stiffness target value to be larger than an initially set value when the information about the road surface indicates that the road surface includes a step.

13. The apparatus for fall prevention during walking according to claim 1, wherein the obtainer includes first foot sensors configured to be located on a sole of a right foot of the user, second foot sensors configured to be located on a sole of a left foot of the user, and a road surface condition obtainer, the first foot sensors are configured to obtain first contact state information about a contact between the right foot and the road surface when the user is walking, the second foot sensors are configured to obtain second contact state information about a contact between the left foot and the road surface when the user is walking, the road surface condition obtainer obtains, based on the first contact state information and the second contact state information, information about road surface conditions that are likely to cause falling as the information about the road surface, and the controller independently sets the first stiffness target value and the second stiffness target value, sets the first stiffness target value to be larger than an initially set value, and sets the second stiffness target value to be larger than an initially set value when the information about the road surface indicates road surface conditions that are likely to cause falling.

14. An apparatus for fall prevention during walking, comprising:

a waist belt to be fixed on a waist of a user;

a left above-knee belt to be fixed above a knee of a left leg of the user;

a right above-knee belt to be fixed above a knee of a right leg of the user;

a fifth wire coupled to the waist belt and the right above-knee belt;

a sixth wire coupled to the waist belt and the right above-knee belt;

a seventh wire coupled to the waist belt and the left above-knee belt;

an eighth wire coupled to the waist belt and the left above-knee belt, at least a portion of a fifth wire configured to be located along a right side surface of a right thigh of the user, at least a portion of a sixth wire configured to be located along a left side surface of the right thigh, at least a portion of the seventh wire configured to be located along a right side surface of a left thigh of the user, at least a portion of the eighth wire configured to be located along a left side surface of the left thigh;

a fifth tension controller configured to control a tension of the fifth wire;

a sixth tension controller configured to control a tension of the sixth wire;

a seventh tension controller configured to control a tension of the seventh wire;

an eighth tension controller configured to control a tension of the eighth wire;

an obtainer configured to obtain information about a road surface where the user walks; and a controller, wherein the controller determines, based on the information about the road surface, a fifth stiffness target value of the fifth wire, a sixth stiffness target value of the sixth wire, a seventh stiffness target value of the seventh wire, and an eighth stiffness target value of the eighth wire, the controller causes the fifth tension controller to control the tension of the fifth wire using the fifth stiffness target value, the controller causes the sixth tension controller to control the tension of the sixth wire using the sixth stiffness target value, the controller causes the seventh tension controller to control the tension of the seventh wire using the seventh stiffness target value, the controller causes the eighth tension controller to control the tension of the eighth wire using the eighth stiffness target value, the tension of the fifth wire and the tension of the sixth wire are controlled at a same time, and the tension of the seventh wire and the tension of the eighth wire are controlled at a same time.

15. The apparatus for fall prevention during walking according to claim 14, wherein the fifth tension controller includes a fifth motor having a fifth rotating shaft to which the fifth wire is coupled, the fifth motor controlling rotation of the fifth rotating shaft to thereby control the tension of the fifth wire, the sixth tension controller includes a sixth motor having a sixth rotating shaft to which the sixth wire is coupled, the sixth motor controlling rotation of the sixth rotating shaft to thereby control the tension of the sixth wire, the seventh tension controller includes a seventh motor having a seventh rotating shaft to which the seventh wire is coupled, the seventh motor controlling rotation of the seventh rotating shaft to thereby control the tension of the seventh wire, the eighth tension controller includes an eighth motor having an eighth rotating shaft to which the eighth wire is coupled, the eighth motor controlling rotation of the eighth rotating shaft to thereby control the tension of the eighth wire, and the controller instructs the fifth tension controller to control the rotation of the fifth rotating shaft, instructs the sixth tension controller to control the rotation of the sixth rotating shaft, instructs the seventh tension controller to control the rotation of the seventh rotating shaft, and instructs the eighth tension controller to control the rotation of the eighth rotating shaft.

16. A control device for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire configured to be located along a right side surface of the right ankle, at least a portion of the second wire configured to be located along a left side surface of the right ankle, at least a portion of the third wire configured to be located along a right side surface of the left ankle, at least a portion of the fourth wire configured to be located along a left side surface of the left ankle, the control device comprising:

a first tension controller configured to control a tension of the first wire;

a second tension controller configured to control a tension of the second wire;

third tension controller configured to control a tension of the third wire;

a fourth tension controller configured to control a tension of the fourth wire;

an obtainer configured to obtain information about a road surface where the user walks; and a controller, wherein the controller determines, based on the information about the road surface, a first stiffness target value of the first wire, a second stiffness target value of the second wire, a third stiffness target value of the third wire, and a fourth stiffness target value of the fourth wire, the controller causes the first tension controller to control the tension of the first wire using the first stiffness target value, the controller causes the second tension controller to control the tension of the second wire using the second stiffness target value, the controller causes the third tension controller to control the tension of the third wire using the third stiffness target value, the controller causes the fourth tension controller to control the tension of the fourth wire using the fourth stiffness target value, the tension of the first wire and the tension of the second wire are controlled at a same time, and the tension of the third wire and the tension of the fourth wire are controlled at a same time.

17. A control device for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of a fifth wire configured to be located on a right side surface of a right thigh of the user, at least a portion of a sixth wire configured to be located on a left side surface of the right thigh, at least a portion of the seventh wire configured to be located on a right side surface of a left thigh of the user, at least a portion of the eighth wire configured to be located on a left side surface of the left thigh, the control device comprising:

a fifth tension controller configured to control a tension of the fifth wire;

a sixth tension controller configured to control a tension of the sixth wire;

a seventh tension controller configured to control a tension of the seventh wire;

an eighth tension controller configured to control a tension of the eighth wire;

an obtainer configured to obtain information about a road surface where the user walks; and a controller, wherein the controller determines, based on the information about the road surface, a fifth stiffness target value of the fifth wire, a sixth stiffness target value of the sixth wire, a seventh stiffness target value of the seventh wire, and an eighth stiffness target value of the eighth wire, the controller causes the fifth tension controller to control the tension of the fifth wire using the fifth stiffness target value, the controller causes the sixth tension controller to control the tension of the sixth wire using the sixth stiffness target value, the controller causes the seventh tension controller to control the tension of the seventh wire using the seventh stiffness target value, the controller causes the eighth tension controller to control the tension of the eighth wire using the eighth stiffness target value, the tension of the fifth wire and the tension of the sixth wire are controlled at a same time, and the tension of the seventh wire and the tension of the eighth wire are controlled at a same time.

18. A control method for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire being located along a right side surface of the right ankle, at least a portion of the second wire being located along a left side surface of the right ankle, at least a portion of the third wire being located along a right side surface of the left ankle, at least a portion of the fourth wire being located along a left side surface of the left ankle, the control method comprising:

obtaining information about a road surface where the user walks;

determining, based on the information about the road surface, a first stiffness target value of the first wire, a second stiffness target value of the second wire, a third stiffness target value of the third wire, and a fourth stiffness target value of the fourth wire;

controlling a tension of the first wire using the first stiffness target value;

controlling a tension of the second wire using the second stiffness target value;

controlling a tension of the third wire using the third stiffness target value; and controlling a tension of the fourth wire using the fourth stiffness target value, wherein the tension of the first wire and the tension of the second wire are controlled at a same time, and the tension of the third wire and the tension of the fourth wire are controlled at a same time.

19. A control method for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of the fifth wire being located on a right side surface of a right thigh of the user, at least a portion of the sixth wire being located on a left side surface of the right thigh, at least a portion of the seventh wire being located on a right side surface of a left thigh of the user, at least a portion of the eighth wire being located on a left side surface of the left thigh, the control method comprising:

obtaining information about a road surface where the user walks;

determining, based on the information about the road surface, a fifth stiffness target value of the fifth wire, a sixth stiffness target value of the sixth wire, a seventh stiffness target value of the seventh wire, and an eighth stiffness target value of the eighth wire;

controlling a tension of the fifth wire using the fifth stiffness target value;

controlling a tension of the sixth wire using the sixth stiffness target value;

controlling a tension of the seventh wire using the seventh stiffness target value; and controlling a tension of the eighth wire using the eighth stiffness target value, wherein the tension of the fifth wire and the tension of the sixth wire are controlled at a same time, and the tension of the seventh wire and the tension of the eighth wire are controlled at a same time.

20. A non-transitory recording medium a program for causing a computer to execute a control method for an apparatus including belts and wires, the belts including a left upper ankle belt to be fixed on an upper part of a left ankle of a user, a right upper ankle belt to be fixed on an upper part of a right ankle of the user, a left lower ankle belt to be fixed on a lower part of the left ankle of the user, and a right lower ankle belt to be fixed on a lower part of the right ankle of the user, the wires including a first wire coupled to the right upper ankle belt and the right lower ankle belt, a second wire coupled to the right upper ankle belt and the right lower ankle belt, a third wire coupled to the left upper ankle belt and the left lower ankle belt, and a fourth wire coupled to the left upper ankle belt and the left lower ankle belt, at least a portion of the first wire configured to be located along a right side surface of the right ankle, at least a portion of the second wire configured to be located along a left side surface of the right ankle, at least a portion of the third wire configured to be located along a right side surface of the left ankle, at least a portion of the fourth wire configured to be located along a left side surface of the left ankle, the recording medium being a non-volatile computer-readable recording medium, the control method comprising:

obtaining information about a road surface where the user walks;

determining, based on the information about the road surface, a first stiffness target value of the first wire, a second stiffness target value of the second wire, a third stiffness target value of the third wire, and a fourth stiffness target value of the fourth wire;

controlling a tension of the first wire using the first stiffness target value;

controlling a tension of the second wire using the second stiffness target value;

controlling a tension of the third wire using the third stiffness target value; and controlling a tension of the fourth wire using the fourth stiffness target value, wherein the tension of the first wire and the tension of the second wire are controlled at a same time, and the tension of the third wire and the tension of the fourth wire are controlled at a same time.

21. A non-transitory recording medium a program for causing a computer to execute a control method for an apparatus including belts and wires, the belts including a waist belt to be fixed on a waist of a user, a left above-knee belt to be fixed above a knee of a left leg of the user, and a right above-knee belt to be fixed above a knee of a right leg of the user, the wires including a fifth wire coupled to the waist belt and the right above-knee belt, a sixth wire coupled to the waist belt and the right above-knee belt, a seventh wire coupled to the waist belt and the left above-knee belt, and an eighth wire coupled to the waist belt and the left above-knee belt, at least a portion of a fifth wire configured to be located on a right side surface of a right thigh of the user, at least a portion of a sixth wire configured to be located on a left side surface of the right thigh, at least a portion of the seventh wire configured to be located on a right side surface of a left thigh of the user, at least a portion of the eighth wire configured to be located on a left side surface of the left thigh, the recording medium being a non-volatile computer-readable recording medium, the control method comprising:

obtaining information about a road surface where the user walks;

determining, based on the information about the road surface, a fifth stiffness target value of the fifth wire, a sixth stiffness target value of the sixth wire, a seventh stiffness target value of the seventh wire, and an eighth stiffness target value of the eighth wire;

controlling a tension of the fifth wire using the fifth stiffness target value;

controlling a tension of the sixth wire using the sixth stiffness target value;

controlling a tension of the seventh wire using the seventh stiffness target value; and controlling a tension of the eighth wire using the eighth stiffness target value, wherein the tension of the fifth wire and the tension of the sixth wire are controlled at a same time, and the tension of the seventh wire and the tension of the eighth wire are controlled at a same time.

* * * * *